US008983365B2

(12) United States Patent
Capparelli et al.

(10) Patent No.: US 8,983,365 B2
(45) Date of Patent: Mar. 17, 2015

(54) SYSTEMS AND METHODS FOR COMMUNICATING AND RENDERING ELECTRONIC PROGRAM GUIDE INFORMATION VIA DIGITAL RADIO BROADCAST TRANSMISSION

(75) Inventors: Armond R. Capparelli, Milltown, NJ (US); Joseph F. D'Angelo, Bedminster, NJ (US); Joseph P. Haggerty, Madison, NJ (US); Steven A. Johnson, Ellicott City, MD (US); Bei Li, Clarksville, MD (US); Lia Meller, Summit, NJ (US); Marek Milbar, Huntingdon Valley, PA (US); Jordan Scott, Cranford, NJ (US); Chinmay M. Shah, Piscataway, NJ (US); Kun Wang, New Providence, NJ (US); Girish K. Warrier, Edison, NJ (US); Christopher R. Gould, Epsom (GB)

(73) Assignee: iBiquity Digital Corporation, Columbia, MD (US)

( * ) Notice: Subject to any disclaimer, the term of this patent is extended or adjusted under 35 U.S.C. 154(b) by 1027 days.

(21) Appl. No.: 12/003,323

(22) Filed: Dec. 21, 2007

(65) Prior Publication Data

US 2009/0163137 A1 Jun. 25, 2009

(51) Int. Cl.

| | |
|---|---|
| ***H04H 40/00*** | (2008.01) |
| ***H04H 60/06*** | (2008.01) |
| ***H04H 60/07*** | (2008.01) |
| ***H04H 60/72*** | (2008.01) |
| *H04H 20/16* | (2008.01) |

(52) U.S. Cl.

CPC ..... *H04H 60/06* (2013.01); *H04H 20/16* (2013.01); *H04H 60/07* (2013.01); *H04H 60/72* (2013.01); *H04H 2201/183* (2013.01); *H04H 2201/186* (2013.01)

USPC ..... 455/3.06; 725/62; 725/74; 725/32

(58) Field of Classification Search

USPC ..... 455/3.06, 121; 725/32, 80, 95, 39, 90, 725/64; 370/514, 473; 348/E7.071, 731, 348/E17.005, E5.105, E7.061, E7.073, 348/423.1, 429.1

See application file for complete search history.

(56) References Cited

U.S. PATENT DOCUMENTS 5,134,709 A 7/1992 Bi et al.
5,541,738 A 7/1996 Mankovitz (Continued)

OTHER PUBLICATIONS

NRSC-5-A IBOC Standard dated Sep. 2005 (Source: http://www.nrscstandards.org).

(Continued)

*Primary Examiner* — Golam Sorowar
(74) *Attorney, Agent, or Firm* — Jones Day

(57) ABSTRACT

Methods and systems for preparing data for broadcast via digital radio broadcast transmission is disclosed comprising the steps of receiving a plurality of content files corresponding to programming information for program content to be broadcast; receiving an index file having a pointer for each of the plurality of content files, wherein the index file is associated with a first logical address; storing the index file and the plurality of content files; scheduling a broadcast rotation of the index file and the plurality of content files (wherein the index file is scheduled for repeated transmission intermittently relative to selected ones of the content files); and transmitting the index file and the plurality of content files to an importer in accordance with the broadcast rotation.

118 Claims, 39 Drawing Sheets

(56) References Cited

U.S. PATENT DOCUMENTS

| | | | | |
|---|---|---|---|---|
| 5,703,795 | A | 12/1997 | Mankovitz | |
| 5,886,733 | A * | 3/1999 | Zdepski et al. | 725/64 |
| 5,974,222 | A | 10/1999 | Yuen et al. | |
| RE37,131 | E | 4/2001 | Mankovitz | |
| 6,466,734 | B2 | 10/2002 | Yuen et al. | |
| 6,553,077 | B2 | 4/2003 | Rindsberg et al. | |
| 6,658,062 | B1 * | 12/2003 | Nakatsuyama | 375/259 |
| 6,668,133 | B2 | 12/2003 | Yuen et al. | |
| 6,671,454 | B1 | 12/2003 | Kaneko et al. | |
| RE38,600 | E | 9/2004 | Mankovitz | |
| 6,904,609 | B1 | 6/2005 | Pietraszak et al. | |
| 6,920,641 | B1 | 7/2005 | Hanai et al. | |
| 6,980,769 | B2 | 12/2005 | Toporski | |
| 7,051,280 | B1 * | 5/2006 | Ko | 715/718 |
| 7,228,100 | B2 | 6/2007 | Toporski et al. | |
| 7,305,043 | B2 | 12/2007 | Milbar et al. | |
| 2002/0056127 | A1 * | 5/2002 | Amir | 725/90 |
| 2003/0177142 | A1 | 9/2003 | Ferris | |
| 2004/0062526 | A1 | 4/2004 | Syed et al. | |
| 2004/0076188 | A1 * | 4/2004 | Milbar et al. | 370/514 |
| 2004/0194141 | A1 | 9/2004 | Sanders | |
| 2005/0071882 | A1 * | 3/2005 | Rodriguez et al. | 725/95 |
| 2005/0080673 | A1 | 4/2005 | Picker et al. | |
| 2005/0210510 | A1 | 9/2005 | Danker | |
| 2005/0228830 | A1 | 10/2005 | Plastina et al. | |
| 2005/0234995 | A1 | 10/2005 | Plastina et al. | |
| 2005/0278741 | A1 | 12/2005 | Robarts et al. | |
| 2006/0019618 | A1 * | 1/2006 | Seppala | 455/121 |
| 2006/0026643 | A1 | 2/2006 | Silverberg et al. | |
| 2006/0037060 | A1 | 2/2006 | Simms et al. | |
| 2006/0174270 | A1 * | 8/2006 | Westberg et al. | 725/39 |
| 2006/0209941 | A1 | 9/2006 | Kroeger | |
| 2006/0218579 | A1 * | 9/2006 | Logan et al. | 725/32 |
| 2007/0107019 | A1 * | 5/2007 | Romano et al. | 725/80 |

OTHER PUBLICATIONS

European Telecommunications Standards Institute, TS 102 818 v. 1.2.1 Digital Audio Broadcasting (DAB); XML Specification for DAB Electronic Programme Guide (EPG), Jan. 2005.

European Telecommunications Standards Institute, TS 301 234 v. 2.1.1 Digital Audio Broadcasting (DAB); Multimedia Object Transfer (MOT) protocol, Feb. 2005.

European Telecommunications Standards Institute, TS 102 371 v. 1.1.1 Digital Audio Broadcasting (DAB); Transportation and Binary Encoding Specification for DAB EPG, Jan. 2005.

Thom Linden, An Advanced Application Services Framework for Application and Service Developers using HD Radio Technology, White Paper, Feb. 2003 available at http://www.ibiquity.com/broadcasters/quality_implementation/iboc_white_papers.

International Search Report dated Mar. 3, 2009 from corresponding International Application No. PCT/US2008/013946.

Written Opinion of the International Searching Authority dated Mar. 3, 2009 from corresponding International Application No. PCT/US/013946.

* cited by examiner

| EPG (SB) | file type | market | cluster | date | version |
|---|---|---|---|---|---|
| 6-char: alphanumeric | 2-char: Num 01-99 | 3-char: Num 001-999 | 2-char: Num 01-99<br>00 - non specific | 8-char: Num yyyymmdd | 2-char: Num 01-99<br>00 - reserved |

*File Types*

| Value | File type |
|---|---|
| 00 | Reserved |
| 01 | Content Schedule Basic |
| 02 | Content Schedule Advanced |
| 03 | Content Service Basic |
| 04 | Content Service Advanced |
| 05 | Content Linked Basic |
| 06 | Content Linked Advanced |
| 07 | Reserved |
| 08 | Index File |
| 09-255 | Reserved for future use |

*FIG. 11*

Service Bureau Generic Directory Index (Date: 1:12/10/2005)

| MARKET | CALL SIGN | AM/FM | FREQ | FCC ID (EXAMPLE) | |
|---|---|---|---|---|---|
| Philadelphia, PA | WBEN | FM | 95.7 | 158 | Cluster 1 |
| Philadelphia, PA | WDAS | AM | 1480 | 162 | |
| Philadelphia, PA | WDAS | FM | 105.3 | 174 | |
| Philadelphia, PA | WHYY | FM | 90.9 | 192 | Cluster 2 |
| Philadelphia, PA | WIOQ | FM | 102.1 | 191 | |
| Philadelphia, PA | WIP | AM | 610 | 204 | |
| Philadelphia, PA | WJJZ | FM | 106.1 | 255 | |
| Philadelphia, PA | WMGK | FM | 102.9 | 163 | |
| Philadelphia, PA | WMMR | FM | 93.3 | 145 | |
| Philadelphia, PA | WPEN | AM | 950 | 154 | |
| Philadelphia, PA | WPPZ | FM | 103.9 | 151 | Cluster 3 |
| Philadelphia, PA | WRDW | FM | 96.5 | 295 | |
| Philadelphia, PA | WRNB | FM | 107.9 | 168 | |
| Philadelphia, PA | WRTI | FM | 90.1 | 173 | |
| Philadelphia, PA | WSNI | FM | 104.5 | 187 | |
| Philadelphia, PA | WTMR | AM | 800 | 222 | Cluster 4 |
| Philadelphia, PA | WUSL | FM | 98.9 | 324 | |
| Philadelphia, PA | WWDB | AM | 860 | 997 | Cluster 5 |
| Philadelphia, PA | WWJZ | AM | 640 | 876 | |
| Philadelphia, PA | WXTU | FM | 92.5 | 655 | |

MATCH TO FIG. 12b

Fig. 12a

High Level Description of Transported Entries

MATCH TO FIG. 12a

Day 1

| File names | Port No. | Cluster Stations |
|---|---|---|
| EPGSB10300601121 0200501 | 2 | 03:158,162,174 |
| EPGSB10300602121 0200501 | 2 | 07:192,191,204,255,163,145,154 |
| EPGSB10300603121 0200502 | 2 | 05:151,295,168,173,187 |
| EPGSB10300604121 0200505 | 2 | 02:222,324 |
| EPGSB10300605121 0200501 | 2 | 03:997,876,655 |

Day 2

| File names | Port No. | Cluster Stations |
|---|---|---|
| EPGSB10300601121 1200503 | 3 | 03:158,162,174 |
| EPGSB10300602121 1200501 | 3 | 07:192,191,204,255,163,145,154 |
| EPGSB10300603121 1200506 | 3 | 05:151,295,168,173,187 |
| EPGSB10300604121 1200506 | 3 | 02:222,324 |
| EPGSB10300605121 1200502 | 3 | 03:997,876,655 |

• • •

Day 14

| File names | Port No. | Cluster Stations |
|---|---|---|
| EPGSB10300601122 3200504 | 4 | 03:158,162,174 |
| EPGSB10300602122 3200502 | 4 | 07:192,191,204,255,163,145,154 |
| EPGSB10300603122 3200501 | 4 | 05:151,295,168,173,187 |
| EPGSB10300604122 3200507 | 4 | 02:222,324 |
| EPGSB10300605122 3200501 | 4 | 03:997,876,655 |

Fig. 12b

```
<epgIndex originator="iBiquity Digital" serviceBureau="IBIQUI">
        <!-- markets, clusters, and stations -->
        <stationListing >
                <!-- New York City market -->
                <market marketID="001">
                        <mediumName xml:lang="en">New York, NY</mediumName>
                        <!— stations with schedule-reuse pattern A -->
                        <cluster clusterID="1">
                                <clusterStation stationID="00405611"/>          <!-- WFUV -->
                                <clusterStation stationID="0040715e"/>          <!-- WQXR -->
                                <clusterStation stationID="0040cd79"/>          <!-- WAWZ -->
                                <clusterStation stationID="00411e8b"/>          <!-- WNYC -->
                        </cluster>
                        <!— stations with schedule-reuse pattern B -->
                        <cluster clusterID="2">
                                <clusterStation stationID="0040dcfb"/>          <!-- WLTW -->
                                <clusterStation stationID="0040ea31"/>          <!-- WHTZ -->
                        </cluster>
                </market>
        </stationListing>
```

CONT'D at FIG. 13b . . .

*FIG. 13a*

```
<!-- relative port numbers and files -->
<fileListing>
        <!— relative port 1: service files -->
        <port portID="1" portDate="2006-01-01">
                <file type="contentServiceBasic" clusterID="1" fileDate="2006-01-01" version="1"/>
                <file type="contentServiceBasic" clusterID="2" fileDate="2006-01-01" version="2"/>
        </port>
        <!— relative port 2: schedule files for January 1, 2006 (Sunday) -->
        <port portID="2" portDate="2006-01-01">
                <file type="contentScheduleBasic" clusterID="1" fileDate="2006-01-01" version="3"/>
                <file type="contentScheduleBasic" clusterID="2" fileDate="2006-01-01" version="4"/>
        </port>
        <!— relative port 3: schedule files for January 2, 2006 (Monday) -->
        <port portID="3" portDate="2006-01-02">
                <file type="contentScheduleBasic" clusterID="1" fileDate="2006-01-02" version="5">
                        <alternateDate date="2006-01-03"/>
                        <alternateDate date="2006-01-04"/>
                </file>
                <file type="contentScheduleBasic" clusterID="2" fileDate="2006-01-02" version="6">
                        <alternateDate date="2006-01-03"/>
                        <alternateDate date="2006-01-04"/>
                </file>
        </port>
        <!— relative port 6: schedule files for January 5, 2006 (Thursday) -->
        <port portID="6" portDate="2006-01-05" >
                <file type="contentScheduleBasic" clusterID="1" fileDate="2006-01-05" version="7">
                        <alternateDate date="2006-01-06"/>
                        <alternateDate date="2006-01-07"/>
                </file>
                <file type="contentScheduleBasic" clusterID="2" fileDate="2006-01-05" version="8">
                        <alternateDate date="2006-01-06"/>
                        <alternateDate date="2006-01-07"/>
                        <alternateDate date="2006-01-08"/>
                        <alternateDate date="2006-01-09"/>
                        <alternateDate date="2006-01-10/>
                </file>
        </port>
</fileListing>
</epgIndex>
```

FIG. 13b

```
<serviceInformation>
 <station>
  <shortName>WAAA</shortName>
  <mediumName>AAA 99.5</mediumName>
  <frequency kHz="99500" />
  <service bearerID="4219384.0">
   <shortName>WAAA</shortName>
   <mediumName>Hot 99.5</mediumName>
  </service>
  <service bearerID="4219384.1">
   <shortName>WAAA HD2</shortName>
   <mediumName>AAA 99.5 HD2</mediumName>
  </service>
  <service bearerID="4248763.0">
   <shortName>WAAA</shortName>
   <mediumName>AAA 100</mediumName>
  </service>
  <service bearerID="4248763.1">
   <shortName>WAAA HD2</shortName>
   <mediumName>AAA Oldies</mediumName>
  </service>
  <service bearerID="4202986.0">
   <shortName>WAAA</shortName>
   <mediumName>AAA 01</mediumName>
  </service>
  <service bearerID="4202986.1">
   <shortName>WAAA HD2</shortName>
   <mediumName>AAA 01 New
Rock</mediumName>
  </service>
 </station>
 <station>
  <shortName>WBBB</shortName>
  <mediumName>BBB 100.3</mediumName>
  <frequency kHz="10030" />
  <service bearerID="4248763.0">
   <shortName>WBBB</shortName>
   <mediumName>BBB 100</mediumName>
  </service>
  <service bearerID="4248763.1">
   <shortName>WBBB HD2</shortName>
   <mediumName>BBB Oldies</mediumName>
  </service>
 </station>
 <station>
  <shortName>WCCC</shortName>
  <mediumName>CCC 01</mediumName>
  <frequency kHz="10100" />
  <service bearerID="4202986.0">
   <shortName>WCCC</shortName>
   <mediumName>CCC 02</mediumName>
  </service>
  <service bearerID="4202986.1">
   <shortName>WCCC HD2</shortName>
   <mediumName>CCC101 New Rock</mediumName>
  </service>
 </station>
</serviceInformation>
```

*FIG. 13d*

```
<epg>
 <schedule>
  <content>
   <mediumName>WCCC Rock Overnights</mediumName>
   <location>
    <bearer bearerID="4202986.0" />
    <time time="00:00" duration="PT6H" />
   </location>
  </content>
  <content>
   <mediumName>Kelly Knight and Weasel</mediumName>
   <location>
    <bearer bearerID="4202986.0" />
    <time time="06:00" duration="PT4H" />
   </location>
  </content>
  <content>
   <mediumName>Schelby</mediumName>
   <location>
    <bearer bearerID="4202986.0" />
    <time time="10:00" duration="PT4H" />
   </location>
  </content>
  <content>
   <mediumName>Cerphe</mediumName>
   <location>
    <bearer bearerID="4202986.0" />
    <time time="14:00" duration="PT5H" />
   </location>
</content>
  <content>
   <mediumName>Rock Night Show</mediumName>
   <location>
    <bearer bearerID="4202986.0" />
    <time time="19:00" duration="PT5H" />
   </location>
  </content>
<content>
   <mediumName>Adult Alternative - The Jam</mediumName>
   <location>
    <bearer bearerID="4202986.1" />
    <time time="00:00" duration="PT4H" />
   </location>
  </content>
  <content>
   <mediumName>Adult Alternative - The Jam</mediumName>
   <location>
    <bearer bearerID="4202986.1" />
    <time time="04:00" duration="PT4H" />
   </location>
  </content>
  <content>
   <mediumName>Adult Alternative - The Jam</mediumName>
   <location>
    <bearer bearerID="4202986.1" />
    <time time="08:00" duration="PT4H" />
   </location>
  </content>
  <content>
   <mediumName>Adult Alternative - The Jam</mediumName>
   <location>
    <bearer bearerID="4202986.1" />
    <time time="12:00" duration="PT4H" />
   </location>
  </content>
  <content>
   <mediumName>Adult Alternative - The Jam</mediumName>
   <location>
    <bearer bearerID="4202986.1" />
    <time time="16:00" duration="PT4H" />
   </location>
  </content>
  <content>
   <mediumName>Adult Alternative - The Jam</mediumName>
   <location>
    <bearer bearerID="4202986.1" />
    <time time="20:00" duration="PT4H" />
   </location>
  </content>
 </schedule>
</epg>
```

FIG. 13e

```
<epg>
  <contentGroups>
    <contentGroup contentID="1.0" >
      <mediumName>Overnight Music</mediumName>
    </contentGroup>
    <contentGroup contentID="1.1" >
      <mediumName>Morning Show Edition</mediumName>
    </contentGroup>
    <contentGroup contentID="1.2" >
      <mediumName>World News Service</mediumName>
    </contentGroup>
    <contentGroup contentID="1.3" >
      <mediumName>Brian and Dave Show</mediumName>
    </contentGroup>
    <contentGroup contentID="1.4" >
      <mediumName>Lenny Show</mediumName>
    </contentGroup>
    <contentGroup contentID="1.5" >
      <mediumName>New Music Show</mediumName>
    </contentGroup>
    <contentGroup contentID="1.6" >
      <mediumName>Fresh Show</mediumName>
    </contentGroup>
    <contentGroup contentID="1.7" >
      <mediumName>All Things Today</mediumName>
    </contentGroup>
    <contentGroup contentID="1.8" >
      <mediumName>Market News Place</mediumName>
    </contentGroup>
    <contentGroup contentID="1.9" >
      <mediumName>Evening Music</mediumName>
    </contentGroup>
    <contentGroup contentID="1.a" >
      <mediumName>New Music and Sounds</mediumName>
    </contentGroup>
    <contentGroup contentID="2.0" >
      <mediumName>Classic Radio</mediumName>
    </contentGroup>
    <contentGroup contentID="2.1" >
      <mediumName>Rewind </mediumName>
    </contentGroup>
    <contentGroup contentID="2.2" >
      <mediumName>The World Music Cafe House</mediumName>
    </contentGroup>
    <contentGroup contentID="2.3" >
      <mediumName>City Folk Music</mediumName>
    </contentGroup>
    <contentGroup contentID="2.4" >
      <mediumName>University Sports</mediumName>
    </contentGroup>
    <contentGroup contentID="3.0" >
      <mediumName>New York Night Show</mediumName>
    </contentGroup>
    <contentGroup contentID="3.1" >
      <mediumName>The Morning Show</mediumName>
    </contentGroup>
    <contentGroup contentID="3.2" >
      <mediumName>The Office Today</mediumName>
    </contentGroup>
    <contentGroup contentID="3.3" >
      <mediumName>Music</mediumName>
    </contentGroup>
    <contentGroup contentID="3.4" >
      <mediumName>Symphony Hall Tonight</mediumName>
    </contentGroup>
    <contentGroup contentID="3.5" >
      <mediumName>Music from Austria</mediumName>
    </contentGroup>
  </contentGroups>
</epg>
```

FIG. 13f

Service Bureau Manager

File Edit Encode Window

C:\SB\test_minimum\alter\indexDS.xml

Index

Properties

Current Index Date: Monday, November 19, 2007

Apply Index for: Tuesday, December 04, 2007

Index Version: 77

Set Country Code: 1

Service Bureau Formating

| | serviceBureauID | version | stationListing |
|---|---|---|---|
| ▷ | IBIQUI | 4 | 4 |

Add Market or Cluster

Choose Market Name from List: Boston

Market ID: 007

Cluster and Markets

| | marketID | clusterID | mediumName |
|---|---|---|---|
| ▷ | 8 | 1 | Washington, DC |
| | 8 | 2 | Washington, DC |
| | 8 | 4 | Washington, DC |
| | 8 | 5 | Washington, DC |
| | 8 | 6 | Washington, DC |
| | 8 | 7 | Washington, DC |

Cluster and

| | clusterID |
|---|---|
| ▷ | 1 |
| | 1 |
| | 1 |
| | 2 |
| | 2 |
| | 2 |

Alternative Dates:

| * | date |
|---|---|
| ▽ | 2007-11-13 |
| ▽ | 2007-11-14 |
| ▽ | 2007-11-15 |
| ▽ | 2007-11-16 |
| ▽ | 2007-11-19 |

| December 2007 | | | | | | |
|---|---|---|---|---|---|---|
| S | M | T | W | T | F | S |
| 25 | 26 | 27 | 28 | 29 | 30 | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | 1 | 2 | 3 | 4 | 5 |

Clusters

| | portID |
|---|---|
| | 1 |
| | 1 |
| | 1 |
| | 1 |
| | 1 |
| | 1 |
| | 1 |
| | 1 |
| ▷ | 2 |
| | 2 |
| | 2 |
| | 2 |

Start | Dialog (Running) -Mic... | Walkthrough: Read...

MATCH TO FIG. 15c2

Fig. 15c1

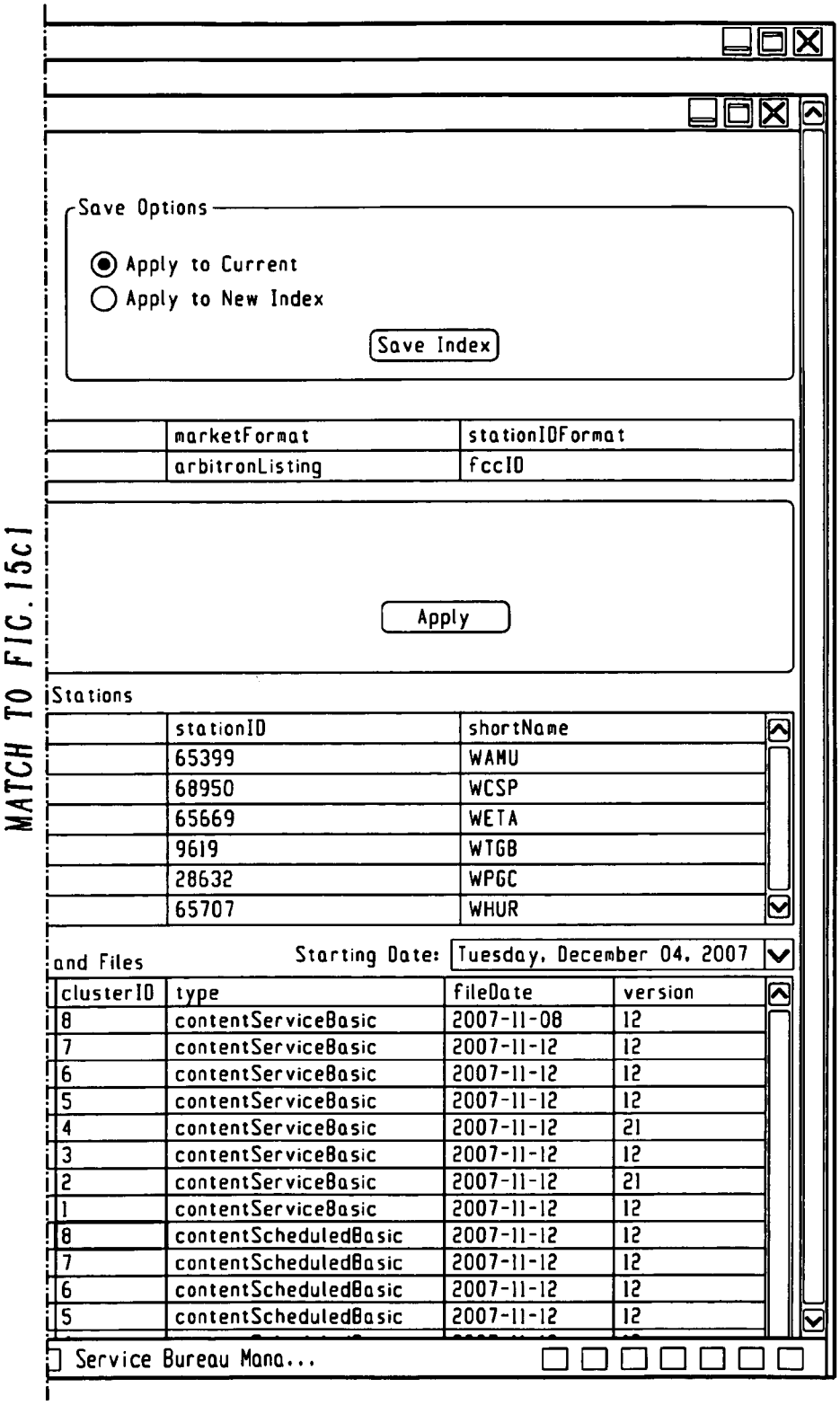
Fig. 15c2

Basic 2-line display scenario
Step 1: User tunes into service - Manual, scan or preset
Step 2: Press EPG/Menu button to access EPG data for current service and program (content) display
Medium larger LCD display scenario
Step 1: User tunes into service - Manual, scan or preset
Step 2: Press EPG/Menu button to access EPG data for services and programs display

SYSTEMS AND METHODS FOR COMMUNICATING AND RENDERING ELECTRONIC PROGRAM GUIDE INFORMATION VIA DIGITAL RADIO BROADCAST TRANSMISSION

BACKGROUND

1. Field of the Disclosure

The present disclosure relates to digital radio broadcast transmission and reception and, in particular, to methods and systems for transmitting and rendering electronic program guide information for digital radio broadcast.

2. Background Information

Digital radio broadcasting technology delivers digital audio and data services to mobile, portable, and fixed receivers. One type of digital radio broadcasting, referred to as in-band on-channel (IBOC) digital audio broadcasting (DAB), uses terrestrial transmitters in the existing Medium Frequency (MF) and Very High Frequency (VHF) radio bands. HD Radio™ technology, developed by iBiquity Digital Corporation, is one example of an IBOC implementation for digital radio broadcasting and reception.

IBOC DAB signals can be transmitted in a hybrid format including an analog modulated carrier in combination with a plurality of digitally modulated carriers or in an all-digital format wherein the analog modulated carrier is not used. Using the hybrid mode, broadcasters may continue to transmit analog AM and FM simultaneously with higher-quality and more robust digital signals, allowing themselves and their listeners to convert from analog-to-digital radio while maintaining their current frequency allocations.

One feature of digital transmission systems is the inherent ability to simultaneously transmit both digitized audio and data. Thus the technology also allows for wireless data services from AM and FM radio stations. The broadcast signals can include metadata, such as the artist, song title, or station call letters. Special messages about events, traffic, and weather can also be included. For example, traffic information, weather forecasts, news, and sports scores can all be scrolled across a radio receiver's display while the user listens to a radio station.

IBOC DAB technology can provide digital quality audio, superior to existing analog broadcasting formats. Because each IBOC DAB signal is transmitted within the spectral mask of an existing AM or FM channel allocation, it requires no new spectral allocations. IBOC DAB promotes economy of spectrum while enabling broadcasters to supply digital quality audio to the present base of listeners.

Multicasting, the ability to deliver several audio programs or streams over one channel in the AM or FM spectrum, enables stations to broadcast multiple streams on separate supplemental or sub-channels of the main frequency. For example, multiple streams of data can include alternative music formats, local traffic, weather, news, and sports. The supplemental channels can be accessed in the same manner as the traditional station frequency using tuning or seeking functions. For example, if the analog modulated signal is centered at 94.1 MHz, the same broadcast in IBOC DAB can include supplemental channels 94.1-1, 94.1-2, and 94.1-3. Highly specialized programming on supplemental channels can be delivered to tightly targeted audiences, creating more opportunities for advertisers to integrate their brand with program content. As used herein, multicasting includes the transmission of one or more programs in a single digital radio broadcasting channel or on a single digital radio broadcasting signal. Multicast content can include a main program service (MPS), supplemental program services (SPS), program service data (PSD), and/or other broadcast data.

The National Radio Systems Committee, a standard-setting organization sponsored by the National Association of Broadcasters and the Consumer Electronics Association, adopted an IBOC standard, designated NRSC-5A, in September 2005. NRSC-5A, the disclosure of which is incorporated herein by reference, sets forth the requirements for broadcasting digital audio and ancillary data over AM and FM broadcast channels. The standard and its reference documents contain detailed explanations of the RF/transmission subsystem and the transport and service multiplex subsystems. Copies of the standard can be obtained from the NRSC at http://www.nrscstandards.org/standards.asp. iBiquity's HD Radio™ technology is an implementation of the NRSC-5A IBOC standard. Further information regarding HD Radio™ technology can be found at www.hdradio.com and www.ibiquity.com.

Other types of digital radio broadcasting systems include satellite systems such as Satellite Digital Audio Radio Service (SDARS, e.g., XM Radio™, Sirius®), Digital Audio Radio Service (DARS, e.g., WorldSpace®), and terrestrial systems such as Digital Radio Mondiale (DRM), Eureka 147 (branded as DAB Digital Audio Broadcasting®), DAB Version 2, and FMeXtra®. As used herein, the phrase "digital radio broadcasting" encompasses digital audio broadcasting including in-band on-channel broadcasting, as well as other digital terrestrial broadcasting and satellite broadcasting.

Digital radio broadcasting systems are providing digital radio in numerous markets throughout the United States. These digital radio transmissions include a wide variety of content such as music, news, sports, and talk shows. The present inventors have observed a need for systems and methods to facilitate intelligently browsing through the myriad of available content that can be received at a digital radio broadcast receiver. The present inventors have also observed a need for digital radio receiver features that provide users an easy way to select and receive the desired content. The present inventors have also observed a need for methods and systems for suitably structuring electronic program guide information to facilitate its transmission and reception via digital radio broadcasting.

SUMMARY

Embodiments of the present disclosure are directed to systems and methods that may satisfy these needs. According to exemplary embodiments, a method of preparing data for broadcast via digital radio broadcast transmission is disclosed. The method comprises receiving programming information from a content provider; storing the programming information; generating at least one content file corresponding to the programming information; generating an index file having information identifying the at least one content file, wherein the index file is associated with a first logical address; scheduling the index file and the at least one content file for broadcast via digital radio broadcast transmission; and communicating the index file and the at least one content file for broadcast via digital radio broadcast transmission. A system comprising a processing system and a memory coupled to the processing system are described wherein the processing system is configured to carry out the above-described method. Computer programming instructions adapted to cause a processing system to carry out the above-described method may be embodied within any suitable computer readable medium.

According to exemplary embodiments, a method of preparing data for broadcast via digital radio broadcast transmission is disclosed. The method comprises receiving an index file having information identifying at least one content file, wherein the index file is associated with a first logical address; receiving the at least one content file corresponding to programming information for program content to be broadcast; storing the index file and the at least one content file; and transmitting the index file and at least one content file to an importer in accordance with a broadcast rotation, wherein the index file is scheduled for repeated transmission intermittently relative to selected ones of the content files. A system comprising a processing system and a memory coupled to the processing system are described wherein the processing system is configured to carry out the above-described method. Computer programming instructions adapted to cause a processing system to carry out the above-described method may be embodied within any suitable computer readable medium.

According to exemplary embodiments, a method of generating an electronic program guide for a digital radio broadcast transmission is disclosed. The method comprises receiving an index file, the received index file having information identifying at least one content file; storing the received index file; receiving the at least one content file, wherein the at least one received content file includes data for displaying programming information; storing the at least one received content file; and displaying the programming information based upon the data from the at least one received content file to a user as an electronic program guide such that the user can view the programming information. A system comprising a processing system and a memory coupled to the processing system are described wherein the processing system is configured to carry out the above-described method. Computer programming instructions adapted to cause a processing system to carry out the above-described method may be embodied within any suitable computer readable medium.

BRIEF DESCRIPTION OF THE DRAWINGS

These and other features, aspects, and advantages of the present disclosure will become better understood with regard to the following description, appended claims, and accompanying drawings wherein:

FIG. 11 illustrates an exemplary EPG file naming convention in accordance with certain embodiments;

FIGS. 12*a* and 12*b* illustrate an exemplary EPG index file in accordance with certain embodiments;

FIGS. 13*a* to 13*f* illustrate exemplary XML files in accordance with certain embodiments;

FIGS. 15*a*, 15*b*, 15*c*1, and 15*c*2 illustrate exemplary user interfaces in accordance with certain embodiments;

DESCRIPTION

An electronic program guide (EPG) as described herein can permit users to browse and select from program listings and services (including available data services) that are displayed on a user interface of a digital radio broadcast receiver. An EPG can enable a user to view and choose from amongst various programs in the user's current digital radio broadcast market. Additionally, an EPG can enable users to conditionally trigger other services within and outside the radio receiver, such as content recording.

Exemplary Digital Radio Broadcasting System

FIGS. 1-10 and the accompanying description herein provide a general description of an exemplary IBOC system, exemplary broadcasting equipment structure and operation, and exemplary receiver structure and operation, including structure and operation for supporting EPG functionality. FIGS. 11-24 and the accompanying description herein provide a detailed description of exemplary approaches for generating, broadcasting, and receiving EPGs in accordance with exemplary embodiments of the present disclosure. Whereas aspects of the disclosure are presented in the context of an exemplary IBOC system, it should be understood that the present disclosure is not limited to IBOC systems and that the teachings herein are applicable to other forms of digital radio broadcasting as well.

IBOC digital radio content is generated by a variety of entities including local station programmers, network programmers (e.g., news, sports, concerts), and third-party program syndicators and data service providers. A service bureau (SB) is an entity that processes and builds EPGs for digital radio broadcasting (e.g., IBOC broadcasting). To perform this function, the SB aggregates EPG data from the various sources (e.g., networks, syndication providers, special event and content providers) and maintains the data for participating stations, clusters and markets. EPG data, also referred to herein as programming information or EPG content, includes information that describes the content (including audio programs and station data services) available on a radio station such as program names, data service names, descriptions, start times, durations, etc. In addition to aggregating EPG data, the SB can also establish contractual relationships with stations, networks of stations, or other content providers to provide EPG services. Radio stations that participate in the EPG will typically be the main point of transmission for the EPG data over-the-air.

Figure 1:
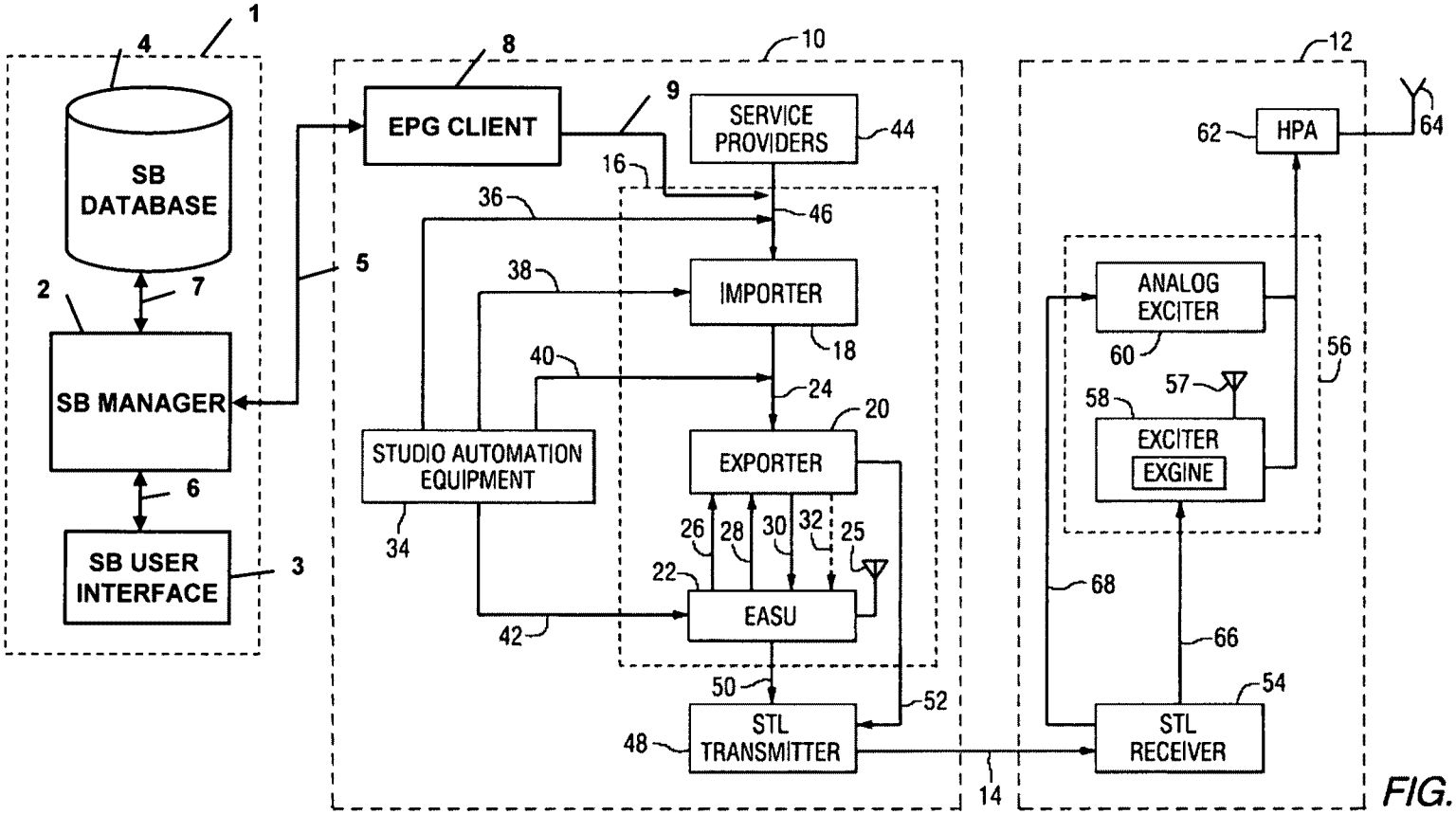
FIG. 1 illustrates a block diagram that provides an overview of a system in accordance with certain embodiments.

Referring to the drawings, FIG. 1 is a functional block diagram of the relevant aspects of a service bureau (SB) block 1, studio site 10, an FM transmitter site 12, and a studio transmitter link (STL) 14 that can be used to broadcast an FM IBOC DAB signal to IBOC radio capable receivers. The SB block 1 includes a Service Bureau User Interface (SBUI) 3, a Service Bureau Database (SBDB) 4, and a Service Bureau Manager (SBM) 2, which represent hardware and/or software components under the control of the SB. The studio site 10 includes, among other things, an EPG Client 8, studio automation equipment 34, an importer 18, an exporter 20, an exciter auxiliary service unit (EASU) 22, and an STL transmitter 48. The transmitter site includes an STL receiver 54, a digital exciter 56 that includes an exciter engine (exgine) subsystem 58, and an analog exciter 60. While in FIG. 1 the exporter is resident at a radio station's studio site and the exciter is located at the transmission site, these elements may be co-located at the transmission site. Additionally, while in FIG. 1 the SB block 1 is shown as separate from the studio site 10, one or more of the SB components could be co-located at the studio site 10 or hosted by a third-party.

The SB block 1 collects and processes EPG data from stations, content providers and/or markets/networks. In certain embodiments, the SB block 1 may collect and process EPG data from an individual radio station. Additionally, in certain embodiments the SB block 1 may collect and process EPG data from a "cluster" of radio stations, which may be a grouping of stations within a market or markets organized to maintain efficient radio bandwidth usage. Therefore in some embodiments, the SB block 1 can group radio stations into clusters based on the bandwidth requirements for the constituent radio stations' EPGs. For example, if a cluster EPG service provided 1.5 kbps of bandwidth for EPG data, then three radio stations each requiring 500 bps for their EPGs could be grouped together. This grouping could be performed dynamically or could be predetermined by the SB operator. Alternatively, a "cluster" may be a group of stations that are owned or operated by a single broadcasting entity. Thus in some embodiments, the radio stations are grouped into clusters based on ownership. In certain embodiments, the SB block 1 may collect and process EPG data from a market, which may be a grouping of stations based on geographic boundaries (e.g., the Philadelphia market). This partitioning of stations into markets advantageously solves the problem of presenting a meaningful EPG even though several AM or FM stations are assigned to the same carrier frequency. For example, both Station 1 in Lancaster, Pa., and Station 2 in Trenton, N.J. are assigned to 94.5 MHZ. If a user selects the Lancaster, Pa. market, the receiver could show Station 1 on 94.5 MHz, but if the user selects the Trenton, N.J. market, receiver could show Station 2 on 94.5 MHz. In certain embodiments, the SB block 1 may collect and process data from any suitable combination of individual radio stations, clusters, and markets. Advantageously, by collecting EPG data from multiple sources the SB may be able to transmit programming information regarding stations that broadcast only in legacy analog waveform and otherwise have no digital or other means of conveying their program schedule.

Within the SB block 1, the SBM 2 is a software application that performs several functions and that may execute on either a standalone computer processor, the same computer processor as the SBUI 3, the same computer processor as the SBDB 4, any other suitable processor, or any suitable combination thereof. The SBM 2 aggregates EPG data, generates and manages EPG files, prioritizes EPG files for bandwidth management, schedules EPG files for transmission, and interfaces with the EPG Client 8 via an interface 5. In some embodiments, the SBM 2 may also validate the file formatting of EPG files and/or group EPG files into clusters. The SBUI 3 is a software application that allows creation and modification of EPG files by the SB operators and/or third party providers of service and content. The SBUI 3 executes on a processing system, e.g., one or more computer processors, and interfaces with the SBM 2 via an interface 6 that may be, for example, a socket connection or an application programming interface (API). The SBDB 4 includes the hardware and software for storing EPG files in a database structure and for responding to queries from the SBM 2. The SBM 2 interfaces with the SBDB 4 via an interface 7 that may be, for example, a socket connection or an API.

At the studio site 10, the EPG Client 8 is a software application that performs the functions of receiving EPG files from the SBM 2, segmenting EPG files into packets, populating an internal storage with the EPG packets, and transmitting the EPG packets to the importer according to a bandwidth management algorithm via an interface 9. In some embodiments the EPG Client 8 may also validate the correctness of the EPG files. The interface 9 may be a socket connection and/or an API. The EPG Client 8 may execute on processing system, e.g., one or more computer processors, the same computer processor that implements the importer, or any other suitable processing system or combination thereof. Additionally, while the EPG Client 8 is shown in FIG. 1 as resident at the studio site 10, it could also be co-located with the SB block 1. In this configuration, the EPG Client could execute on the same computer processor as the SBUI 2, the same computer processor as the SBDB 4, any other suitable processing system, or any suitable combination thereof.

The studio automation equipment supplies main program service (MPS) audio 42 to the EASU, MPS data (MPSD) 40 to the exporter, supplemental program service (SPS) audio 38 to the importer, and SPS data (SPSD) 36 to the importer. MPS audio serves as the main audio programming source. In hybrid modes, it preserves the existing analog radio programming formats in both the analog and digital transmissions. MPSD, also known as program service data (PSD), includes information such as music title, artist, album name, etc. Supplemental program service can include supplementary audio content as well as PSD.

Second Generation Data Services, known as Advanced Applications Services (AAS), include the ability to deliver many data services or streams and application specific content over one channel in the AM or FM spectrum, and enable stations to broadcast multiple streams on supplemental or sub-channels of the main frequency. A "service" in this context may be defined as content that is delivered to users via digital radio broadcasting. AAS contains the HD Radio data payload and shares channel bandwidth with multicasting services to provide broadcast data services. Both streaming and file based data services are supported along with the ability to perform Large Object Transport (LOT) as described below. AAS can include any type of data that is not classified as MPS, SPS, or Station Information Service (SIS). For example, AAS includes a Service Information Guide (SIG) which provides detailed station service information and includes services besides multicast audio programming, including the EPG (a data service), navigation maps, traffic information, multimedia applications and other data content.

The importer 18 contains hardware and software for supplying AAS. Services are identified in the SIG by their MIME hash and their logical address (described below) in the AAS. The EPG content for AAS can be supplied by the EPG Client 8 and service providers 44, which provide service data 46 to the importer via an API. The service providers may be a broadcaster located at the studio site or externally sourced third-party providers of services and content. The importer 18 can establish session connections between multiple service providers. The importer 18 encodes and multiplexes service data 46, SPS audio 38, and SPS data 36 to produce exporter link data 24, which is output to the exporter 20 via a data link 24. Station Information Service (SIS) is also provided, which comprises station information such as call sign, absolute time, position correlated to GPS, data describing the services available on the station (e.g., a subset of the MIME hash transmitted in the SIG such as the least significant 12-bits), etc.

The importer 18 can use a data transport mechanism, which may be referred to herein as a radio link subsystem (RLS), to provide packet encapsulation, varying levels of quality of service (e.g., varying degrees of forward error correction and interleaving), and bandwidth management functions. The RLS can utilize High-Level Data Link Control (HDLC) for encapsulating the packets. HDLC is known to one of skill in the art and is described in ISO/IEC 13239:2002 Information technology—Telecommunications and information exchange between systems—High-level data link control (HDLC) procedures. HDLC framing includes a beginning frame delimiter (e.g., '0x7E'), a logical address (e.g., port number), a control field for sequence numbers and other information (e.g., packet 1 of 2, 2 of 2 etc.), the payload (e.g., the index file), a checksum (e.g., a CRC), and an ending frame delimiter (e.g., '0x7E'). For bandwidth management, the importer 18 typically assigns logical addresses (e.g. ports) to AAS data based on, for example, the number and type of services being configured at any given studio site 10. RLS is described in more detail in U.S. Pat. No. 7,305,043, which is incorporated herein by reference in its entirety.

Due to receiver implementation choices, RLS packets can be limited in size to about 8192 bytes, but other sizes could be used. Therefore data may be prepared for transmission according to two primary data segmentation modes—packet mode and byte-streaming mode—for transmitting objects larger than the maximum packet size. In packet mode the importer 18 may include a large object transfer (LOT) client (e.g. a software client that executes on the same computer processing system as the importer 18) to segment a "large" object (for example, a sizeable EPG file) into fragments no larger than the chosen RLS packet size. In typical embodiments objects may range in size up to 4,294,967,295 bytes. At the transmitter, the LOT client writes packets to an RLS port for broadcast to the receiver. At the receiver, the LOT client reads packets from the RLS port of the same number. The LOT client may process data associated with many RLS ports (e.g., typically up to 32 ports) simultaneously, both at the receiver and the transmitter.

The LOT client operates by sending a large object in several messages, each of which is no longer than the maximum packet size. To accomplish this, the transmitter assigns an integer called a LotID to each object broadcast via the LOT protocol. All messages for the same object will use the same LotID. The choice of LotID is arbitrary except that no two objects being broadcast concurrently on the same RLS port may have the same LotID. In some implementations, it may be advantageous to exhaust all possible LotID values before a value is reused.

When transmitting data over-the-air, there may be some packet loss due to the probabilistic nature of the radio propagation environment. The LOT client addresses this issue by allowing the transmitter to repeat the transmission of an entire object. Once an object has been received correctly, the receiver can ignore any remaining repetitions. All repetitions will use the same LotID. Additionally, the transmitter may interleave messages for different objects on the same RLS port so long as each object on the port has been assigned a unique LotID.

The LOT client divides a large object into messages, which are further subdivided into fragments. Preferably all the fragments in a message, excepting the last fragment, are a fixed length such as 256 bytes. The last fragment may be any length that is less than the fixed length (e.g., less than 256 bytes). Fragments are numbered consecutively starting from zero. However, in some embodiments an object may have a zero-length object—the messages would contain only descriptive information about the object.

The LOT client typically uses two types of messages—a full header message, and a fragment header message. Each message includes a header followed by fragments of the object. The full header message contains the information to reassemble the object from the fragments plus descriptive information about the object. By comparison, the fragment header message contains only the reassembly information. The LOT client of the receiver (e.g. a software and/or hardware application that typically executes within the data processors 232 and 288 of FIGS. 7 and 8 respectively or any other suitable processing system) distinguishes between the two types of messages by a header-length field (e.g. field name "hdrLen"). Each message can contain any suitable number of fragments of the object identified by the LotID in the header as long as the maximum RLS packet length is not exceeded. There is no requirement that all messages for an object contain the same number of fragments. Table 1 below illustrates exemplary field names and their corresponding descriptions for a full header message. Fragment header messages typically include only the hdrLen, repeat, LotID, and position fields.

TABLE 1

| FIELD NAME | FIELD DESCRIPTION |
|---|---|
| hdrLen | Size of the header in bytes, including the hdrLen field. Typically ranges from 24-255 bytes. |
| repeat | Number of object repetitions remaining. Typically ranges from 0 to 255. All messages for the same repetition of the object use the same repeat value. When repeating an object, the transmitter broadcasts all messages having repeat = R before broadcasting any messages having repeat = R − 1. A value of 0 typically means the object will not be repeated again. |
| LotID | Arbitrary identifier assigned by the transmitter to the object. Typically range from 0 to 65,535. All messages for the same object use the same LotID value. |
| position | The byte offset in the reassembled object of the first fragment in the message equals 256 * position. Equivalent to "fragment number". |
| version | Version of the LOT protocol |
| discardTime | Year, month, day, hour, and minute after which the object may be discarded at the receiver. Expressed in Coordinated Universal Time (UTC). |
| fileSize | Total size of the object in bytes. |
| mimeHash | MIME hash describing the type of object |
| fileName | File name associated with the object |

Full header and fragment header messages may be sent in any ratio provided that at least one full header message is broadcast for each object. Bandwidth efficiency will typically be increased by minimizing the number of full header messages; however, this may increase the time necessary for the receiver to determine whether an object is of interest based on the descriptive information that is only present in the full header. Therefore there is typically a trade between efficient use of broadcast bandwidth and efficient receiver processing and reception of desired LOT files.

In byte-streaming mode, as in packet mode, each data service is allocated a specific bandwidth by the radio station operators. The importer 18 then receives data messages of arbitrary size from the data services. The data bytes received from each service are then placed in a byte bucket (e.g. a queue) and HDLC frames are constructed based on the bandwidth allocated to each service. For example, each service may have its own HDLC frame that will be just the right size to fit into a modem frame. For example, assume that there are two data services, service #1 and service #2. Service #1 has been allocated 1024 bytes, and service #2 512 bytes. Now assume that service #1 sends message A having 2048 bytes, and service #2 sends message B also having 2048 bytes. Thus the first modem frame will contain two HDLC frames; a 1024 byte frame containing N bytes of message A and a 512 byte HDLC frame containing M bytes of message B. N & M are determined by how many HDLC escape characters are needed. If no escape characters are needed then N=1024 and M=512. If the messages contains nothing but HDLC framing bytes (i.e. 0x7E) then N=512 and M=256. Also, if data service #1 does not send a new message (call it message AA) then its unused bandwidth may be given to service #2 so its HDLC frame will be larger than its allocated bandwidth of 512 bytes.

The exporter 20 contains the hardware and software necessary to supply the MPS and SIS for broadcasting. The exporter accepts digital MPS audio 26 over an audio interface and compresses the audio. The exporter also multiplexes MPS data 40, exporter link data 24, and the compressed digital MPS audio to produce exciter link data 52. In addition, the exporter accepts analog MPS audio 28 over its audio interface and applies a pre-programmed delay to it to produce a delayed analog MPS audio signal 30. This analog audio can be broadcast as a backup channel for hybrid IBOC DAB broadcasts. The delay compensates for the system delay of the digital MPS audio, allowing receivers to blend between the digital and analog program without a shift in time. In an AM transmission system, the delayed MPS audio signal 30 is converted by the exporter to a mono signal and sent directly to the STL as part of the exciter link data 52.

The EASU 22 accepts MPS audio 42 from the studio automation equipment, rate converts it to the proper system clock, and outputs two copies of the signal, one digital (26) and one analog (28). The EASU includes a GPS receiver that is connected to an antenna 25. The GPS receiver allows the EASU to derive a master clock signal, which is synchronized to the exciter's clock by use of GPS units. The EASU provides the master system clock used by the exporter. The EASU is also used to bypass (or redirect) the analog MPS audio from being passed through the exporter in the event the exporter has a catastrophic fault and is no longer operational. The bypassed audio 32 can be fed directly into the STL transmitter, eliminating a dead-air event.

STL transmitter 48 receives delayed analog MPS audio 50 and exciter link data 52. It outputs exciter link data and delayed analog MPS audio over STL link 14, which may be either unidirectional or bi-directional. The STL link may be a digital microwave or Ethernet link, for example, and may use the standard User Datagram Protocol (UDP/IP) or the standard TCP/IP.

The transmitter site 12 includes an STL receiver 54, an exciter 56 and an analog exciter 60. The STL receiver 54 receives exciter link data, including audio and data signals as well as command and control messages, over the STL link 14. The exciter link data is passed to the exciter 56, which produces the IBOC DAB waveform. The exciter includes a host processor, digital up-converter, RF up-converter, and exgine subsystem 58. The exgine accepts exciter link data and modulates the digital portion of the IBOC DAB waveform. The digital up-converter of exciter 56 converts from digital-to-analog the baseband portion of the exgine output. The digital-to-analog conversion is based on a GPS clock, common to that of the exporter's GPS-based clock derived from the EASU. Thus, the exciter 56 includes a GPS unit and antenna 57. An alternative method for synchronizing the exporter and exciter clocks can be found in U.S. patent application Ser. No. 11/081,267 (Publication No. 2006/0209941 A1), the disclosure of which is hereby incorporated by reference. The RF up-converter of the exciter up-converts the analog signal to the proper in-band channel frequency. The up-converted signal is then passed to the high power amplifier 62 and antenna 64 for broadcast. In an AM transmission system, the exgine subsystem coherently adds the backup analog MPS audio to the digital waveform in the hybrid mode; thus, the AM transmission system does not include the analog exciter 60. In addition, the exciter 56 produces phase and magnitude information and the analog signal is output directly to the high power amplifier.

IBOC DAB signals can be transmitted in both AM and FM radio bands, using a variety of waveforms. The waveforms include an FM hybrid IBOC DAB waveform, an FM all-digital IBOC DAB waveform, an AM hybrid IBOC DAB waveform, and an AM all-digital IBOC DAB waveform.

Figure 2:
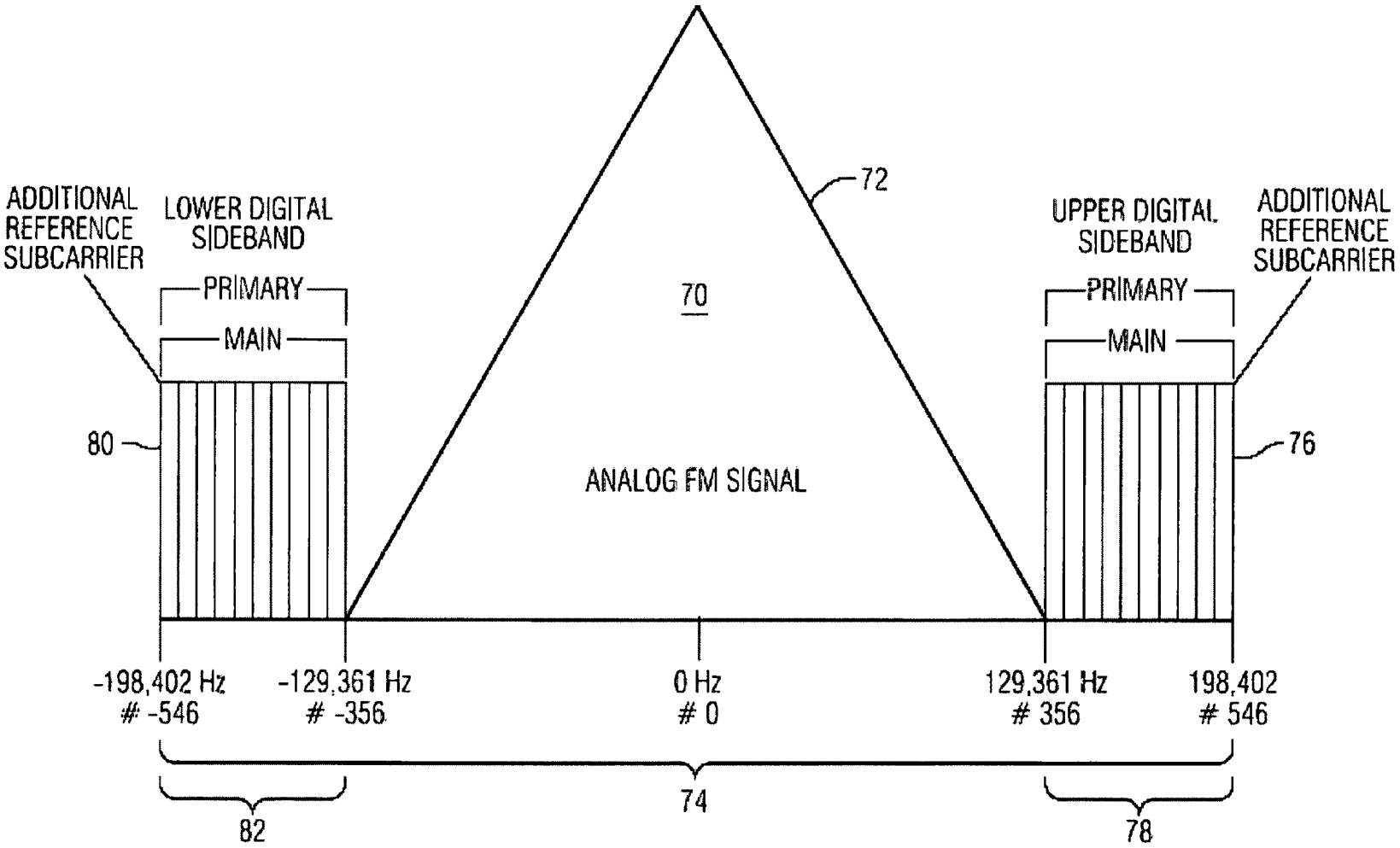
FIG. 2 is a schematic representation of a hybrid FM IBOC waveform.

FIG. 2 is a schematic representation of a hybrid FM IBOC waveform 70. The waveform includes an analog modulated signal 72 located in the center of a broadcast channel 74, a first plurality of evenly spaced orthogonally frequency division multiplexed subcarriers 76 in an upper sideband 78, and a second plurality of evenly spaced orthogonally frequency division multiplexed subcarriers 80 in a lower sideband 82. The digitally modulated subcarriers are divided into partitions and various subcarriers are designated as reference subcarriers. A frequency partition is a group of 19 orthogonal frequency division multiplexing (OFDM) subcarriers containing 18 data subcarriers and one reference subcarrier.

The hybrid waveform includes an analog FM-modulated signal, plus digitally modulated primary main subcarriers. The subcarriers are located at evenly spaced frequency locations. The subcarrier locations are numbered from −546 to +546. In the waveform of FIG. 2, the subcarriers are at locations +356 to +546 and −356 to −546. Each primary main sideband is comprised of ten frequency partitions. Subcarriers 546 and −546, also included in the primary main sidebands, are additional reference subcarriers. The amplitude of each subcarrier can be scaled by an amplitude scale factor.

Figure 3:
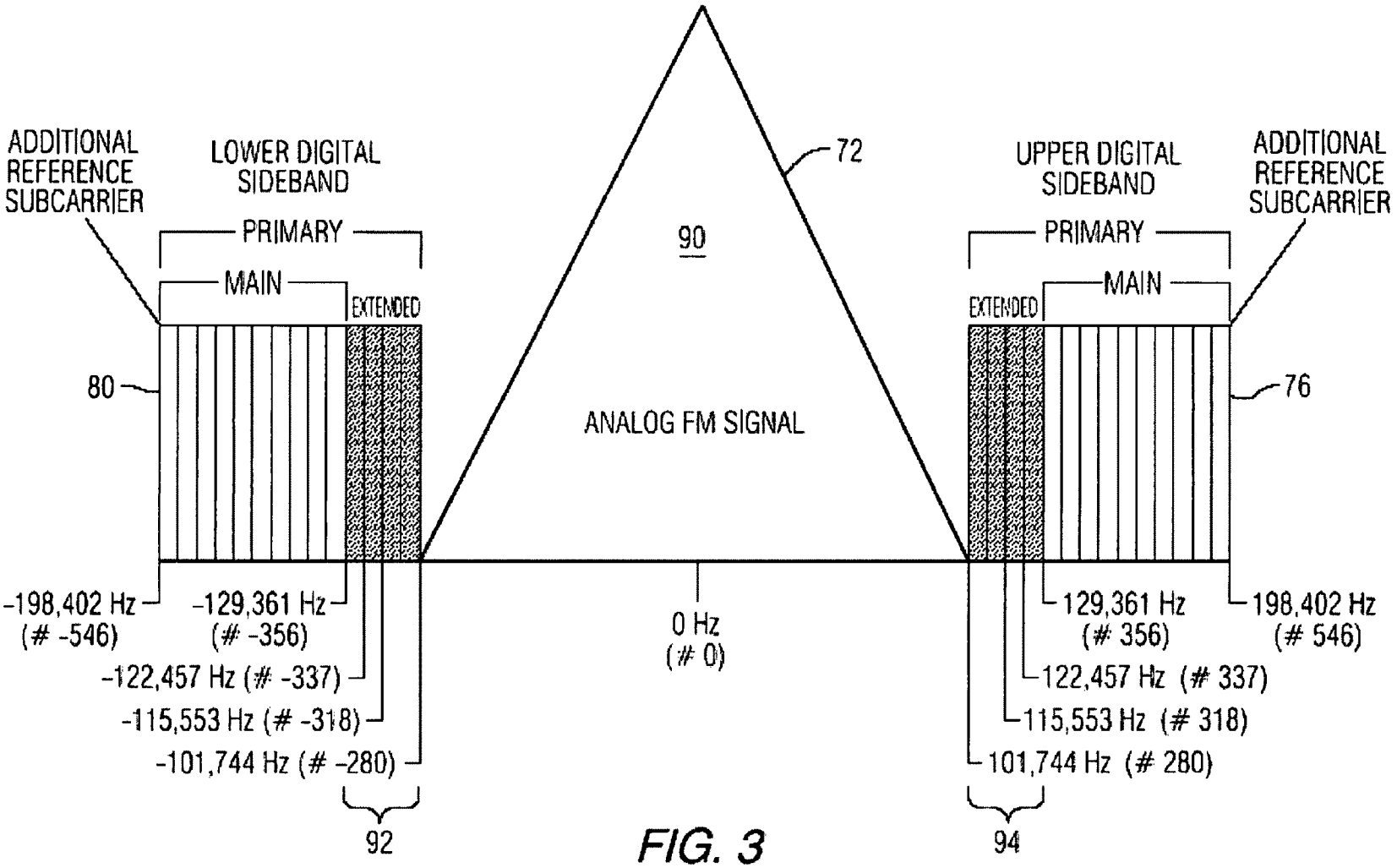
FIG. 3 is a schematic representation of an extended hybrid FM IBOC waveform.

FIG. 3 is a schematic representation of an extended hybrid FM IBOC waveform 90. The extended hybrid waveform is created by adding primary extended sidebands 92, 94 to the primary main sidebands present in the hybrid waveform. One, two, or four frequency partitions can be added to the inner edge of each primary main sideband. The extended hybrid waveform includes the analog FM signal plus digitally modulated primary main subcarriers (subcarriers +356 to +546 and −356 to −546) and some or all primary extended subcarriers (subcarriers +280 to +355 and −280 to −355).

The upper primary extended sidebands include subcarriers 337 through 355 (one frequency partition), 318 through 355 (two frequency partitions), or 280 through 355 (four frequency partitions). The lower primary extended sidebands include subcarriers −337 through −355 (one frequency partition), −318 through −355 (two frequency partitions), or −280 through −355 (four frequency partitions). The amplitude of each subcarrier can be scaled by an amplitude scale factor.

Figure 4:
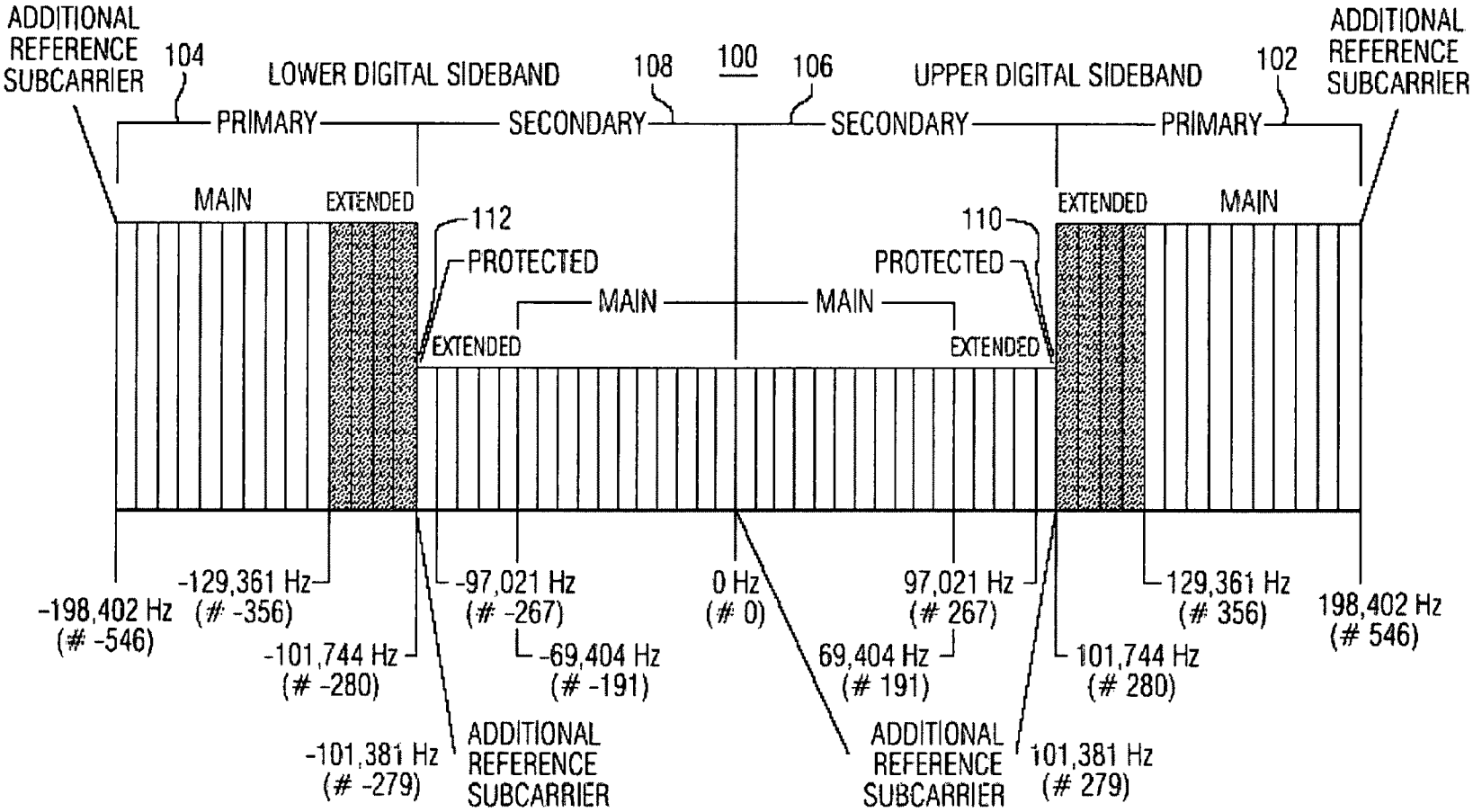
FIG. 4 is a schematic representation of an all-digital FM IBOC waveform.

FIG. 4 is a schematic representation of an all-digital FM IBOC waveform 100. The all-digital waveform is constructed by disabling the analog signal, fully expanding the bandwidth of the primary digital sidebands 102, 104, and adding lower-power secondary sidebands 106, 108 in the spectrum vacated by the analog signal. The all-digital waveform in the illustrated embodiment includes digitally modulated subcarriers at subcarrier locations −546 to +546, without an analog FM signal.

In addition to the ten main frequency partitions, all four extended frequency partitions are present in each primary sideband of the all-digital waveform. Each secondary sideband also has ten secondary main (SM) and four secondary extended (SX) frequency partitions. Unlike the primary sidebands, however, the secondary main frequency partitions are mapped nearer to the channel center with the extended frequency partitions farther from the center.

Each secondary sideband also supports a small secondary protected (SP) region 110, 112 including 12 OFDM subcarriers and reference subcarriers 279 and −279. The sidebands are referred to as "protected" because they are located in the area of spectrum least likely to be affected by analog or digital interference. An additional reference subcarrier is placed at the center of the channel (0). Frequency partition ordering of the SP region does not apply since the SP region does not contain frequency partitions.

Each secondary main sideband spans subcarriers 1 through 190 or −1 through −190. The upper secondary extended sideband includes subcarriers 191 through 266, and the upper secondary protected sideband includes subcarriers 267 through 278, plus additional reference subcarrier 279. The lower secondary extended sideband includes subcarriers −191 through −266, and the lower secondary protected sideband includes subcarriers −267 through −278, plus additional reference subcarrier −279. The total frequency span of the entire all-digital spectrum is 396,803 Hz. The amplitude of each subcarrier can be scaled by an amplitude scale factor. The secondary sideband amplitude scale factors can be user selectable. Any one of the four may be selected for application to the secondary sidebands.

In each of the waveforms, the digital signal is modulated using orthogonal frequency division multiplexing (OFDM). OFDM is a parallel modulation scheme in which the data stream modulates a large number of orthogonal subcarriers, which are transmitted simultaneously. OFDM is inherently flexible, readily allowing the mapping of logical channels to different groups of subcarriers.

In the hybrid waveform, the digital signal is transmitted in primary main (PM) sidebands on either side of the analog FM signal in the hybrid waveform. The power level of each sideband is appreciably below the total power in the analog FM signal. The analog signal may be monophonic or stereo, and may include subsidiary communications authorization (SCA) channels.

In the extended hybrid waveform, the bandwidth of the hybrid sidebands can be extended toward the analog FM signal to increase digital capacity. This additional spectrum, allocated to the inner edge of each primary main sideband, is termed the primary extended (PX) sideband.

In the all-digital waveform, the analog signal is removed and the bandwidth of the primary digital sidebands is fully extended as in the extended hybrid waveform. In addition, this waveform allows lower-power digital secondary sidebands to be transmitted in the spectrum vacated by the analog FM signal.

Figure 5:
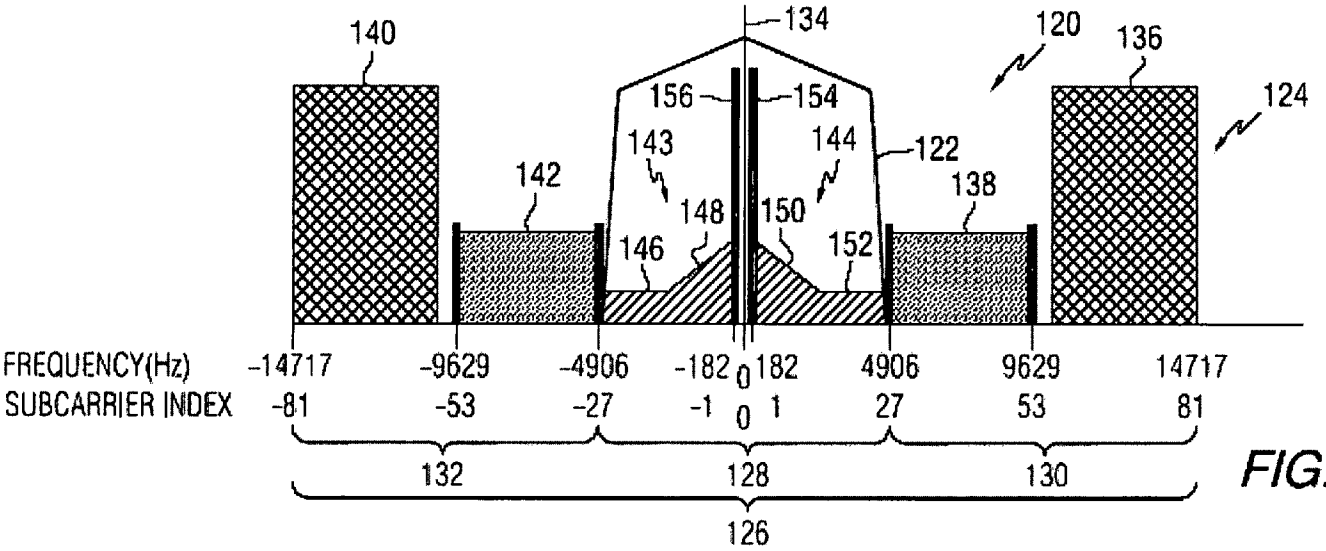
FIG. 5 is a schematic representation of a hybrid AM IBOC DAB waveform.

FIG. 5 is a schematic representation of an AM hybrid IBOC DAB waveform 120. The hybrid format includes the conventional AM analog signal 122 (bandlimited to about ±5 kHz) along with a nearly 30 kHz wide DAB signal 124. The spectrum is contained within a channel 126 having a bandwidth of about 30 kHz. The channel is divided into upper 130 and lower 132 frequency bands. The upper band extends from the center frequency of the channel to about +15 kHz from the center frequency. The lower band extends from the center frequency to about −15 kHz from the center frequency.

The AM hybrid IBOC DAB signal format in one example comprises the analog modulated carrier signal 134 plus OFDM subcarrier locations spanning the upper and lower bands. Coded digital information representative of the audio or data signals to be transmitted (program material), is transmitted on the subcarriers. The symbol rate is less than the subcarrier spacing due to a guard time between symbols.

As shown in FIG. 5, the upper band is divided into a primary section 136, a secondary section 138, and a tertiary section 144. The lower band is divided into a primary section 140, a secondary section 142, and a tertiary section 143. For the purpose of this explanation, the tertiary sections 143 and 144 can be considered to include a plurality of groups of subcarriers labeled 146, 148, 150 and 152 in FIG. 5. Subcarriers within the tertiary sections that are positioned near the center of the channel are referred to as inner subcarriers, and subcarriers within the tertiary sections that are positioned farther from the center of the channel are referred to as outer subcarriers. In this example, the power level of the inner subcarriers in groups 148 and 150 is shown to decrease linearly with frequency spacing from the center frequency. The remaining groups of subcarriers 146 and 152 in the tertiary sections have substantially constant power levels. FIG. 5 also shows two reference subcarriers 154 and 156 for system control, whose levels are fixed at a value that is different from the other sidebands.

The power of subcarriers in the digital sidebands is significantly below the total power in the analog AM signal. The level of each OFDM subcarrier within a given primary or secondary section is fixed at a constant value. Primary or secondary sections may be scaled relative to each other. In addition, status and control information is transmitted on reference subcarriers located on either side of the main carrier. A separate logical channel, such as an IBOC Data Service (IDS) channel can be transmitted in individual subcarriers just above and below the frequency edges of the upper and lower secondary sidebands. The power level of each primary OFDM subcarrier is fixed relative to the unmodulated main analog carrier. However, the power level of the secondary subcarriers, logical channel subcarriers, and tertiary subcarriers is adjustable.

Using the modulation format of FIG. 5, the analog modulated carrier and the digitally modulated subcarriers are transmitted within the channel mask specified for standard AM broadcasting in the United States. The hybrid system uses the analog AM signal for tuning and backup.

Figure 6:
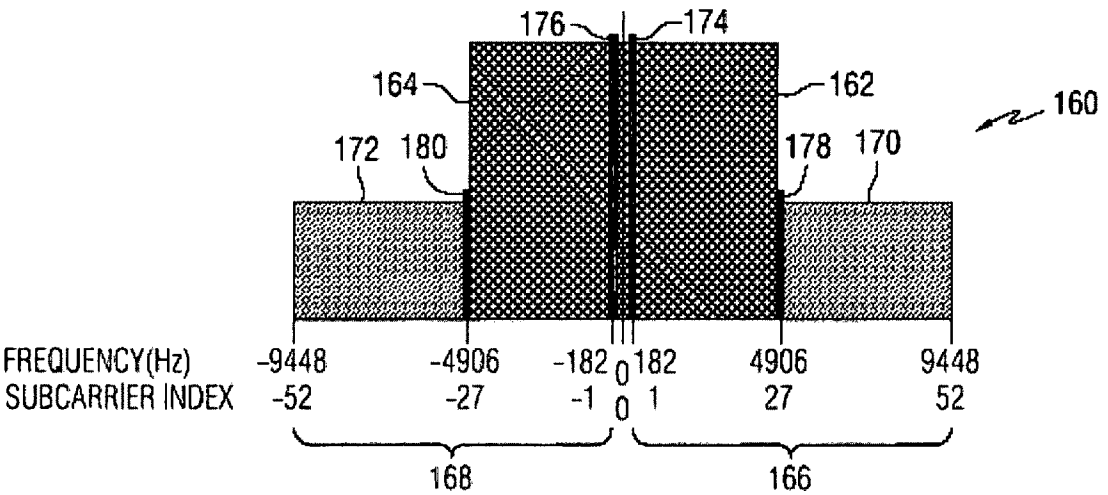
FIG. 6 is a schematic representation of an all-digital AM IBOC DAB waveform.

FIG. 6 is a schematic representation of the subcarrier assignments for an all-digital AM IBOC DAB waveform. The all-digital AM IBOC DAB signal 160 includes first and second groups 162 and 164 of evenly spaced subcarriers, referred to as the primary subcarriers, that are positioned in upper and lower bands 166 and 168. Third and fourth groups 170 and 172 of subcarriers, referred to as secondary and tertiary subcarriers respectively, are also positioned in upper and lower bands 166 and 168. Two reference subcarriers 174 and 176 of the third group lie closest to the center of the channel. Subcarriers 178 and 180 can be used to transmit program information data.

Figure 7:
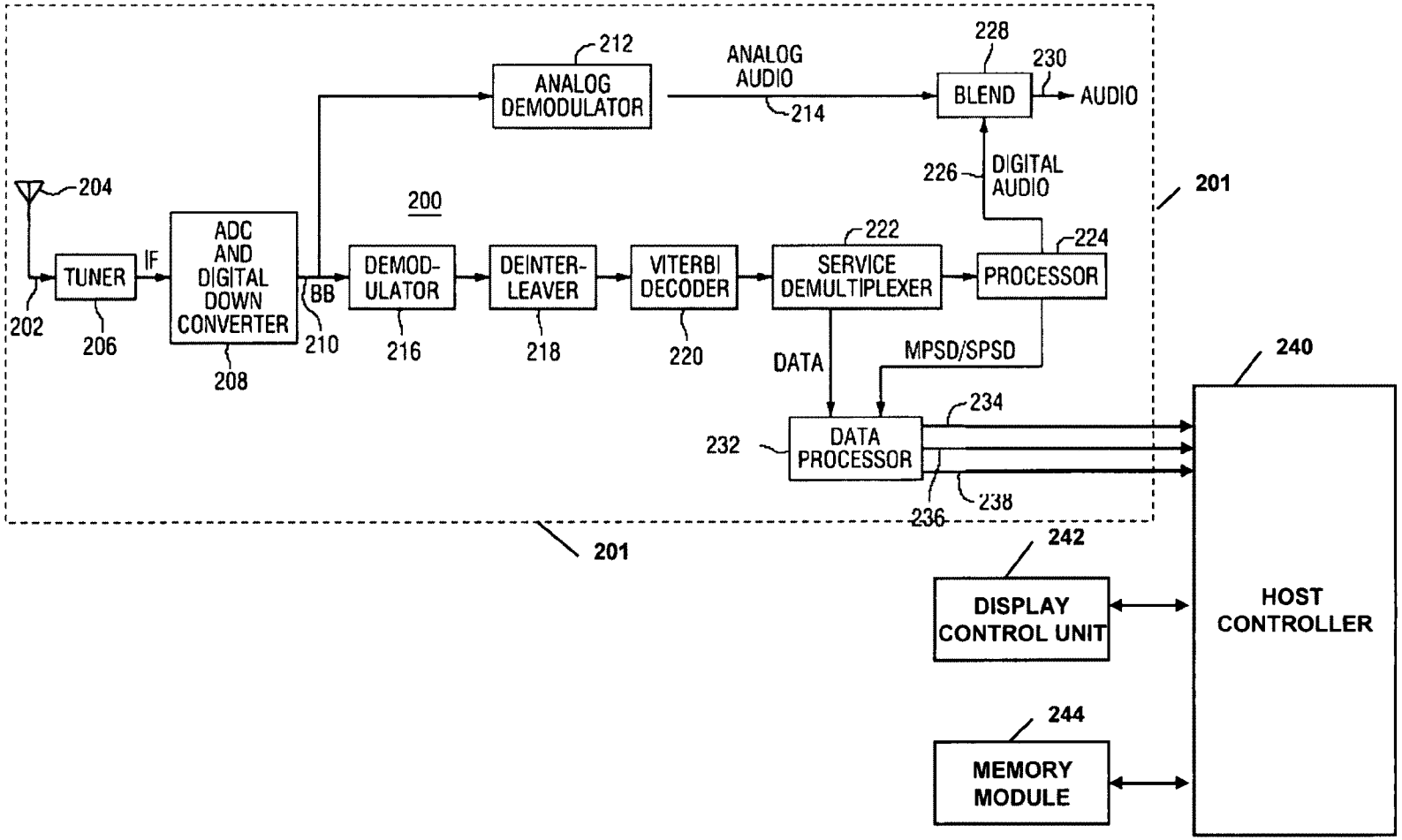
FIG. 7 is a functional block diagram of an AM IBOC DAB receiver in accordance with certain embodiments.

FIG. 7 is a simplified functional block diagram of the relevant components of an AM IBOC DAB receiver 200. The receiver includes a signal processing block 201, a host controller 240, a display controller unit (DCU) 242, and a memory module 244. The signal processing block 201 includes an input 202 connected to an antenna 204, a tuner or front end 206, and a digital down converter 208 for producing a baseband signal on line 210. An analog demodulator 212 demodulates the analog modulated portion of the baseband signal to produce an analog audio signal on line 214. A digital demodulator 216 demodulates the digitally modulated portion of the baseband signal. Then the digital signal is deinterleaved by a deinterleaver 218, and decoded by a Viterbi decoder 220. A service demultiplexer 222 separates main and supplemental program signals from data signals. A processor 224 processes the program signals to produce a digital audio signal on line 226. The analog and main digital audio signals are blended as shown in block 228, or a supplemental digital audio signal is passed through, to produce an audio output on line 230. A data processor 232 processes the data signals and produces data output signals on lines 234, 236 and 238. The data lines 234, 236, and 238 may be multiplexed together onto a suitable bus such as an Inter-Integrated Circuit ($I^2C$) or Serial Peripheral Interface (SPI) bus. The data signals can include, for example, SIS, MPS data, SPS data, and one or more AAS.

The host controller 240 receives and processes the data signals (e.g., the SIS, MPSD, SPSD, and AAS signals) from the signal processing block 201. The host controller comprises a microcontroller that is coupled to the DCU 242 and memory module 244. Any suitable microcontroller could be used such as an Atmel® AVR 8-bit reduced instruction set computer (RISC) microcontroller, an advanced RISC machine (ARM®) 32-bit microcontroller or any other suitable microcontroller. The DCU 242 comprises any suitable I/O processor that controls the display, which may be any suitable visual display such as an LCD or LED display. In certain embodiments, the DCU 242 may also control user input components via a keyboard, touch-screen display, dials, knobs or other suitable inputs. The memory module 244 may include any suitable data storage medium such as RAM, Flash ROM (e.g., an SD memory card), and/or a hard disk drive.

Figure 8:
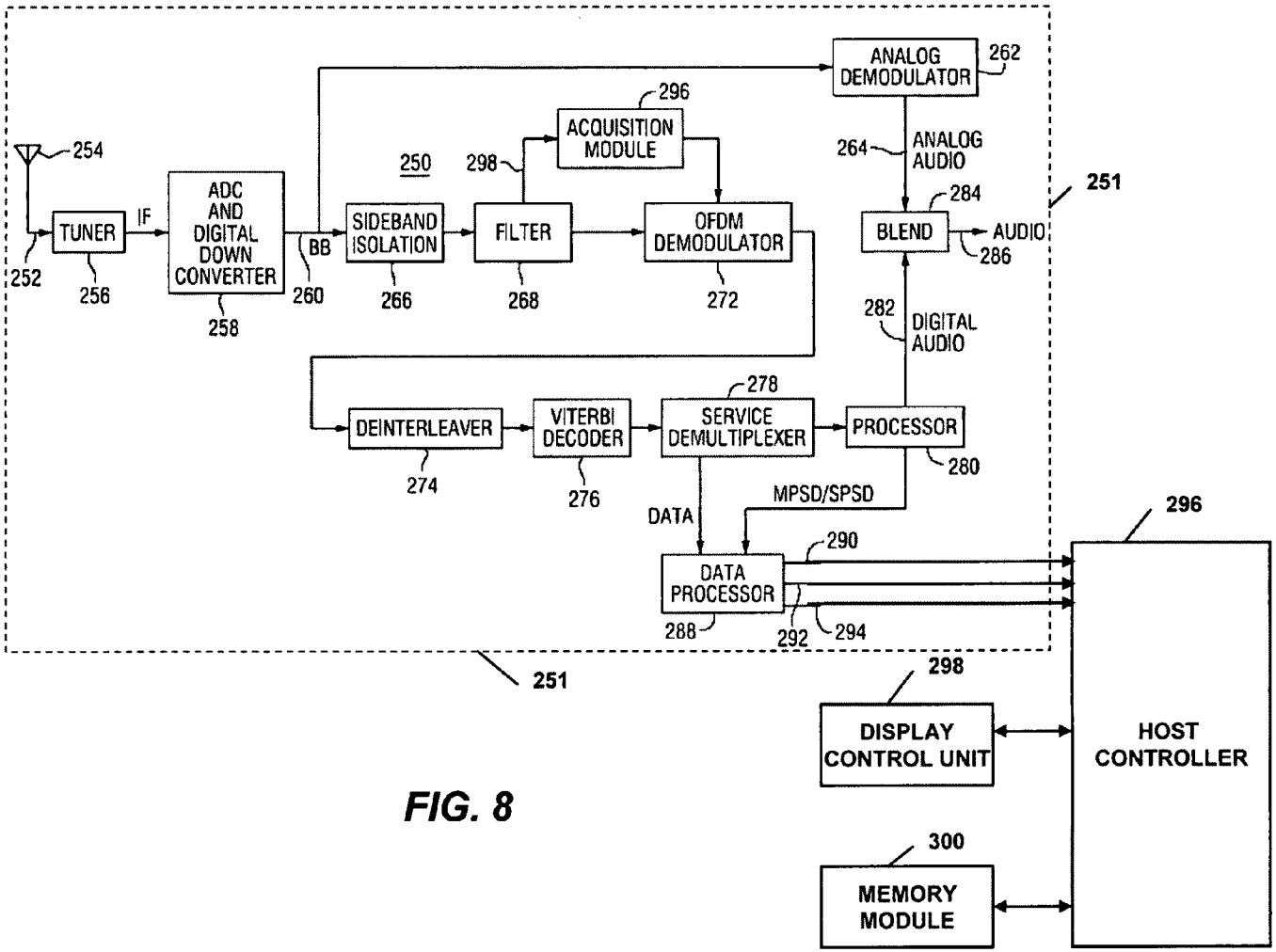
FIG. 8 is a functional block diagram of an FM IBOC DAB receiver in accordance with certain embodiments.

FIG. 8 is a simplified functional block diagram of the relevant components of an FM IBOC DAB receiver 250. The receiver includes a signal processing block 251, a host controller 296, a DCU 298, and a memory module 300. The signal processing block 251 includes an input 252 connected to an antenna 254 and a tuner or front end 256. A received signal is provided to an analog-to-digital converter and digital down converter 258 to produce a baseband signal at output 260 comprising a series of complex signal samples. The signal samples are complex in that each sample comprises a "real" component and an "imaginary" component, which is sampled in quadrature to the real component. An analog demodulator 262 demodulates the analog modulated portion of the baseband signal to produce an analog audio signal on line 264. The digitally modulated portion of the sampled baseband signal is next filtered by sideband isolation filter 266, which has a pass-band frequency response comprising the collective set of subcarriers $f_1$-$f_n$ present in the received OFDM signal. Filter 268 suppresses the effects of a first-adjacent interferer. Complex signal 298 is routed to the input of acquisition module 296, which acquires or recovers OFDM symbol timing offset or error and carrier frequency offset or error from the received OFDM symbols as represented in received complex signal 298. Acquisition module 296 develops a symbol timing offset $\Delta t$ and carrier frequency offset $\Delta f$, as well as status and control information. The signal is then demodulated (block 272) to demodulate the digitally modulated portion of the baseband signal. Then the digital signal is deinterleaved by a deinterleaver 274, and decoded by a Viterbi decoder 276. A service demultiplexer 278 separates main and supplemental program signals from data signals. A processor 280 processes the main and supplemental program signals to produce a digital audio signal on line 282. The analog and main digital audio signals are blended as shown in block 284, or the supplemental program signal is passed through, to produce an audio output on line 286. A data processor 288 processes the data signals and produces data output signals on lines 290, 292 and 294. The data lines 290, 292 and 294 may be multiplexed together onto a suitable bus such as an $I^2C$ or SPI bus. The data signals can include, for example, SIS, MPS data, SPS data, and one or more AAS.

The host controller 296 receives and processes the data signals (e.g., SIS, MPS data, SPS data, and AAS) from the signal processing block 251. The host controller comprises a microcontroller that is coupled to the DCU 298 and memory module 300. Any suitable microcontroller could be used such as an Atmel® AVR 8-bit RISC microcontroller, an advanced RISC machine (ARM®) 32-bit microcontroller or any other suitable microcontroller. The DCU 298 comprises any suitable I/O processor that controls the display, which may be any suitable visual display such as an LCD or LED display. In certain embodiments, the DCU 298 may also control user input components via a keyboard, touch-screen display, dials, knobs or other suitable inputs. The memory module 300 may include any suitable data storage medium such as RAM, Flash ROM (e.g., an SD memory card), and/or a hard disk drive.

In practice, many of the signal processing functions shown in the receivers of FIGS. 7 and 8 can be implemented using one or more integrated circuits. For example, while in FIGS. 7 and 8 the signal processing block, host controller, DCU, and memory module are shown as separate components, the functions of two or more of these components could be combined in a single processor (e.g., a System on a Chip (SoC)).

Figure 9A:
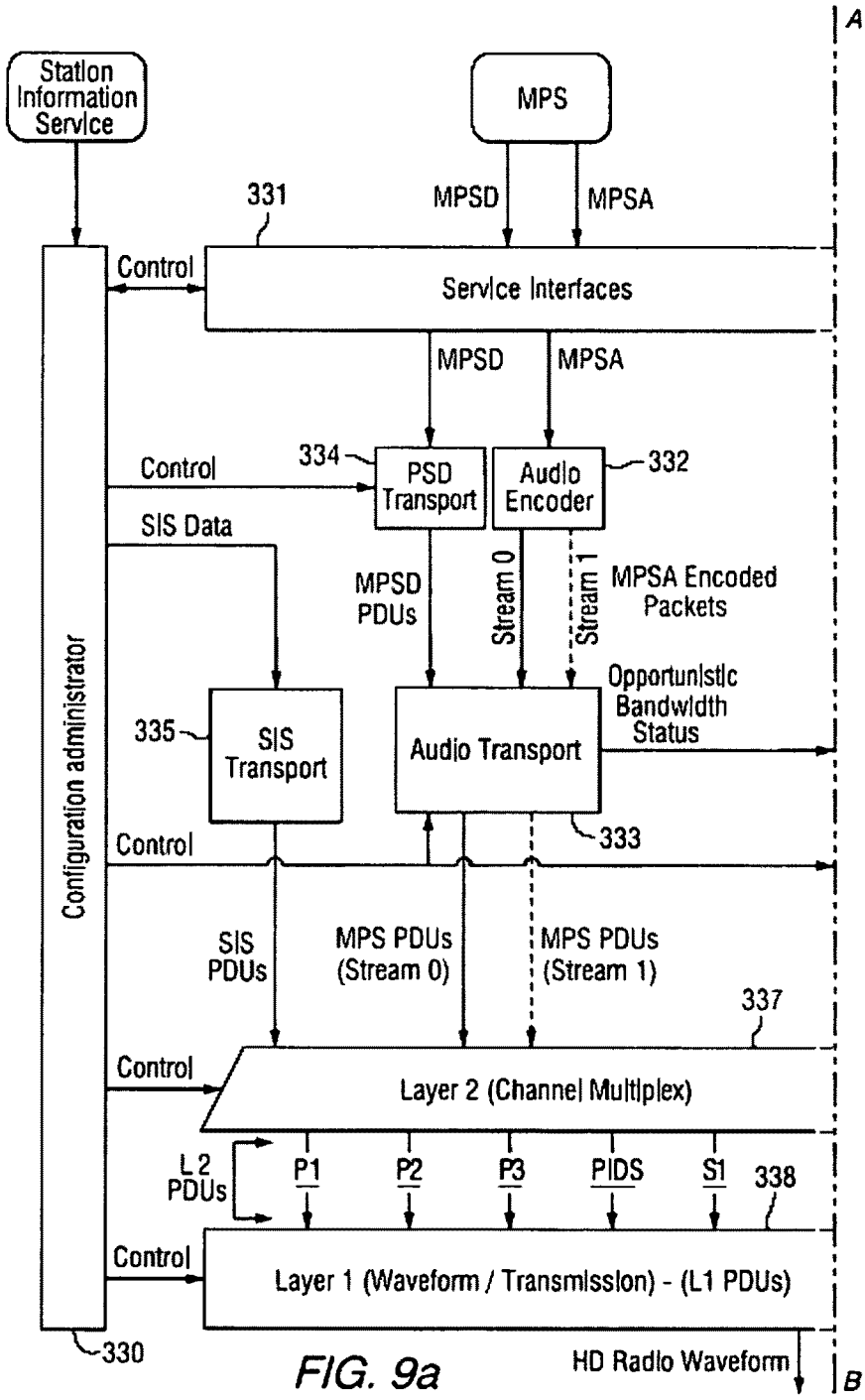
FIGS. 9*a* and 9*b* are diagrams of an IBOC DAB logical protocol stack from the broadcast perspective.
Figure 9B:
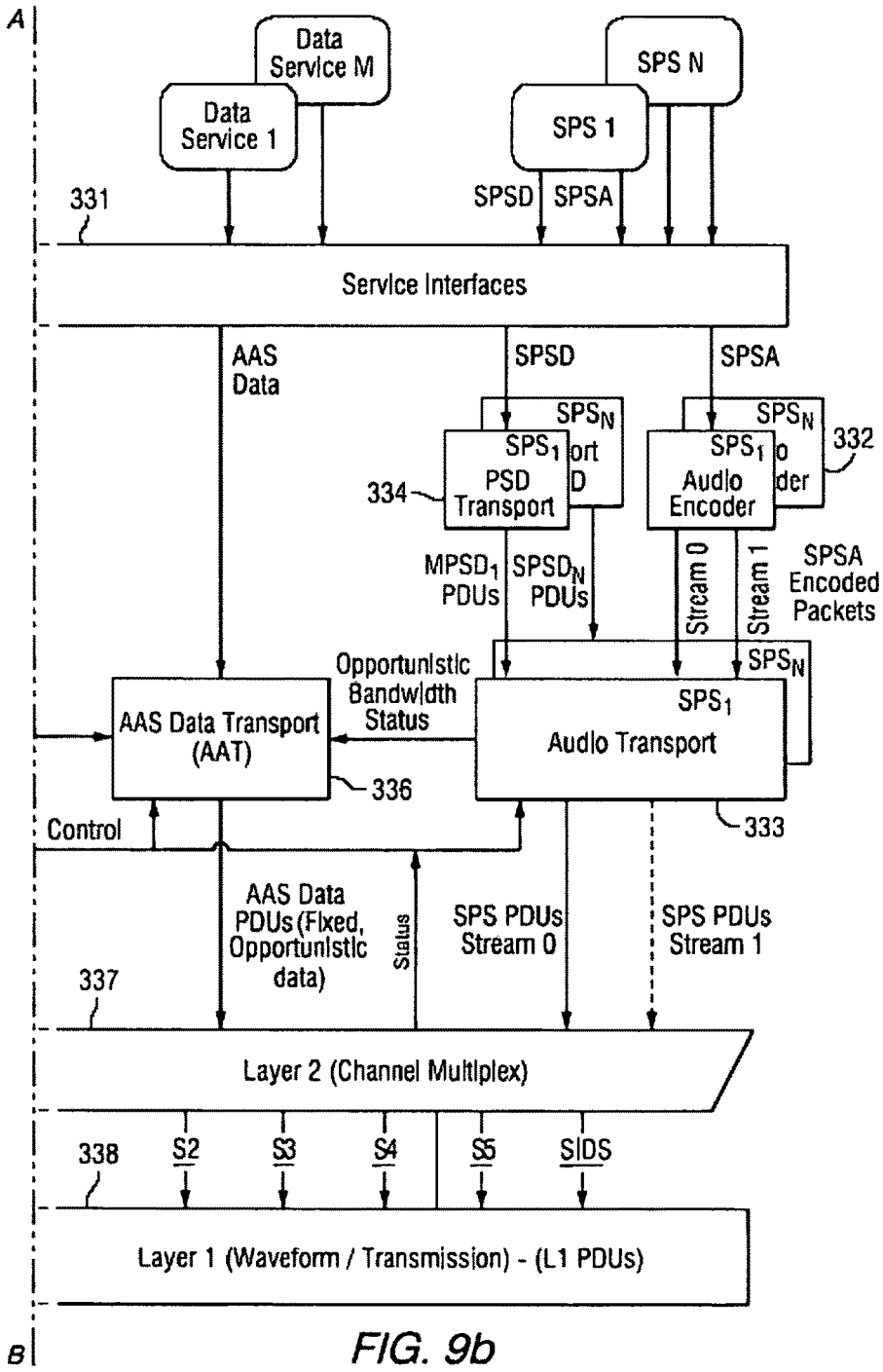

FIGS. 9*a* and 9*b* are diagrams of an IBOC DAB logical protocol stack from the transmitter perspective. From the receiver perspective, the logical stack will be traversed in the opposite direction. Most of the data being passed between the various entities within the protocol stack are in the form of protocol data units (PDUs). A PDU is a structured data block that is produced by a specific layer (or process within a layer) of the protocol stack. The PDUs of a given layer may encapsulate PDUs from the next higher layer of the stack and/or include content data and protocol control information originating in the layer (or process) itself. The PDUs generated by each layer (or process) in the transmitter protocol stack are inputs to a corresponding layer (or process) in the receiver protocol stack.

As shown in FIGS. 9*a* and 9*b*, there is a configuration administrator 330, which is a system function that supplies configuration and control information to the various entities within the protocol stack. The configuration/control information can include user defined settings, as well as information generated from within the system such as GPS time and position. The service interfaces 331 represent the interfaces for all services. The service interface may be different for each of the various types of services. For example, for MPS audio and SPS audio, the service interface may be an audio card. For MPS data and SPS data the interfaces may be in the form of different APIs. For all other data services the interface is in the form of a single API. An audio codec 332 encodes both MPS audio and SPS audio to produce core (Stream 0) and optional enhancement (Stream 1) streams of MPS and SPS audio encoded packets, which are passed to audio transport 333. Audio codec 332 also relays unused capacity status to other parts of the system, thus allowing the inclusion of opportunistic data. MPS and SPS data is processed by PSD transport 334 to produce MPS and SPS data PDUs, which are passed to audio transport 333. Audio transport 333 receives encoded audio packets and PSD PDUs and outputs bit streams containing both compressed audio and program service data. The SIS transport 335 receives SIS data from the configuration administrator and generates SIS PDUs. A SIS PDU can contain station identification and location information, indications regarding provided audio and data services, as well as absolute time and position correlated to GPS. The AAS data transport 336 receives AAS data from the service interface, as well as opportunistic bandwidth data from the audio transport, and generates AAS data PDUs, which can be based on quality of service parameters. The transport and encoding functions are collectively referred to as Layer 4 of the protocol stack and the corresponding transport PDUs are referred to as Layer 4 PDUs or L4 PDUs. Layer 2, which is the channel multiplex layer, (337) receives transport PDUs from the SIS transport, AAS data transport, and audio transport, and formats them into Layer 2 PDUs. A Layer 2 PDU includes protocol control information and a payload, which can be audio, data, or a combination of audio and data. Layer 2 PDUs are routed through the correct logical channels to Layer 1 (338), wherein a logical channel is a signal path that conducts L1 PDUs through Layer 1 with a specified grade of service. There are multiple Layer 1 logical channels based on service mode, wherein a service mode is a specific configuration of operating parameters specifying throughput, performance level, and selected logical channels. The number of active Layer 1 logical channels and the characteristics defining them vary for each service mode. Status information is also passed between Layer 2 and Layer 1. Layer 1 converts the PDUs from Layer 2 and system control information into an AM or FM IBOC DAB waveform for transmission. Layer 1 processing can include scrambling, channel encoding, interleaving, OFDM subcarrier mapping, and OFDM signal generation. The output of OFDM signal generation is a complex, baseband, time domain pulse representing the digital portion of an IBOC signal for a particular symbol. Discrete symbols are concatenated to form a continuous time domain waveform, which is modulated to create an IBOC waveform for transmission.

Figure 10:
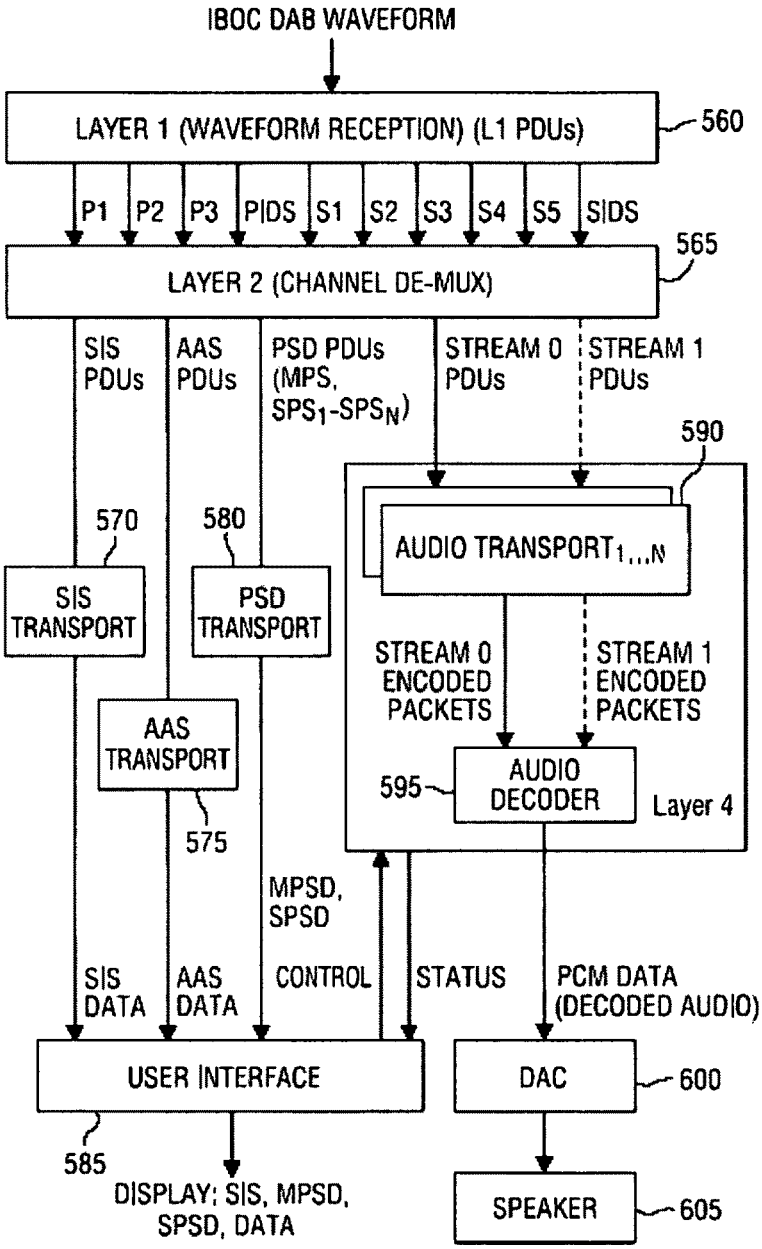
FIG. 10 is a diagram of an IBOC DAB logical protocol stack from the receiver perspective.

FIG. 10 shows the logical protocol stack from the receiver perspective. An IBOC waveform is received by the physical layer, Layer 1 (560), which demodulates the signal and processes it to separate the signal into logical channels. The number and kind of logical channels will depend on the service mode, and may include logical channels P1-P3, Primary IBOC Data Service Logical Channel (PIDS), S1-S5, and SIDS. Layer 1 produces L1 PDUs corresponding to the logical channels and sends the PDUs to Layer 2 (565), which demultiplexes the L1 PDUs to produce SIS PDUs, AAS PDUs, PSD PDUs for the main program service and any supplemental program services, and Stream 0 (core) audio PDUs and Stream 1 (optional enhanced) audio PDUs. The SIS PDUs are then processed by the SIS transport 570 to produce SIS data, the AAS PDUs are processed by the AAS transport 575 to produce AAS data, and the PSD PDUs are processed by the PSD transport 580 to produce MPS data (MPSD) and any SPS data (SPSD). The SIS data, AAS data, MPSD and SPSD are then sent to a user interface 590. The SIS data, if requested by a user, can then be displayed. Likewise, MPSD, SPSD, and any text based or graphical AAS data can be displayed. The Stream 0 and Stream 1 PDUs are processed by Layer 4, comprised of audio transport 590 and audio decoder 595. There may be up to N audio transports corresponding to the number of programs received on the IBOC waveform. Each audio transport produces encoded MPS packets or SPS packets, corresponding to each of the received programs. Layer 4 receives control information from the user interface, including commands such as to store or play programs, and to seek or scan for radio stations broadcasting an all-digital or hybrid IBOC signal. Layer 4 also provides status information to the user interface.

Exemplary EPG File Description

According to an exemplary embodiment, the Service Bureaus can generate two primary types of EPG files—index files and content files. The EPG index and content files typically have a file name that includes one or more of the following: the SB identifier, the file type (e.g., Index File or Content File), a market identifier, a cluster identifier, a date, and a version number. The file names may follow a naming convention that specifies byte lengths and proper entries for each component. For example, FIG. 11 illustrates a naming convention having six characters for the SB identifier, two characters for the file type, three numerals for the market (e.g., '001' could identify New York, N.Y.), two characters for the cluster, eight characters for the date and two characters for the version number. Any other suitable naming convention could be used. Advantageously, following such a naming convention may allow the file names to facilitate selection of index and content files at the receiver to be decoded and processed.

Index files typically contain information identifying the content files that are associated with the markets, clusters, and radio stations served by a SB. This identifying information could be, for example, a list of the content file names or binary encoded data that can be used to generate the content file names. Index files are typically constructed using a high-level language such as XML. However, in some embodiments, the index files and content files could be constructed using any other suitable file type. For example, the index and content files could be formulated as Comma-Separated-Values (CSV) files. Additionally, in embodiments directed to radio station clusters or markets, the index file may indicate the number of stations for any respective cluster and Station Identifications (e.g., FCC Identifiers). Advantageously, by including clusters of other stations in the EPG, a receiver may be able to receive programming information regarding stations from which it cannot currently receive broadcast signals.

Index files are typically broadcast over an RLS port assigned by the importer and communicated in the SIG as described below. In certain embodiments, the importer may assign a block of RLS ports for EPG files, in which cases the entries in the index file also may indicate an RLS port number on which each content file is being transmitted. In these embodiments, each RLS port number may be associated with a particular date. For example, the index file could be broadcast over RLS port number 1, the content file for the current date could then be broadcast over RLS port number 2, and the content file for the next date over RLS port number 3. Any suitable number of RLS ports and content files could be used. For example, for 7 days of content files, 8 RLS ports could be assigned, or for 14 days of content files 15 RLS ports could be assigned. As the date rolls over, the RLS ports associated with content files would be updated as described in more detail below. FIGS. 12*a* and 12*b* illustrate an exemplary Index File that contains five clusters of radio stations. As shown in FIG. 12*a*, cluster 1 contains radio stations on 95.7 FM, 1480 AM, and 105.3 FM. As illustrated in FIG. 12*b*, cluster 1 corresponds to the first entry in the index file and has an exemplary file name of EPGSB103006011210200501 (e.g., where the "006" refers to Philadelphia in this example). It is being broadcast on RLS port number 2, which is associated with Day 1 (i.e. the current date).

Figure 13C:
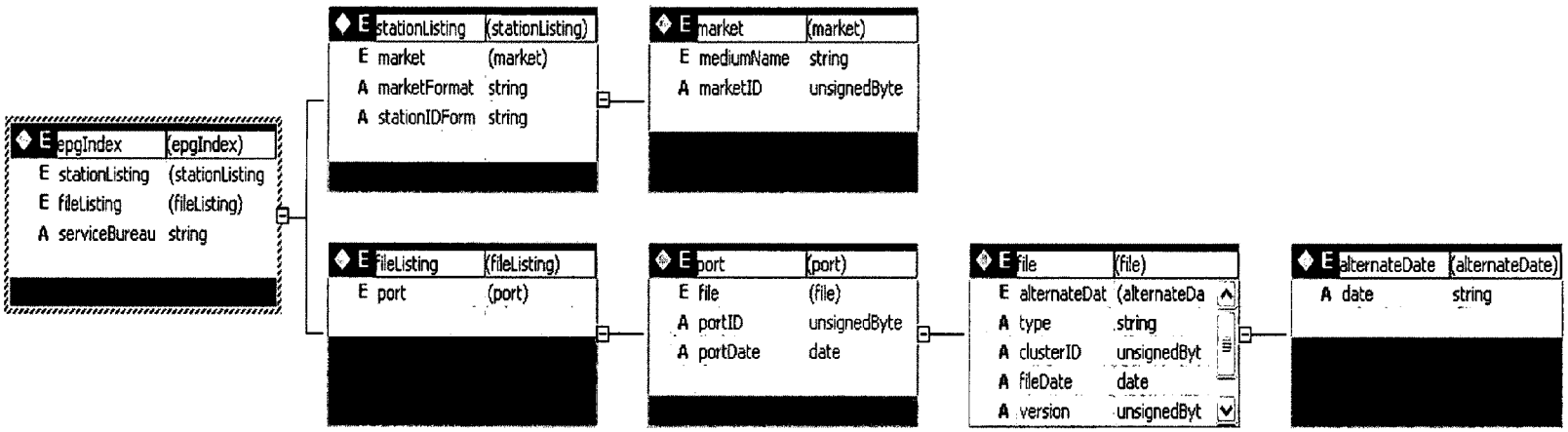

In some embodiments, the index files and content files may be structured in an XML hierarchy. An exemplary XML index file is illustrated in FIGS. 13*a* and 13*b*. FIG. 13 *a* shows, which show an index file for one market identified as the New York market (shown as marketID "001") having two clusters (shown as clusterID numbers "1", and "2") and six stations (four in cluster 1 shown as stationID numbers "00405611", "0040715e", "0040cd79", and "00411e8b", and two in cluster 2 shown as stationID numbers "0040dcfb" and "0040ea31"). The index file contains a list of the content file names associated with portID numbers 1, 2, 3 and 6, wherein portID number 1 is associated with static-service files, portID number 2 is associated with Jan. 1, 2006, portID number 3 is associated with Jan. 2, 2006, and portID number 6 is associated with Jan. 5, 2006. An exemplary XML hierarchy for an index file is illustrated in FIG. 13*c*. Each XML file may include a single top level element (e.g., "epgIndex" for index files, "epg" for schedule files and linked content files (described below), or "serviceInformation" for service files (described below)). Each top level element can include one or more elements and one or more attributes. Referring to FIGS. 13*a* and 13*c*, the "epgIndex" top level element includes a "stationListing" element that describes the markets and clusters associated with the index file, a "fileListing" element that describes the content files associated with the index file, and an "originator" attribute. Each element can further include one or more child elements and one or more attributes, wherein the child elements can also have one or more attributes. For example in FIGS. 13*a* and 13*c* the "stationListing" element includes a "market" child element that describes the markets associated with the index file, and "serviceBureau," "version," "marketFormat," and "stationIDFormat" attributes. Furthermore, the child elements can be nested to any desired level. Referring again to FIGS. 13*a* and 13*c*, the "market" child element includes "cluster" child elements.

Index files and content files may be binary encoded and/or compressed prior to transmission for efficient bandwidth capacity management. In certain aspects, a suitable binary encoding scheme could be, for example, Tag-Length-Value (TLV) encoding. For example, "Digital Audio Broadcasting (DAB); Transportation and Binary Encoding Specification for DAB Electronic Programme Guide (EPG)," ETSI TS 102 371 v.1.1.1 (2005-01), incorporated herein in its entirety by reference, discloses a typical TLV binary encoding scheme. In the disclosed scheme, each element or attribute of an XML file is encoded using a unique tag value, a length value (indicating the length of the data contained within this element or attribute), and the actual data value or values. The XML elements are encoded into binary data structures that generally preserve the hierarchical nature of the XML schema. The binary structure includes a basic binary object that may include a top level element having elements and attributes that may be encoded according to the following pseudo-code algorithm.

```
binary__object( ) {
    top__level__element( )) {
        Element__or__attribute( ) {
            element__or__attribute__tag
            element__or__attribute__length
            if (element__or__attribute__length == 0xFE) {
                extended__element__or__attribute__length__16
            }
            if (element__or__attribute__length == 0xFF) {
                extended__element__or__attribute___length__24
            }
            for (i=0; i< element__or__attribute__length or
extended__element__or__attribute___length; i++) {
            element__or__attribute__data__byte
}    }    }    }
```

In this exemplary algorithm the tag uniquely identifies the element within the index file, or uniquely identifies the attribute within the parent element. The length indicates the number of bytes contained in the element or attribute—the number of bytes that follow the length byte up to the end of the element or attribute. In some embodiments, the extended length may be used for longer elements or attributes. For elements, the data bytes contain the element's attributes and child elements; for attributes the data bytes contain the attribute's value such as a string, integer, or other data type.

Certain embodiments provide a content file reuse capability. Specifically, for content that is repetitive (e.g., the "Morning Show" is broadcast Monday through Friday mornings from 6:00 AM to 9:00 AM), the index file can include an indication that the content files corresponding to the content apply to multiple dates (e.g., the content files associated with the "Morning Show" will indicate that they apply to Monday through Friday). Such a file reuse indicator may be an additional element in the index file (e.g., an "alternateDate" element) that is associated with the appropriate content files. FIG. 13*b* illustrates an exemplary embodiment of file reuse indicators. As shown, the cluster 1 and cluster 2 files for portID number 3 contain "alternateDate" elements that refer to Jan. 3, 2006 and Jan. 4, 2006. Thus in this exemplary embodiment, schedule files for these two dates are not transmitted. Rather the receiver will reuse the cluster 1 and cluster 2 files from portID number 3 to populate the EPG for Jan. 3, 2006 and Jan. 4, 2006. Advantageously, such a file reuse capability minimizes the bandwidth required for transmitting the EPG.

Content files provide information on available audio programs and data content. Specifically, the content files carry EPG service, schedule, and linked content information for the station or stations supported by the SB. The content files are generated by the SBM and sent to transmitting stations along with the index file.

In certain embodiments, there may be six types of content files, three for a basic profile and three for an advanced profile. The basic profile may contain basic EPG information—e.g., time and short program title—adapted for simple and/or low-end receivers. The advanced profile may contain more advanced information including longer program titles, descriptions, and multimedia content adapted for receivers with more capabilities. Additionally, because the basic and advanced profiles are typically transmitted separately, the advanced profile carries an association to the corresponding basic profile. When a receiver receives the basic and advanced profiles, it may internally combine the profiles to present a consistent EPG. Typically, receivers that desire to decode the advanced profile will also decode the associated basic profile for the corresponding content. Advantageously, separating the profiles into basic and advanced allows low-end receivers to receive and decode only the information necessary to render a basic EPG (e.g., display EPG information with or without accompanying audio EPG information), while higher-end receivers may by able to render more advanced content consistent with their respective capabilities.

The six content file types comprise service information (service files), schedule information (schedule files), and linked content information (linked content files) for a basic profile; and service information (service files), schedule information (schedule files), and linked content information (linked content files) for an advanced profile. While described separately for clarity, it is contemplated that both basic and advanced file types could be utilized (basic and advanced content may be merged) in higher-end EPG enabled receivers. For example, a content file could contain both service information and schedule information, or both schedule information and linked content information, or any other suitable combination.

Service files provide information about available audio programs and data services. The elements of a service file may include name, description, program type, and whether it is a data or audio service. Examples of audio programs include hosted DJ radio shows, talk radio shows, baseball games, etc. Examples of data services include streaming traffic data or stock tickers, etc. Service files also typically include the station on which the service is being broadcast including the station call sign and broadcast frequency. For example, a service file might indicate that 95.7 FM is broadcasting audio via HD Radio™. Exemplary XML elements and attributes for a service file are shown below in Table 2 and an exemplary XML service file is illustrated in FIG. 13*d*. The exemplary service file shown in FIG. 13*d* contains a top level "serviceInformation" element having several "station" elements, each of which describes a particular radio station. For example, the exemplary service file contains information on WAAA 99.5 FM, WBBB 100.3 FM, and WCCC 101.0 FM. Each "station" element includes "shortName," "mediumName," "frequency," and "service" child elements. As shown, the "service" elements have a "bearerID" attribute that provides a unique identifier for each particular radio station service.

TABLE 2

| Element | Attributes |
|---|---|
| serviceInformation | |
| serviceInformation.station | stationID; system |
| serviceInformation.station.shortName | xml:lang |
| serviceInformation.station.mediumName | xml:lang |
| serviceInformation.station.frequency | type, kHz |
| serviceInformation.station.service | contentformat; bearerID |
| serviceInformation.station.service.shortName | xml:lang |
| serviceInformation.station.service.mediumName | xml:lang |
| serviceInformation.station.service.mediaDescription | |
| serviceInformation.station.service.mediaDescription.multimedia | type; mimeValue; xml:lang; url; width; height |

Schedule files provide information on the individual pieces of content that are broadcast on one or more services for a defined period of time. Information on both audio programs and data services may be included within any schedule file. The elements of a schedule file may include the content name, start time, duration, description, program type, a value indicating the associated service file, and links to other multimedia content associated with the content. For example, a schedule file could indicate that the "Morning Show" is available from 6:00 AM to 9:00 AM Monday morning and have a "bearerID" attribute indicating that the schedule file is associated with the service file for 95.7 FM. For a data service, an exemplary schedule file could indicate that "Washington D.C. Traffic Updates" are available 24 hours a day, for example. Schedule files may include an appropriate expiration date and/or time. For example, if the "Morning Show" was only available on Monday, then the corresponding schedule file could expire at the end of the day on Monday. In certain embodiments, content may be selected (e.g., user defined) for triggering other processes inside or outside the receiver. For example, this may provide the capability to start recording a certain program at a certain time when it is to be broadcast to trigger a reminder alarm (e.g., audio and/or visual indicator) when a certain program is scheduled to start. Exemplary XML elements and attributes for a schedule file are shown below in Table 3 and an exemplary XML schedule file is shown in FIG. 13*e*. The exemplary service file shown in FIG. 13*d* contains a top level "epg" element having a "schedule" element. The "schedule" element includes several "content" child elements, each of which describes a particular radio program. The exemplary schedule file in FIG. 13*e* contains schedule information for WCCC 101.0 FM, the service information for shown in FIG. 13*d*. Thus it includes several "content" elements for bearerID 4202986.0 (e.g., "WCCC Rocks Overnights", "Kelly Knight and Weasel", etc.), and several "content" elements for bearerID 4202986.1 (e.g., "Adult Alternative—The Jam" etc."), each of which has a "time" child element that describes the start time and duration of the associated program content.

TABLE 3

| Element | Attributes |
|---|---|
| epg | |
| epg.schedule | |
| epg.schedule.content | contentID; broadcast |
| epg.schedule.content.mediumName | xml:lang |
| epg.schedule.content.longName | xml:lang |
| epg.schedule.content.location | |
| epg.schedule.content.location.time | time; duration |
| epg.schedule.content.location.bearer | bearerID |
| epg.schedule.content.mediaDescription | |
| epg.schedule.content.mediaDescription.ShortDescription | xml:lang |
| epg.schedule.content.contentformat | type; code |
| epg.schedule.content.memberOf | contentID; itemNum |

In certain embodiments, individual pieces of content, including audio and data content, can be linked or grouped together to form a series. The linked content files contain a reference to one or more linked content groups. The linked content groups contain the linked details for the individual pieces of content such as name, description, type of group, and links to multimedia content for the group. To continue the above example, the "Morning Show" could include a link to a grouping of other talk shows in the schedule files associated with an index file. Other examples of groupings could include sports programs, network and national baseball games, local team baseball games, comedy shows, streaming traffic services, or any other suitable grouping of content. Exemplary XML elements and attributes for a linked content file are shown below in Table 4 an exemplary XML linked content file is illustrated in FIG. 13*f*. The exemplary linked content file contains a top level "epg" element having a "contentGroups" element. The "contentGroups" element includes a number of "contentGroup" child elements, each of which describes a specific content group. For example, the exemplary linked content file contains content groups for "Overnight Music", "Morning Show Edition, etc. As shown, the "contentGroup" elements have a "contentID" attribute that provides a unique identifier for each particular content group.

TABLE 4

| Element | Attributes |
|---|---|
| epg | |
| epg.contentGroups | |
| epg.contentGroups.contentGroup | contentID; type; numOfItems |
| epg.contentGroups.contentGroup.mediumName | xml:lang |
| epg.contentGroups.contentGroup.longName | xml:lang |
| epg. contentGroups.contentGroup.contentformat | type; code |
| epg.contentGroups.contentGroup.memberof | contentID; itemNum |

In certain embodiments, service files, schedule files, and linked content files may be additionally defined for reuse or classified as static or dynamic. Files defined as static are typically service files containing information such as a station call sign that will change infrequently; these files may be referred to as static-service files. Dynamic files are typically schedule and linked content files that will change on a daily or weekly basis. However, schedule and linked content files may be reused so that these files are only sent once and the EPG can reference the reuse file on other file dates as needed. In certain embodiments the static-service files may be assigned a default RLS port by the importer over which the static-service files are broadcast. Advantageously, this allows for efficient transport and prioritization of content that need not be updated frequently.

Certain embodiments of the current invention provide a schema for defining the elements of the EPG files. The XML schema could be constructed with any suitable XML schema language such as XML Schema or Document Type Definition (DTD). The index files and content files can be initially generated as XML files by the SBM and validated against the appropriate XML schema.

Figure 14:
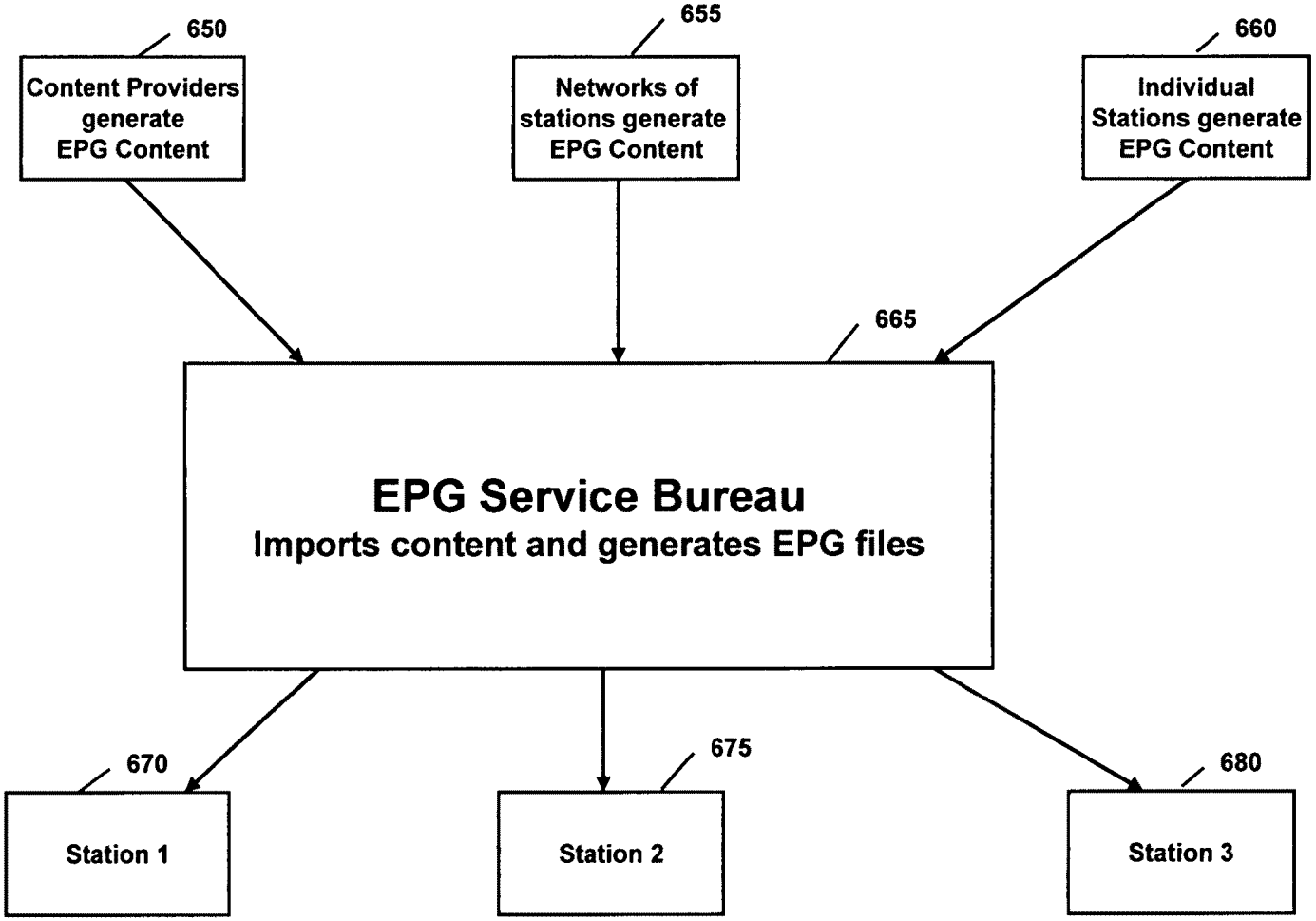
FIG. 14 illustrates a system for aggregating and broadcasting EPGs in accordance with certain embodiments.

FIG. 14 illustrates an exemplary process by which the SB 665 aggregates and transmits programming information. As illustrated in FIG. 14, the content providers 650, networks of radio stations 655, and individual stations 660 (collectively "EPG content providers") generate EPG content, which is then aggregated and processed by the SB 665 and scheduled for transmission on the participating radio stations 670, 675, and 680. In an exemplary embodiment, the SB 665 operates the SB block 1 of FIG. 16 to aggregate EPG content (e.g., programming information, service information, and linked content information), generate and manage EPG files, prioritize EPG files for bandwidth management, schedule EPG files for transmission, and interface with the EPG Client 8 via an interface 5. In some embodiments, the SB block 1 may also validate the file formatting of EPG files and/or group EPG files into clusters. Although each participating radio station 670, 675, and 680 is shown as only transmitting EPG files from a single SB, it is contemplated that multiple SBs may transmit EPG files from a single radio station.

The EPG content providers will typically utilize a SBUI (see, e.g., FIG. 15*a* and 15*b*) for generating and modifying the EPG content and communicating it to the SB. In some embodiments, the SB operators will also have the access to the SBUI. In this regard, the SBUI may be configured to establish session connections between multiple EPG content providers and/or the SB operators. The SBUI application may be resident at the SB, distributed to individual EPG content providers, hosted by a third-party, or any suitable combination thereof. Further, in some embodiments the SBUI 2 may be accessible as a website via the Internet.

Figure 15A:
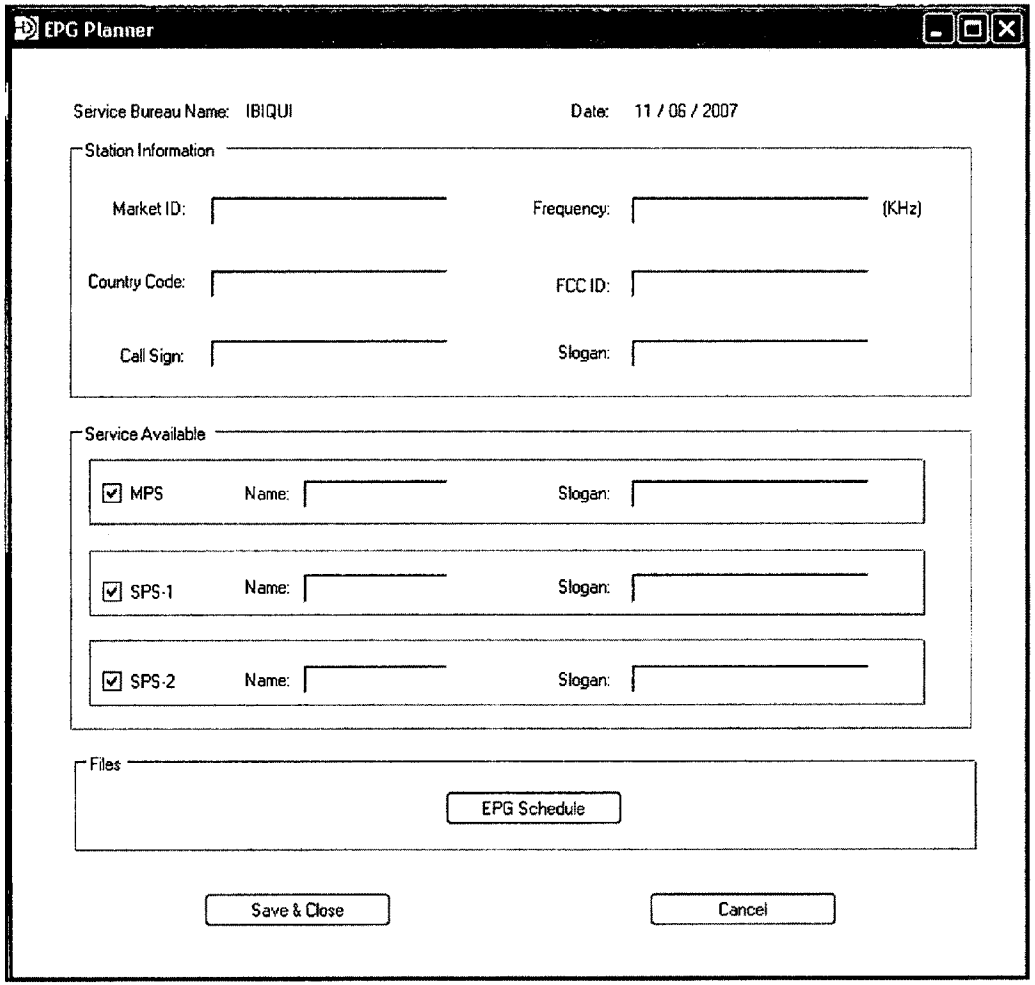
Figure 15B:
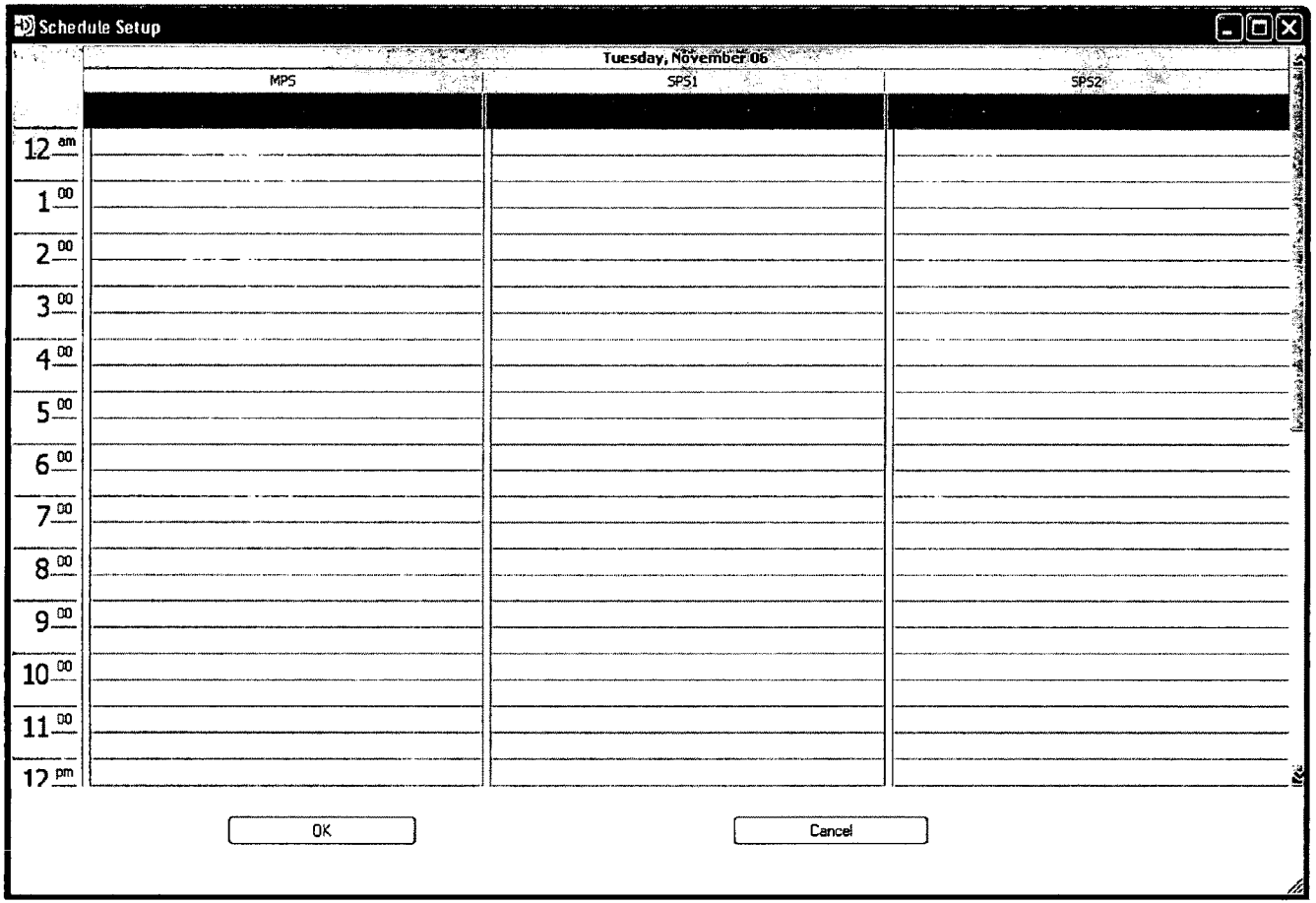

In certain embodiments, the SBUI provides a Graphical User Interface (GUI) that allows the EPG content providers and SB operators to create and modify radio program schedules, for example, in a day and time-slot format. An exemplary GUI is shown in FIGS. 15*a* and 15*b*. In the exemplary dialog box shown in FIG. 15*a*, a user may input the station and service information such as market ID, frequency, country code, FCC ID, and call sign as well indicate whether programs are available on the MPS and SPS channels. By selecting "EPG Schedule," a user can then create 24-hour schedules for each MPS and SPS channel as illustrated in the exemplary dialog box shown in FIG. 15*b*.

In some embodiments the SB operators may have their own interface for accessing the SBM 2. An exemplary SB operator interface is shown in FIGS. 15*c*1 and 15*c*2. The exemplary interface displays and allows SB operators to modify current and future index files. To perform these functions, it contains a number of dialog boxes and tables. These include: a "Service Bureau Formatting" block containing SB information; a market dropdown box for choosing the appropriate market (it is contemplated that each SB may serve multiple markets); a "Clusters and Markets" table containing markets and their associated clusters; a "Clusters and Stations" table containing clusters and their associated stations; a "Clusters and Files" table containing clusters with their associated ports, content files, and content file reuse indicators (the "Alternative Dates" table).

The EPG content generated by the SBUI may be created in a variety of file formats. In some embodiments, the EPG content may be created as pre-formatted XML content files using the XML schema described above. In some embodiments, the EPG content could be created as CSV files and/or text files. Additionally, any other suitable file format could be utilized such as HTML files, Microsoft Word files, Microsoft Excel files, or Microsoft Outlook files. In certain embodiments, the EPG content could be generated in any suitable combination of these formats.

Figure 16:
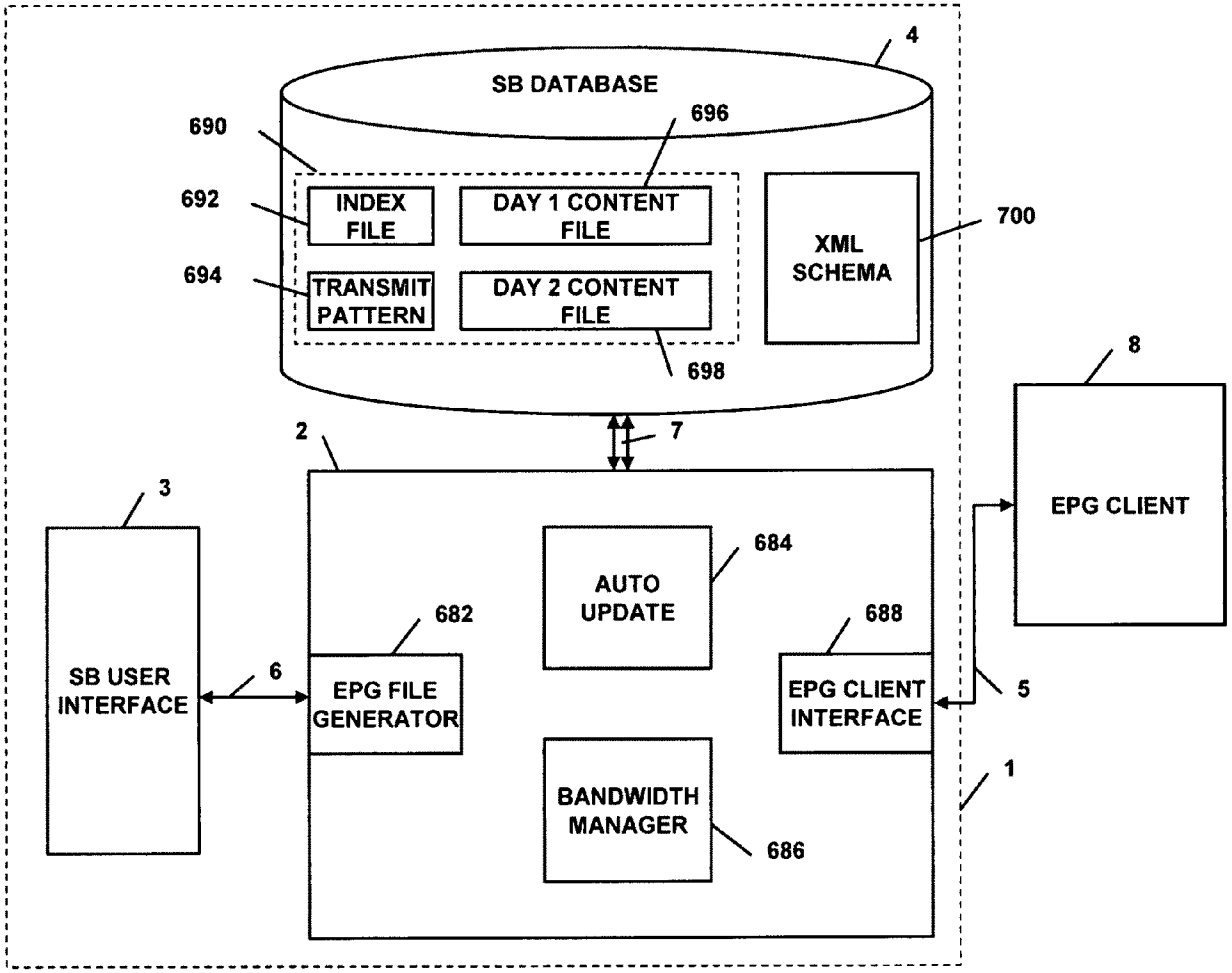
FIG. 16 illustrates a Service Bureau system in accordance with certain embodiments.

Referring to FIG. 16, the SBUI 3 may also provide users with the capability to define desired broadcast ratios for various files. For example, it may be desirable to transmit static-service files less frequently than schedule files. It also may be desirable to transmit the schedule files for the current day more frequently than the schedule files for the next day or following week. The SBUI can provide a dialog box that gives users the ability to enter a desired static-file-to-schedule transmission ratio, or the ratio may be specified in a software configuration file. For example, in some applications a suitable static-file-to-schedule transmission ratio may be 4:1 meaning that the schedule files will be transmitted four times for every one time the static-service file is transmitted. This ratio may be entered in the form of a ratio, a percentage or any other suitable format. In some embodiments, the SBUI can also provide a dialog box that gives the users the ability to enter a desired date-to-date transmission ratio (e.g., a first-date-to-second-date transmission ratio) or the ratio may be specified in a software configuration file. For example, the user may define the number of times Day 1 (i.e. the current day) will be transmitted in comparison to the number of times Day 2, Day 3, Day 4 etc. will be transmitted. This ratio may be entered in the form of a ratio, a percentage for each day, or any other suitable format. These ratios may be stored in any appropriate file format such as XML, plain text, or CSV. After the user has defined the desired ratios, they can then be communicated to the SBM along with the EPG content.

FIG. 16 illustrates the components of an exemplary SB block 1. As illustrated in FIG. 16, the SBUI 3 communicates with the SBM 2 to provide EPG content via an interface 6. For example, in some embodiments the SBUI may be hosted on a third-party website or on an EPG content provider server, in which case the interface with the SBM could be via a TCP/IP socket connection. In some embodiments, the SBUI may execute on the same processor as the SBM, in which case the interface may be an API. Alternatively, the EPG content could be delivered to the SBM on any suitable computer readable medium such as optical, magnetic, or memory card storage.

The SBM 2 is comprised of several functional modules. In certain embodiments the SBM 2 includes an EPG file generator module 682, an automatic update module 684, a bandwidth manager module 686, and an EPG Client interface module 688. The EPG file generator module 682 receives the EPG content, processes it to generate content files, and stores the content files in the SBDB 4. The EPG file generator module 682 may also receive any desired broadcast ratios, process them to generate a transmit pattern file, and store the transmit pattern file in the SBDB 4. In some embodiments the EPG file generator module 682 receives EPG content in a non-XML file format and converts it into to XML files utilizing the XML schema 700 according to a predetermined conversion template. However, in certain embodiments the EPG file generator module 682 may leave the EPG content in its native file format. For example, if the EPG content is in the form of XML files, the EPG file generator module 682 may not perform any conversion or validation of the EPG content. But in some applications the EPG file generator module 682 validates received XML files against an XML schema 700 as described above. In still other embodiments, the EPG file generator module 682 converts the EPG content to another file format such as CSV. Once the content files are generated, the EPG file generator module 682 stores them in the SBDB 4 via the SBDB interface 7.

The SBDB 4 includes hardware (e.g., magnetic or optical storage) and software for storing and maintaining content files, index files, and other EPG related files. The exemplary embodiment shown in FIG. 16 illustrates an SBDB 4 that has been provisioned with EPG files. The exemplary SBDB 4 contains files in a database 690, which stores EPG files currently scheduled for transmission to the EPG Client 8, and the XML schema 700, which may be used for generating and validating EPG files. For example, an XML-based EPG file can be validated by checking the file against an appropriate XML schema (e.g., a schedule file could be checked against a schedule file XML schema) to determine whether it is well-formed and whether it conforms to the schema's defined structure. A well-formed document follows the basic rules of XML established for the design of documents. The EPG files stored in the database 690 include an index file 692, a transmit pattern file 694, a day 1 content file 696, and a day 2 content file 698. Although the files in the database 690 only show two days of content files, any suitable number of content files could be utilized depending on the number of days of EPG that are to be made available. For example, for a two-week EPG, 14 days of content files could be used. In certain embodiments the SBDB 4 can also store EPG files that are not currently scheduled for transmission.

The SBDB 4 provides functionality such as inserting files, modifying files, deleting files, and responding to queries. In some embodiments, the SBDB 4 may be a file system such as FAT or NTFS. In other embodiments, the SBDB may be a relational, hierarchical, or object-oriented database such as a Native XML database, Microsoft SQL Server, Oracle Database, or any other suitable database. The software portion of the SBDB 4 may execute on the same computer processor as the SBUI 2 or it may execute on another processor within the SB site 1. Additionally, the SBDB 4 may be an externally hosted data repository. In certain embodiments the SBDB may be an FTP server that provides an FTP interface to the SBM. The interface 7 between the SBM and the SBDB may be any suitable connection such as a network connection (e.g., a TCP/IP socket) or an API.

Figure 17:
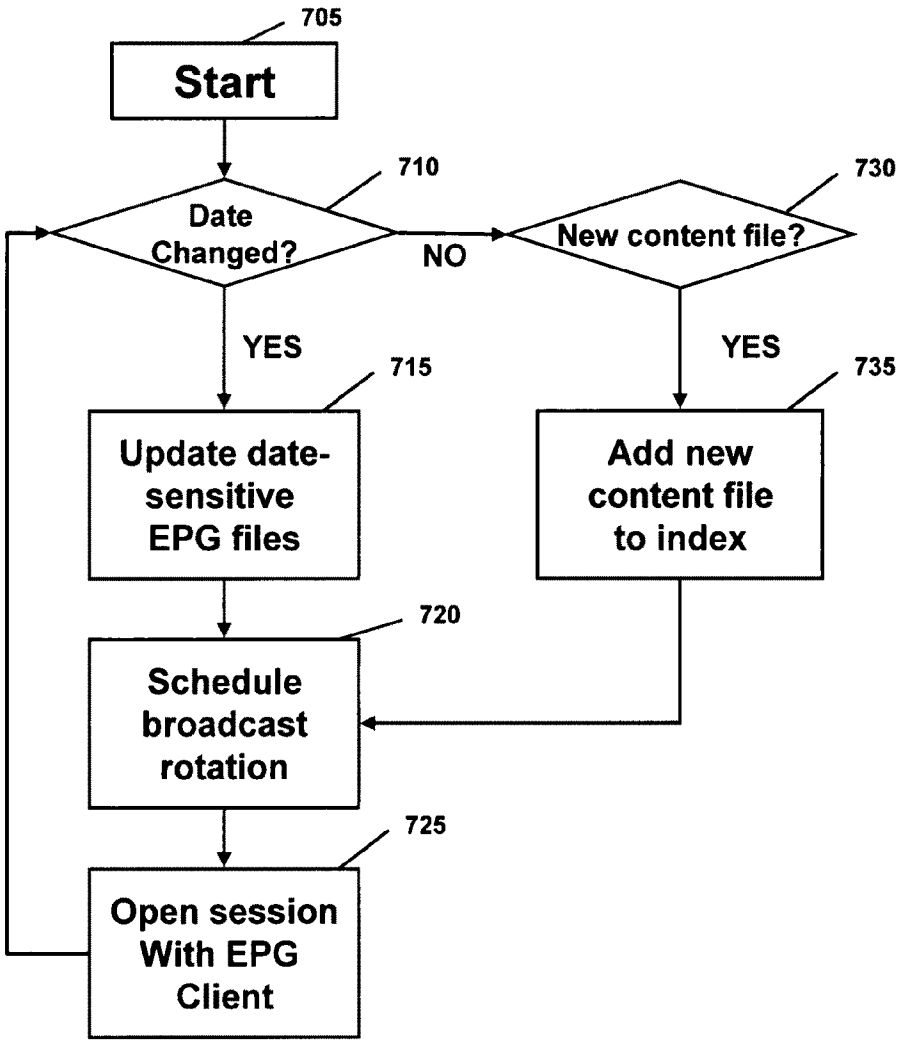
FIG. 17 illustrates a process of generating index files and scheduling content files for transmission in accordance with certain embodiments.

FIG. 17 shows an exemplary process for generating and scheduling EPG files and a transmit pattern file at the SBM 2 (FIG. 16), and transmitting EPG files and the transmit pattern file to the EPG Client. In step 705, the automatic update module 684 is triggered by an event handler to begin updating the index, content, and transmit pattern files. In some embodiments, this is triggered by an event handler that is responsive to a variety of events. For example, the event handler could include a timer set to expire at a suitable interval such as every day, every hour and/or every half hour. The event handler could also include events such as the insertion of a new content file into the SBDB 4 or the modification of a file in the SBDB 4. Additionally, the event handler could be triggered by a user input such as a refresh command.

In step 710, the automatic update module 684 determines whether a date change event has occurred. Because schedule files are typically relevant only for specific dates, it is desirable to roll over the content files each day. If a date change has occurred, then in step 715 the automatic update module 684 retrieves and parses the content files and the transmit pattern file 694 in the database 690 and the other content files in the SBDB 4 that are not currently scheduled for transmission to update the database for the date change. The bandwidth manager then schedules the broadcast rotation in step 720 by updating the content files, the index file, and the transmit pattern file 694. This updating can include removing the content files 696 that are currently associated with day 1, rotating the content files 698 that are currently associated with day 2 into day 1, and inserting new content files into day 2. The index file 692 can then be updated to reflect the new content files. Updating the index file consists of removing the entries associated with day 1, updating the entries associated with day 2 to day 1, and adding the new entries associated with day 2, and changing the version number of the index file (e.g. incrementing the version number by 1, 0.1 or any other suitable amount). Although two days of content files are discussed for exemplary purposes, any suitable number of days could be utilized depending on the number of days of EPG that are to be made available. For example, for a two-week EPG, 14 days of content files could be used.

In step 720 the bandwidth manager 686 may also prioritize the broadcast rotation to provide for efficient use of both radio station bandwidth and receiver processing resources. Prioritization may involve two principle operations. First, prioritization can involve determining the frequency (i.e., transmit pattern) at which the files in the database 690 will be repeatedly broadcast by the transmitter. In certain embodiments, the allocated station bandwidth to transport the EPG may be limited. For example, a typical radio station may only allocate between 1.5 kbps and 9 kbps of bandwidth for EPG services. Therefore it may be advantageous to maximize the transmission of content that may be considered most relevant to the end users or that is the most commercially beneficial to the SB operators. In this regard, the bandwidth manager 686 may prioritize the most current content files for more frequent transmission. For example, if there are schedule files for both day 1 and day 2, then the day 1 schedule files could be prioritized so that they would be broadcast twice for each single broadcast of the day 2 schedule files. This type of prioritization typically involves generating and/or modifying the transmit pattern file 694 using the appropriate desired broadcast ratios.

Second, prioritizing the broadcast rotation can involve determining the frequency at which certain files are spooled to the EPG Client 8. For example, in some embodiments the content files associated with day 1 will contain schedule and service information pertaining to multiple radio station clusters or markets. Assume that there are two schedule files for day 1; the first schedule file is associated with cluster A and the second schedule file is associated with cluster B. An exemplary prioritization could involve the following sequence:

a) Communicating the cluster A schedule file to the EPG Client 8;

b) Allowing the EPG Client to broadcast the cluster A schedule file for 10 minutes;

c) Communicating the cluster B schedule file to the EPG Client 8;

d) Allowing the EPG Client to broadcast the cluster A schedule file for 5 minutes;

e) Continuously repeating steps a through d.

In some embodiments, it may be advantageous for commercial reasons to broadcast certain clusters more frequently than others. For example, if the radio stations in a first cluster had a contract with the SB that specified a higher number of EPG transmissions for that cluster than the radio stations in a second cluster, then it would be advantageous to transmit the content files related to the first cluster more frequently than the content files in the second cluster. The bandwidth manager 686 may perform this prioritization by scheduling the transmission frequency, to the EPG Client, of clusters and individual stations in the database 690. For example, assume that there are three clusters that have content files to be broadcast during day 1. Assume further that the content files for each cluster would require 1.5 kbps of bandwidth to broadcast. Thus if all the content files were broadcast in parallel the total bandwidth requirement would be 4.5 kbps. Assume further that the available radio station bandwidth for EPG services is only 2 kbps. Therefore it could be advantageous to broadcast the content file for each cluster in series. To accomplish this, the content file for the first cluster in the database 690 could be communicated to the EPG Client 8, then the content file for the second cluster, and then the content file for the third cluster. If, as described above, it is desirable to broadcast the content files for the first cluster more frequently than the second cluster, the bandwidth manager 686 can transmit the content file for the first cluster more frequently than the other clusters.

In step 730, the auto update module 684 may also determine whether a new content file was added to the SBDB 4, or an existing content file was modified. If so, then in step 735 the auto update module determines whether the added or modified content file needs to be added to the database 690 (e.g. the content file is related to a day that is currently being broadcast or it is a file that is currently in the EPG Client spooler as described below). The auto update module then adds the file to the database 690. If necessary, the auto update module will also cause the replacement and/or removal of files that are currently in the EPG Client spooler and update the version number of that file (e.g., increment the version number by 1, 0.1, or any other suitable amount). Once the database has been updated, the bandwidth manager schedules the broadcast rotation (e.g. generates and/or modifies the transmit pattern) in step 720 as described above.

Figure 18:
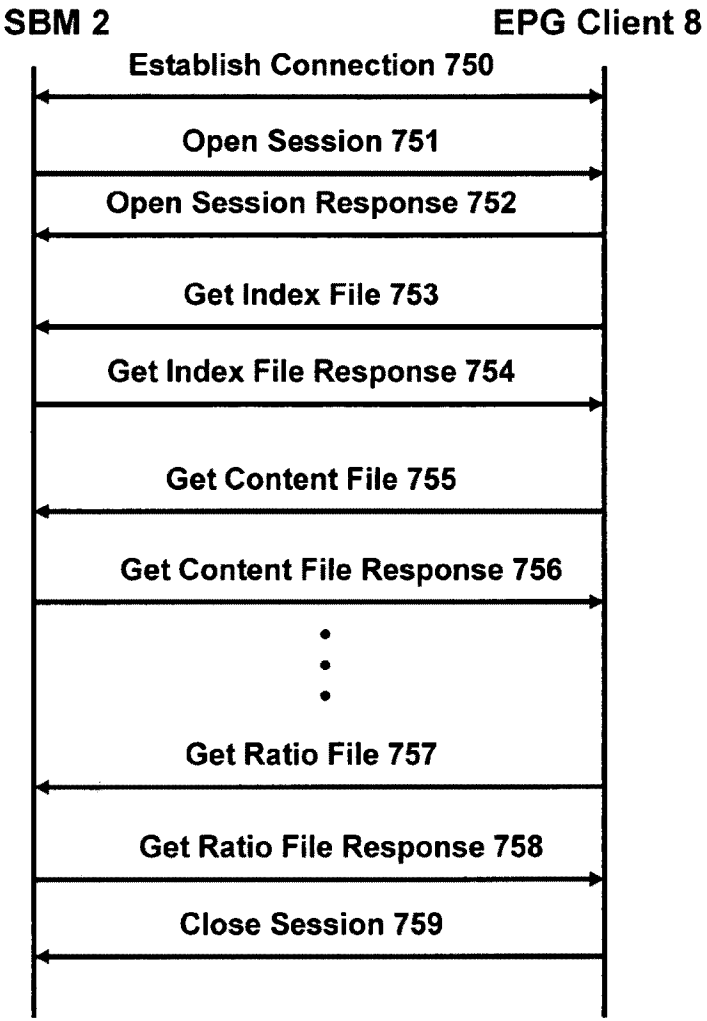
FIG. 18 illustrates a messaging sequence between a Service Bureau manager and an EPG Client in accordance with certain embodiments.

Once the bandwidth manager 686 provisions the database 690 with the desired content files and index file, the EPG Client interface 688 opens a session with the EPG Client 8 to communicate the files in step 725. FIG. 18 shows an example of the message sequencing between the SBM 2 and the EPG Client 8. The SBM 2 first establishes a TCP/IP connection 750 to the EPG Client 8. Once this connection is established, and the SBM 2 is ready to begin sending data, it sends an "Open Session" 751 message to the EPG Client 8 with its name. The EPG Client 8 may respond with an "Open Session Response" 752. At this point the EPG Client will request an index file using the "Get Index File" command 753. The SBM 2 should respond with the index file it wishes to transmit included in the "Get Index File Response" message 754. The EPG Client 8 parses the entries in this index file and determines the content files it needs to transmit. The EPG Client 8 then requests each of these files using the "Get Content File" command 755. The SBM 2 responds with the "Get Content File Response" message 756 for each file requested, which includes the requested content file. This continues until the EPG Client 8 has received all the content files for the index file. Next, the EPG Client 8 requests the bandwidth allocation ratios (e.g., the transmit pattern file 694) using the "Get Ratio File" commands 757. The SBM 2 responds with the appropriate transmit pattern file 694 using the "Get Ratio File Response" message 758. Finally, the EPG Client closes the session with a "Close Session" command 759.

Figure 19:
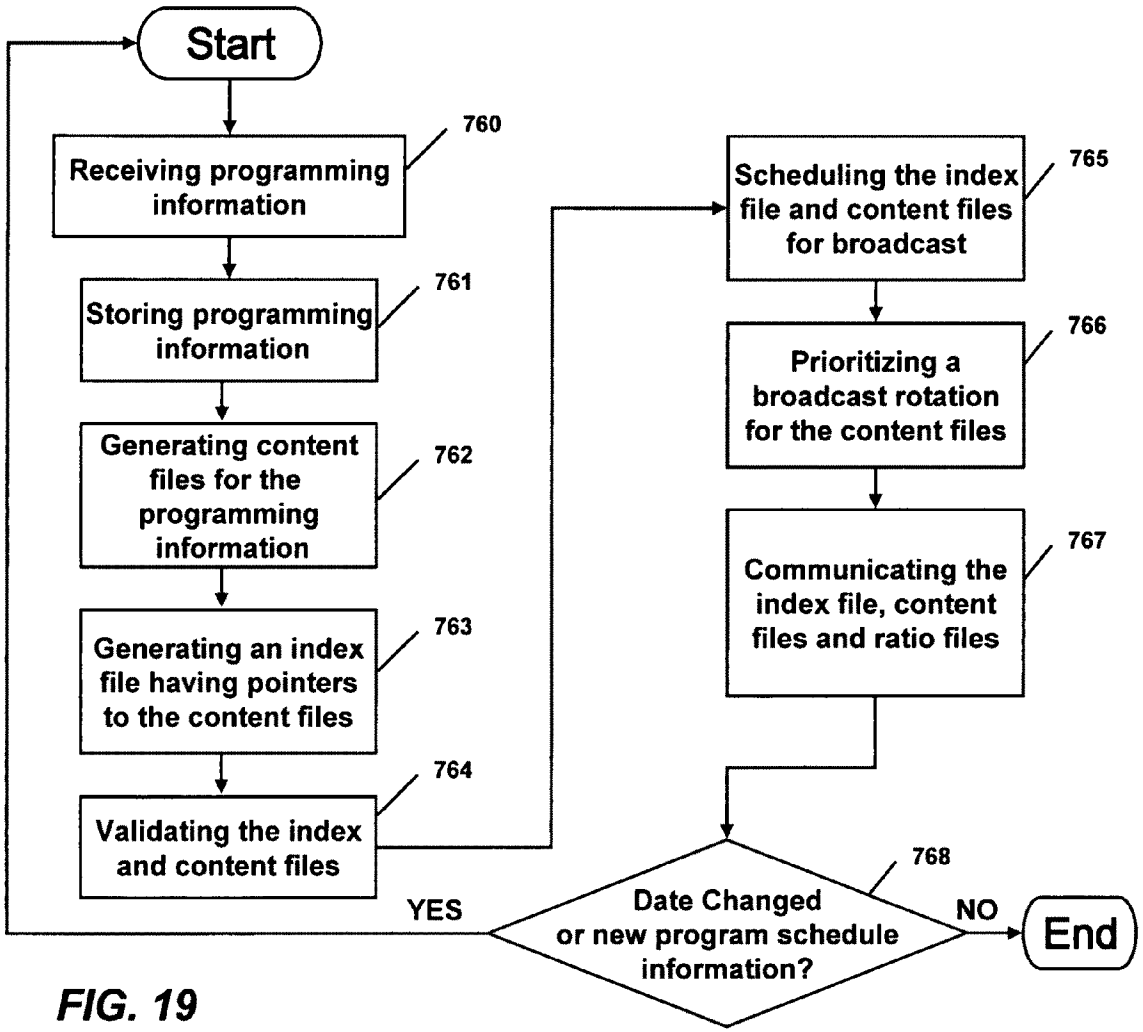
FIG. 19 illustrates an exemplary process of preparing data for broadcast via digital radio broadcast transmission in accordance with certain embodiments.

FIG. 19 illustrates an exemplary process for preparing data for broadcast via digital radio broadcast transmission. The process may be initiated by the occurrence of an event as described above. In step 760, the SBUI 3 receives programming information from one or more EPG content providers as previously described. The SBM 2 then stores the programming information in step 761 (e.g., in RAM, magnetic or optical storage) and generates content files corresponding to the programming information in step 762. In addition to programming information, the SBUI may receive transmission ratio information such as a transmit pattern file.

The content files may be formatted as described above. For example, the content files may be generated in XML format and may comprise one or a combination of service files, schedule files, and linked content files corresponding to a basic or advanced profile. The content files may be associated with specific logical addresses (e.g., a content file may be assigned to be transmitted over a specific RLS port). Also, some logical addresses may be associated with a specific date (e.g., RLS port number 3 is assigned to day 1). In certain embodiments, multiple logical addresses may be associated with different dates (e.g., RLS port number 3 is associated with day 1 and RLS port number 4 is associated with day 2). The content files also may comprise static service files. The static service files may be associated with a specific logical address (e.g., RLS port number 2 is associated with static service files). Some of the content files may be associated with a cluster of radio stations (e.g., a grouping of stations) and/or with a market of radio stations (e.g., a geographic region such as Philadelphia).

In step 763 the SBM 2 generates an index file having information identifying at least one content file, wherein the index file is associated with a logical address (e.g., the index file is assigned to be transmitted over RLS port number 1). As described above, the index file typically comprises a SB identifier, a market and/or cluster identifier, a date, a version number, and information identifying content files such as a list of the content file names or binary encoded data that can be used to generate a list of content file names. The list of content file names could comprise the file names and a logical address associated with each file name. The index file may also be generated in XML. In some embodiments the SBM 2 may validate the XML index and/or content files against an XML schema as described above in step 764.

Next, in step 765 the SBM 2 schedules the content files and the index file for broadcast via digital radio broadcast transmission. Scheduling typically includes provisioning the appropriate index files and content files in the database 690 for transmission (e.g., storing the content files for day 1 in the day 1 storage area of the database etc.). In some embodiments service files and static-service files may be scheduled to be broadcast less frequently than schedule files in order to maximize bandwidth usage in light of the relatively static nature of service files.

In some embodiments the SBM 2 prioritizes a broadcast rotation for the content files in step 766. As described above, this can include one or a combination of determining the frequency at which the files in the database 690 will be repeatedly broadcast by the transmitter (e.g. generating and/or modifying a transmit pattern file) and/or determining the frequency at which certain files in the database 690 are communicated to the EPG Client 8.

Next, in step 767 the EPG Client interface 688 communicates with the EPG Client 8 to transmit the index file and content files for broadcast via digital radio broadcast transmission. In certain embodiments, the EPG Client interface 688 may also communicate transmission ratio information such as a transmit pattern file. Finally, in step 768 the SBM 2 determines whether another event has occurred such as a new day or new program schedule and/or service information has been received. If so, the process is restarted; otherwise it is terminated.

Figure 20:
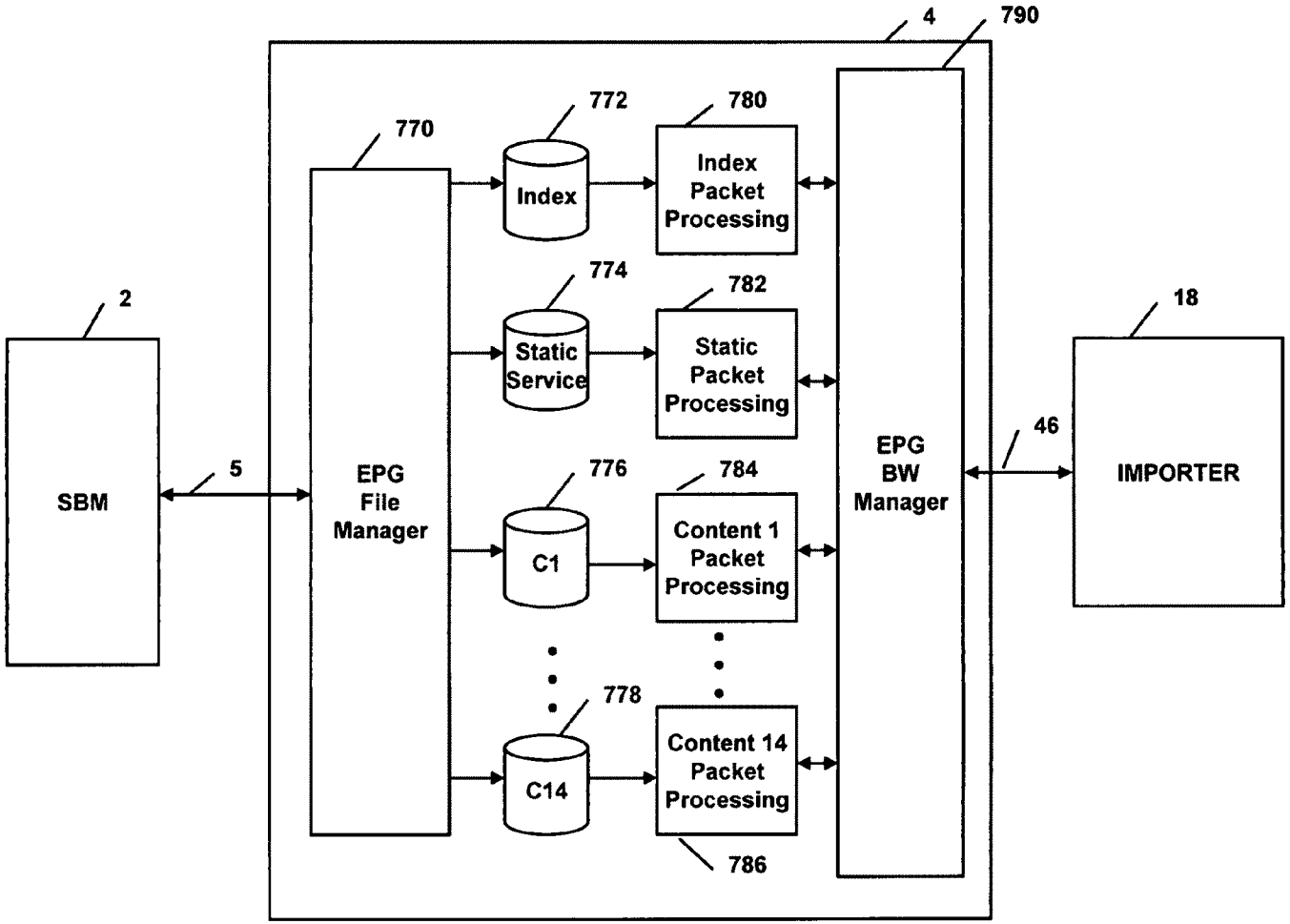
FIG. 20 illustrates an exemplary EPG client in accordance with certain embodiments.

FIG. 20 illustrates the components of an exemplary EPG Client 4. The EPG Client 4 comprises a number of functional modules including an EPG file manager 770, memory locations 772, 774, 776, and 778, packet processing clients 780, 782, 784, and 786, and the EPG bandwidth manager 790 (the memory locations, packet processing clients, and EPG bandwidth manager collectively may be referred to herein as the EPG Client spooler). The EPG file manager 770 communicates with the SBM 2 to retrieve index files, content files, and transmit pattern files. It then parses the files to determine their type (e.g., index, content, or static). In certain embodiments, upon receipt of files from the SBM 2, the EPG file manager 770 may validate files received in XML format and convert them to binary format. The validation of XML files may be performed against XML schema as described above. Index files and content files received in any other format, such as CSV, could also be converted to binary. The conversion of the files to binary may utilize a TLV scheme or any other suitable scheme as previously described.

Once the files have been parsed and encoded, the EPG file manager 770 then stores them in appropriate memory locations. For example, the index file is stored in the index file memory locations 772, static-service files are stored in the static-service file memory locations 774, content files for day 1 through 14 are stored in the content day 1 through content day 14 memory locations 776, 778. The memory locations could be database entries, entries in a file system, or any other suitable storage location and could be stored in any suitable hardware such as optical or magnetic storage.

The packet processing clients then retrieve the files from the corresponding memory locations, segment and packetize the files, and forward them to the EPG bandwidth manager. Each packet processing client retrieves data from its associated memory location. For example, the index packet processing client 780 retrieves data from the index file memory location 772; the static packet processing client 782 retrieves data from the static memory location 774; and the content 1 to content 14 packet processing clients retrieve data from the content day 1 to content day 14 memory locations respectively.

As described above, the RLS can operate in both a packet mode and a byte-streaming mode. In packet mode, each EPG file may be associated with a different RLS port. Thus the index file would be associated with a first RLS port, the static-service file with a second RLS port, and the content day 1 through content day 14 files would be associated with a third through sixteenth RLS port respectively. Alternatively, in some embodiments, some or all of the EPG files may be associated with the same RLS port. Additionally, in some aspects all of the EPG files may be combined in a single long header message. This alternative configuration could be useful in reducing the total bandwidth required to transmit the EPG in some implementations.

In certain embodiments, each RLS port can be assigned a desired percentage of the total bandwidth allocated to the EPG based on the file broadcast frequencies in the transmit pattern file. Typically the index file will be broadcast in each PDU and will therefore not have a desired percentage. However, in some embodiments it could be assigned a high desired percentage rather than being broadcast in each PDU. In certain embodiments, the packet processing clients will segment the packets, using LOT protocol, according to the packet size limitations enforced by the importer for AAS data.

Figure 21:
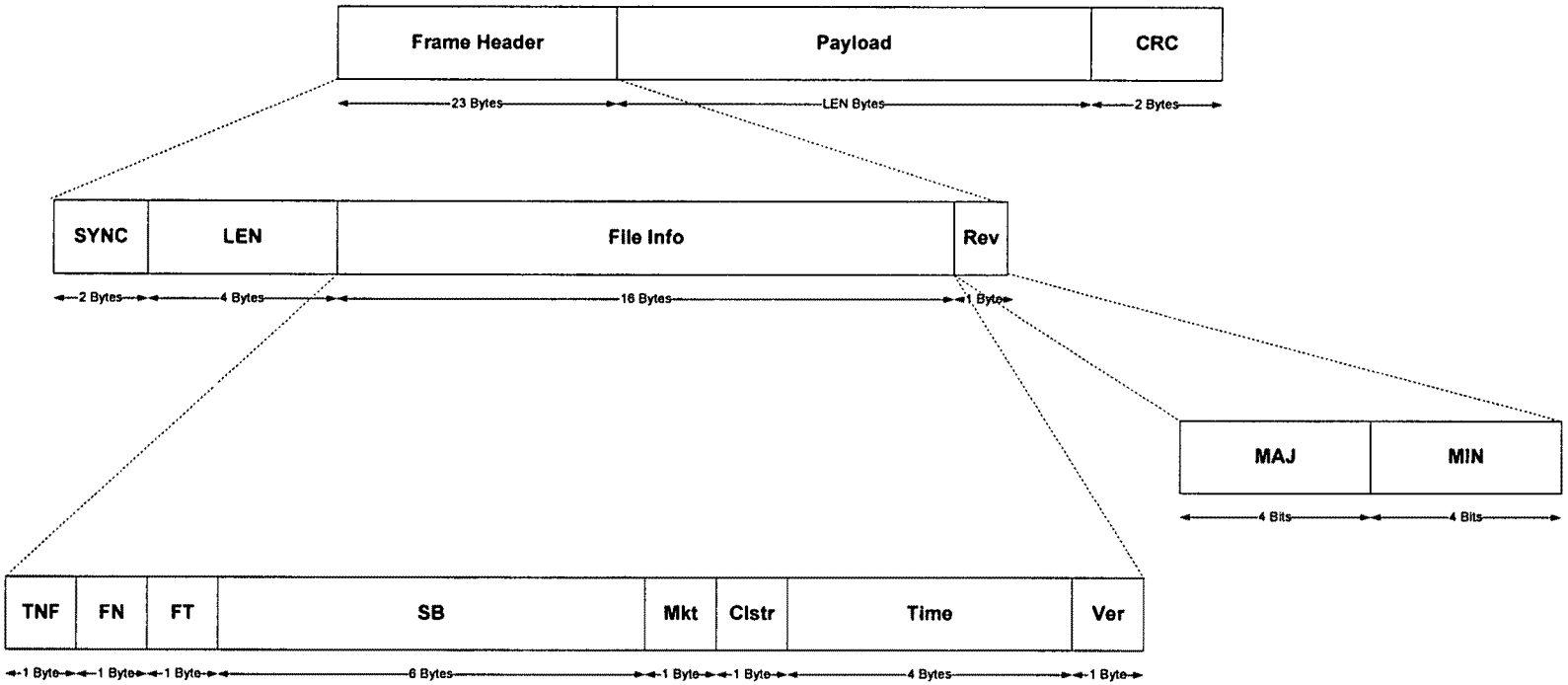
FIG. 21 illustrates an exemplary packet encapsulation protocol in accordance with certain embodiments.

In byte-streaming mode the packet processing clients may provide a simple framing protocol for encapsulating the EPG files. In certain embodiments, based on the ratio files (e.g., static-to-schedule, and day-to-day) each type of file (e.g., index, static, content day 1, content day 14) can be assigned a desired percentage of the total bandwidth allocated to the EPG. Typically the index file will be assigned a high desired percentage so that it is broadcast more frequently than the content files. In this mode, the packet processing clients need not segment the files because they will be segmented by the importer 18 as previously described. An exemplary framing protocol is illustrated in FIG. 21. This framing protocol includes a frame header, the payload, and a CRC. The frame header includes a SYNC field as a frame delimiter, a LEN field for the payload length in bytes, a multi-part File Info field, and a Rev field for the framing protocol revision number. The File Info field includes a TNF field for the total number of files in the EPG, a FN for the file number of the current file, an FT field for the file type (e.g., index file, content file), SB for the SB identifier, Mkt for a market identifier, Clstr for a cluster identifier, Time for packet time, and Ver for the current version of the EPG. Thus in byte-streaming mode, for example, the index packet processing client 780 retrieves the index file from the index file memory location and encapsulates it using the simple framing protocol.

Once the packets are generated, they are forwarded to the EPG bandwidth manager 790. The EPG bandwidth manager 790 is responsible for the interface to the importer and properly managing the total bandwidth allocated to the EPG client 4. This is accomplished by transmitting packets to the importer whenever it requests data (the importer typically utilizes an asynchronous data transfer method). If the response from a single packet is not large enough to fill the allocated bandwidth, the importer will typically immediately request additional packets. The EPG bandwidth manager 790 assures that these packets are available when requested to maintain full bandwidth utilization. In operation, the EPG bandwidth manager 790 interleaves the various packets and transmits them to the importer according to the desired broadcast rotation. To perform this task, the EPG bandwidth manager 790 may operate according to an efficient scheduling algorithm. The scheduling algorithm may operate differently between packet mode implementations and byte-streaming mode implementations. In packet mode, the scheduling algorithm may be statistical in nature and may use one or more of the following metrics to maintain proper broadcast ratios between the various EPG files:

1) Number of packets per PDU;
2) RLS Port bandwidth allocations; and
3) Relative bandwidth usage error among the ports.

Input into the algorithm is a specification of which ports are active and what percentage of available bandwidth should be allocated to each active port. The algorithm tracks how much bandwidth has been used for each port's files. When the importer requests data, the algorithm selects the port with the largest bandwidth usage error for transmission and then updates its bandwidth usage statistics for the next request. The relative bandwidth usage error for each port may be computed as follows:

$$\varepsilon = \frac{P_D - P_M}{P_D}$$

where $P_D$=the desired percentage and $P_M$=the measured percentage.

An appropriate scheduling algorithm for a 16 port implementation in pseudo-code could be:

```
function [portNum] = epgBW(count)
%
% ==== Values Externally Specified before algorithm is run ====
%
global activePorts
global Nls
%
%==== Global Variables =====
%
global portStats % maintains measured statics for each port
global packetCount % Total number of file packets sent
packetCount = packetCount + 1;
%
%===== Compute Error Metric =====
%
errorMax = -100;
port = 16;
for i = 0:15
   j = i+1;
   if activePorts(j) ~= 0
      portError = (activePorts(j)- (portStats(j)/fragCount) )/activePorts(j);
         if portError > errorMax
            port = i;
            errorMax = portError;
         end
   end
end
 if port ~= 16
    portStats(port+1) = portStats(port+1) + 1;
    portNum = port;
 else
    portNum = -1;
       end
```

In byte-streaming mode, the algorithm would be similar. However, the desired percentage and measured percentage would be based on the type of file (e.g., index, static, content day 1, content day 14) rather than the RLS port.

Figure 22:
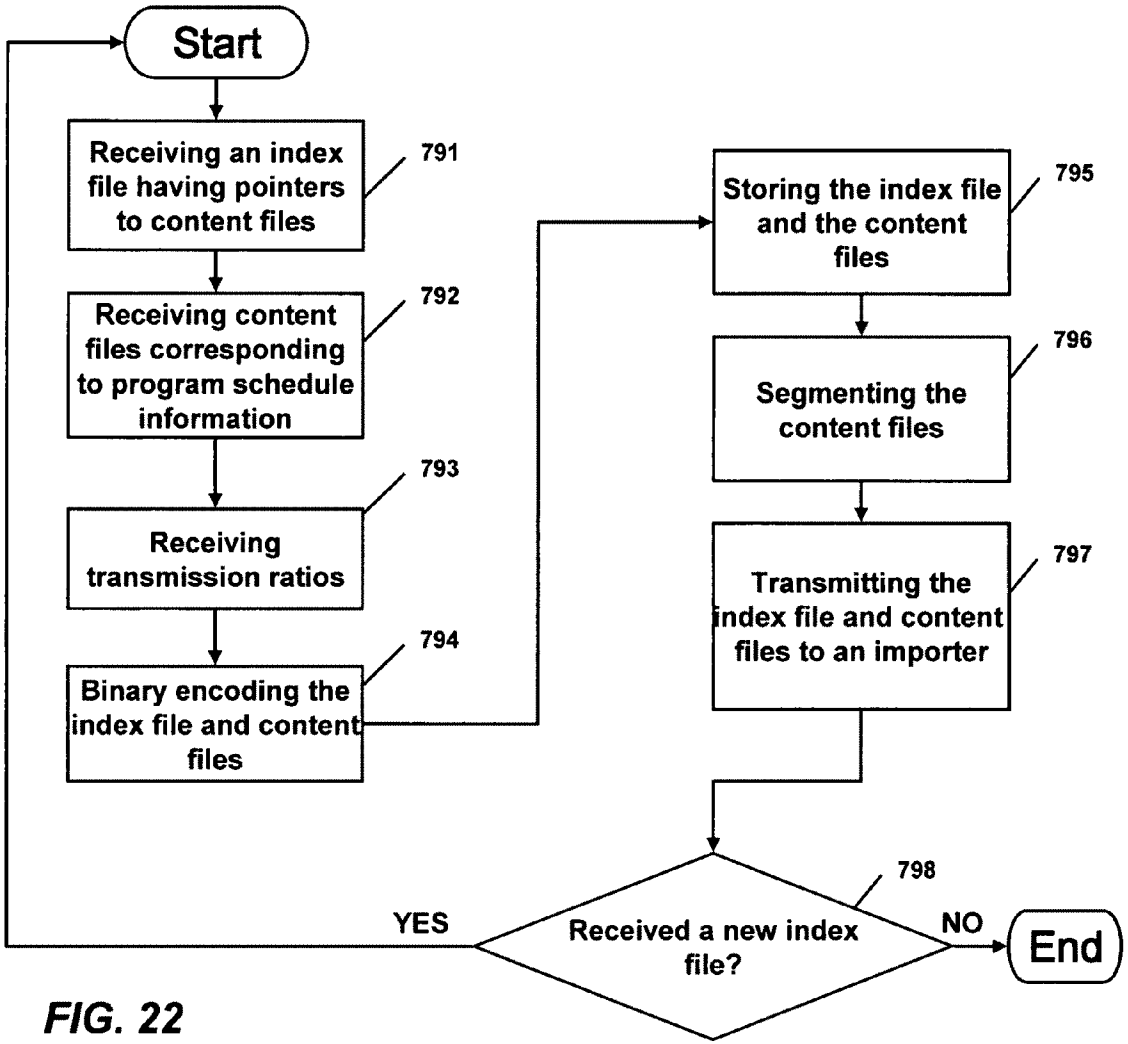
FIG. 22 illustrates an exemplary process of preparing data for broadcast via digital radio transmission in accordance with certain embodiments.

FIG. 22 illustrates an exemplary process for preparing data for broadcast via digital radio broadcast transmission. The process may be initiated by the SB initiating a communication session with the EPG Client 8. In step 791, the EPG file manager 770 receives an index file having information identifying at least one content file, wherein the index file is associated with a first logical address (e.g., the index file is assigned to be transmitted over RLS port number 1). As described above, the index file may comprise a SB identifier, a market and/or cluster identifier, a date, a version number, and information identifying content files such as a list of the content file names or binary encoded data that can be used to generate a list of content file names. The list of content file names could comprise the file names and a logical address associated with each file name. In some embodiments, the index file may be in XML.

In step 792, the EPG file manager 770 receives content files corresponding to programming information for program content to be broadcast. The content files may be formatted as described above. For example, the content files may be in XML format and may comprise one or a combination of service files, schedule files, and linked content files corresponding to a basic or advanced profile. The content files may be associated with specific logical addresses (e.g., a content file may be assigned to be transmitted over a specific RLS port). Also, some logical addresses may be associated with a specific date (e.g., RLS port number 3 is assigned to day 1). In certain embodiments, multiple logical addresses may be associated with different dates (e.g., RLS port number 3 is associated with day 1 and RLS port number 4 is associated with day 2). The content files also may comprise static service files. The static service files may be associated with a specific logical address (e.g., RLS port number 2 is associated with static service files). Some of the content files may be associated with a cluster of radio stations (e.g., a grouping of stations) and/or with a market of radio stations (e.g., a geographic region such as Philadelphia).

In some embodiments, the EPG file manager 770 may also perform one or more of the following steps. In step 793 the EPG file manager 770 may receive a transmit pattern file that specifies file broadcast frequencies (i.e. information specifying the desired frequency at which specific files will be transmitted to the importer 18). This file may have been generated using one or a combination of a schedule-file-to-static-file transmission ratio and/or first-date-to-second-date transmission ratios. In step 794 the EPG file manager 770 may binary encode the index file and the content files.

In step 795 the EPG file manager stores the index file and the content files in their associated storage locations as described above. For example, the index file is stored in the index file memory locations 772, static-service files are stored in the static-service file memory locations 774, content files for day 1 through 14 are stored in the content day 1 through content day 14 memory locations 776, 778.

Next, in step 796 the packet processing clients 780, 782, 784, and 786, and/or the importer 18 may segment the content files for bandwidth management purposes. In certain embodiments the content files may be segmented in a packet streaming mode or a byte-streaming mode as described above.

In step 797, the EPG bandwidth manager transmits the index file and the plurality of content files to the importer in accordance with a broadcast rotation. In the broadcast rotation, the index file is typically scheduled for repeated transmission intermittently relative to the content files. For example, the index file may be transmitted first, then a first content file, then the index file again, then a second content file, etc. The broadcast rotation may be set according to the file broadcast frequencies specified in the transmit pattern file. In some embodiments the index file and content files may be transmitted to the importer asynchronously (i.e. upon the importer's request).

Finally, in step 798 the EPG Client 8 determines whether it has received another index file. If so, the process is restarted; otherwise it is terminated.

Once the importer receives the packets, they are processed as AAS data and broadcast over-the-air as discussed above. A receiver then receives the packets and processes them to construct an EPG that can be rendered for an end user. Advantageously, a receiver may be able to receive programming information regarding stations that broadcast only in legacy analog waveform and otherwise have no digital or other means of conveying their program schedule. While the receiver is described below as receiving EPG data from a single SB, it is contemplated that it may receive EPG data from multiple SBs. In these embodiments, each SB may provide its own unique index file and content files.

Figure 23A:
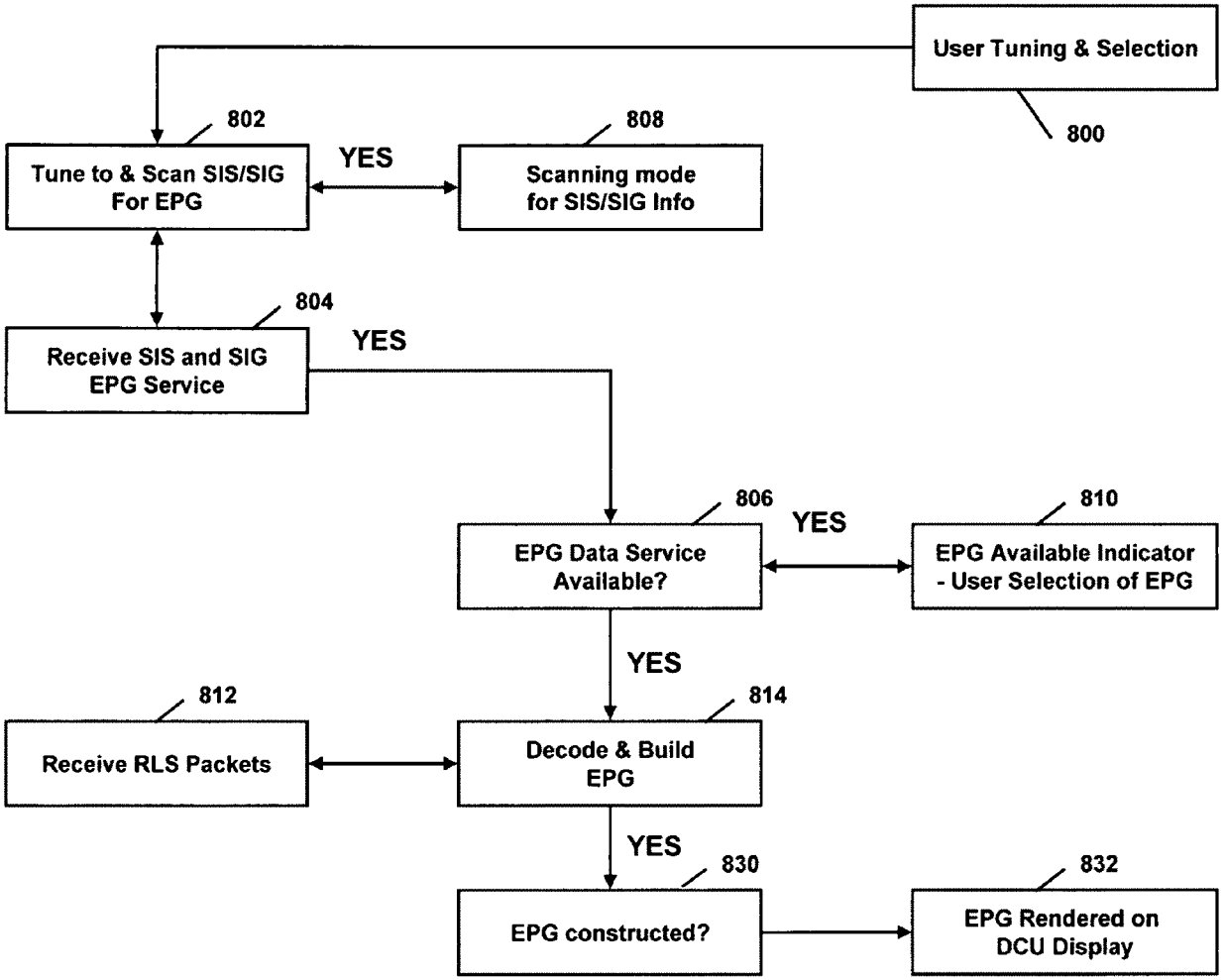
FIGS. 23*a* and 23*b* illustrate a process of receiving and transmitting EPG data in accordance with certain embodiments.
Figure 23B:
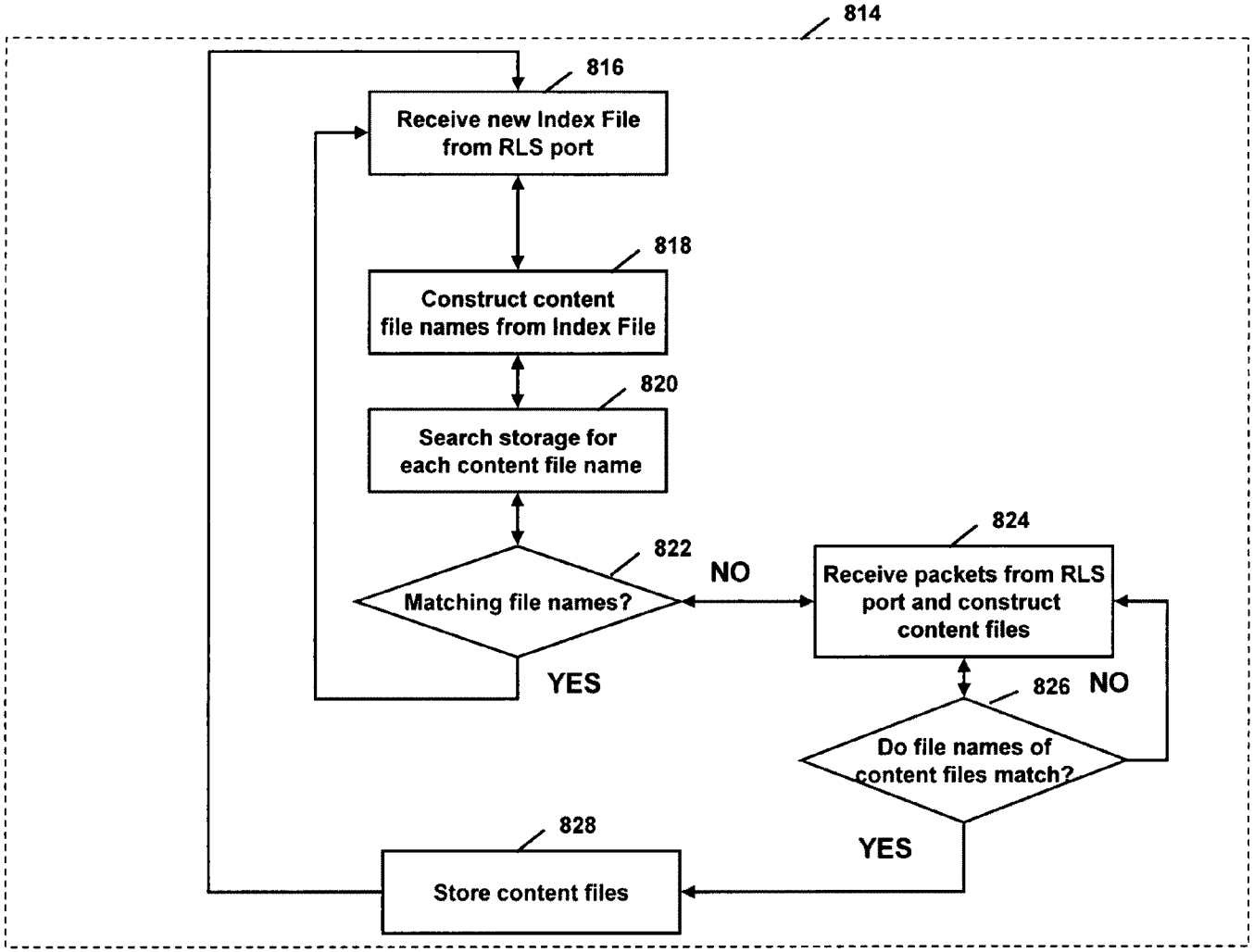

An exemplary process of receiving, processing, and rendering the EPG data is shown in FIGS. 23*a* and 23*b*. Referring to FIG. 23*a*, in step 800, the user powers on the receiver and then tunes the receiver to a desired radio station in step 802. On power-up, the host controller 240, 296 (shown in FIGS. 7 and 8 respectively) begins to repeatedly request various types of data (e.g., SIS, SIG, and LOT segments) from the signal processing block 201, 251. In step 804, the signal processing block 201, 251 receives the SIS and SIG, decodes them, and communicates them to the host controller in response to a request from the host controller 240, 296. In step 806 the host controller 240, 296 parses the SIS and SIG to determine whether the station is broadcasting an EPG. This indication will typically include a MIME type indicator that identifies EPG service. If EPG service is available on a particular station, the SIG will also indicate the RLS port number on which the associated index file can be received.

In step 808, the user may optionally select a scanning mode that causes the host controller to operate the receiver in order to tune to a number of available radio stations and search on each for an indication that EPG service is available. These indications may then be stored by the host controller to generate a list of stations with EPG service. For example, during scanning the host controller 240, 296 may use SIS data to retrieve the least significant bits of a MIME hash identifying the EPG service (e.g., the least significant 12-bits of a 32-bit MIME hash). If a partial match to an EPG service MIME hash is found, the host controller may retrieve SIG data that contains the full MIME hash value (e.g., the full 32-bit MIME hash). In some embodiments, the host controller may rely upon the SIG data without regard for the SIS data. If a complete match is found, the scan may be stopped and EPG processing may begin, or the station may be stored and scanning continued.

In step 810, the host controller causes the DCU to display an indication to the user that EPG service is available. This could be in the form of a lighted "EPG Available" button or an icon on a GUI. In certain embodiments, the user may be able to choose whether to download the EPG at this point. In some cases in which more than one EPG is available, the user may be presented with a dialog box or other prompt that allows them to select from the available EPGs. For example, this might be the case if EPGs are available for different markets, clusters (e.g., groups of stations) or individual stations. The user can then select an EPG, e.g., by pressing a suitable button, which can be for example, either a physical button on the receiver or a soft key button on a GUI. In certain embodiments, the host controller may automatically begin retrieving an available EPG without requiring user input.

While the receiver 200, 250 is tuned to a particular radio station, the signal processing block 250, 251 is continuously receiving and buffering RLS packets (shown as step 812) that are broadcast from the radio station. In embodiments directed to packet-mode transmission using LOT protocol, the data processor 232, 288 may also be reassembling the packets into objects. These objects are then passed to the host controller 240, 296 responsive to a request (e.g. a polling event). Alternatively, packets could be passed to the host controller 240, 296, which could then reassemble them into objects. Additionally, in embodiments directed to byte-streaming data transmission, the packets could be reassembled in either the data processor 232, 288 or the host controller 240, 296 according to the simple framing protocol described above.

The host controller 240, 296 decodes and builds the EPG in step 814 from objects or packets received from the signal processing block 201, 251 in response to a request. The host controller 240, 296 first searches on the RLS port indicated in the SIG for a new index file. While searching on the RLS port, the host controller 240, 296 decodes objects or packets corresponding to the index file if they are binary encoded, and stores them in memory module 244, 296. Referring to FIG. 23*b*, the host controller receives a complete new index file in step 816.

Once the host controller receives the index file, it then decodes the information identifying the associated content files (e.g., content file names) contained in the index file in step 818. In step 820, the host controller searches memory for each content file name from the index file. In step 822, if the content file name is found in memory, then no further processing is necessary for that content file. If the content file name is not found in memory in step 822, the host controller will create a list of missing content files comprised of the file names that are not found in memory. The host controller then continues to listen on the appropriate RLS port or ports to receive objects or packets, and constructs content files in step 824 to obtain the missing content files. Advantageously, in some embodiments in which the content files are associated with specific RLS ports and days, the host controller may disregard unwanted content files (e.g., if the host controller is only implementing a 7-day EPG, then it would ignore the RLS ports containing EPG data for days 8-14). The file name of each content file that is constructed is checked against the list of missing files in step 826. Newly constructed files that are on the missing file list are then stored in memory in step 828.

The process of constructing and storing the content files may vary depending on the implementation. For example, different receivers have different input, display, and memory capabilities. Some typical receiver's displays may include 4 line by 16 character LED or LCD displays, 2 line by 16 character LED or LCD displays, 256 color OEL displays, multi-line back lit LCD displays with 6" or larger multimedia displays, and portable radio back lit LCD displays. Generally the receivers with more advanced displays have more available memory. Simpler receivers may only have a small amount of RAM (e.g., less than 50 Kbytes) while more advanced receivers may have a larger amount of RAM (e.g., 100 Kbytes or more) as well as non-volatile memory such as Flash ROM (e.g., built-in Flash, a hard disk drive, and/or a SD® Memory Card). Advantageously, exemplary embodiments of the present disclosure provide adaptable EPG rendering based on the capabilities of the receiver as described below.

The content files and the index files may be stored in any suitable memory structure. For example, a file system could be used such as NTFS or Journaling Flash File System version 2 (JFFS2). Alternatively, the files could be stored in a database such as SQLite or MySQL. Naturally, the memory structure utilized should be consistent with the memory capabilities of the receiver. Thus more capable receivers could have more complex memory structures. In some embodiments the content files and index files may be stored in non-volatile memory. In these cases, the EPG data may be available immediately upon power-up without requiring the download of any new index or content files.

Figure 24:
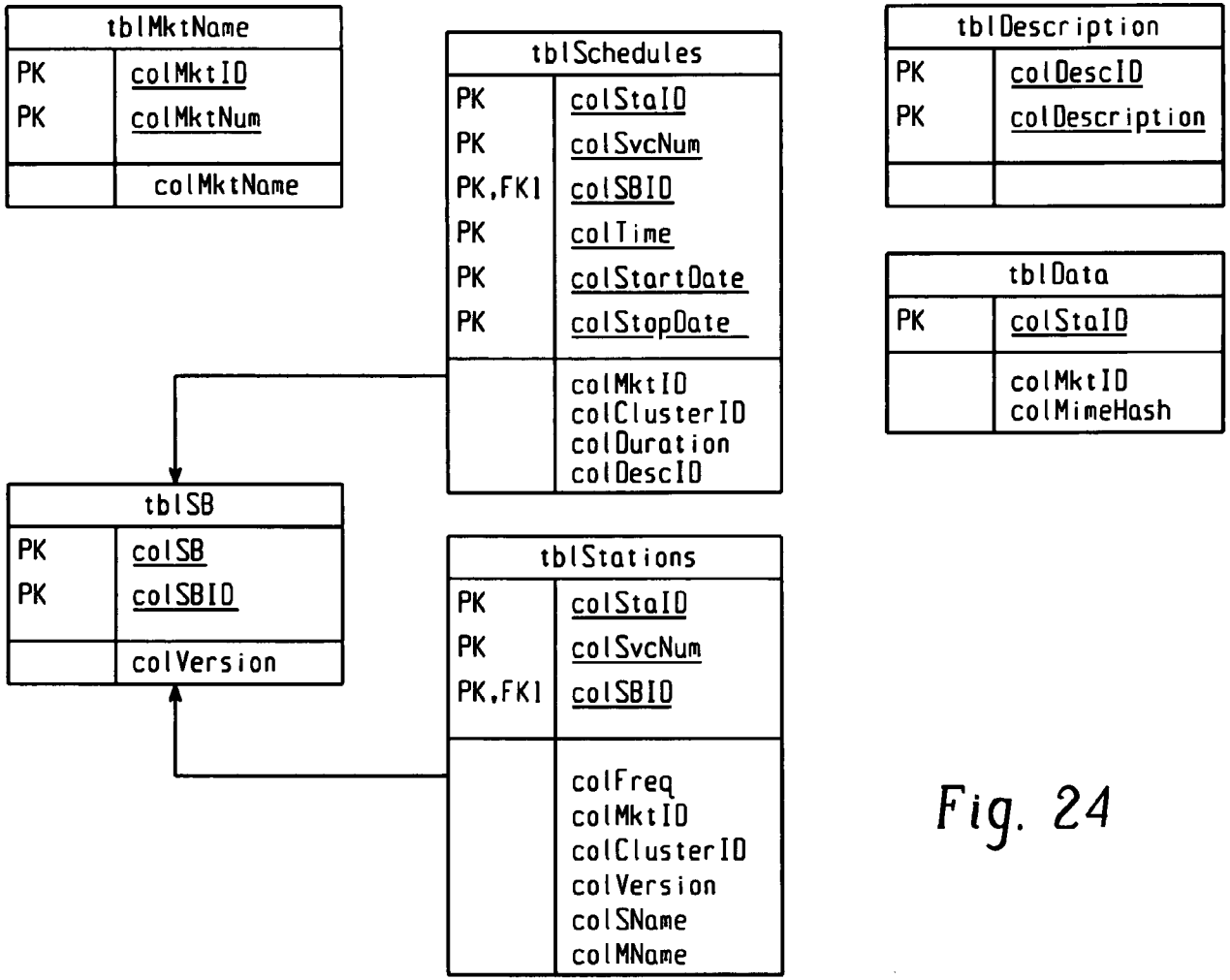
FIG. 24 illustrates an exemplary receiver EPG database in accordance with certain embodiments.

FIG. 24 illustrates an exemplary relational database structure for storing EPG content. As shown, the exemplary database includes a table for market data (tblMktName), a table for SB data (tblSB), a table for schedule information (tblSchedules), a table for service information (tblStations), a table for description information (tblDescription), and a linking table for relating station data to market data (tblData). The market table contains the following exemplary fields:

1) colMktID—an integer field that may auto-increment each time a unique record is inserted to the table.

2) colMktNum—a character field containing the marketID attribute of the market element found in the index file.

3) colMktName—a character field containing a description of the marketID attribute (e.g. "Philadelphia").

The SB table contains the following exemplary fields:

1) colSB—a character field containing the SB identifier.

2) colSBID—an integer field that auto-increments each time a unique record is inserted to the table.

3) colVersion—a byte value corresponding to the current index file version field.

In embodiments wherein a market contains more than one SB, the user may be allowed to display an EPG based on a selected SB. To allow display based of a selected SB, the stations table and schedules table may contain foreign keys (FK) to the colSBID primary key (PK).

The stations table contains the following exemplary fields:

1) colStaID—an integer field consisting of the FCC ID and the country code.

2) colSvcNum—an integer field equal to the audio service number.

3) colSBID—an integer field corresponding to the SB.

4) colFreq—an integer corresponding to the station frequency in kilohertz.

5) colMktID—an integer field corresponding to the station's market.

6) colClusterID—an integer field corresponding the station's market cluster.

7) colVersion—an integer corresponding the current service file version.

8) colSName—a character field corresponding to the short name description of the station (e.g., the station's call sign).

9) colMName—a character field corresponding to the medium name description of the station.

The schedules table contains the following exemplary fields:

1) colStaID—an integer field consisting of the FCC ID and the country code.

2) colSvcNum—an integer field equal to the audio service number.

3) colSBID—an integer field corresponding to the SB.

4) colTime—an integer field corresponding to the start time of the program. For example, the most significant byte may be the UTC flag, followed by a one byte "hours" value, a one byte "minutes" value, and a one byte "seconds" value.

5) colStartDate—an integer field corresponding the earliest calendar date the program is valid. For example, it may comprise a one byte "year" value, a one byte "month" value, and a one byte "day" value.

6) colStopDate—an integer corresponding to the latest calendar date this program is valid.

7) colMktID—an integer field corresponding to the station's market.

8) colClusterID—an integer field corresponding the station's market cluster.

9) colDuration—an integer field corresponding to the duration of the program. For example, it may comprise a one byte "hours" value, a one byte "minutes" value, and a one byte "seconds" value.

10) colDescID—an integer value corresponding to a unique record in the description table.

The description table contains the following exemplary fields:

1) colDescID—an integer field that auto-increments each time a unique record is inserted to the table.

2) colDescription—a character field containing the scheduled program's medium name.

The data table contains the following exemplary fields:

1) colStaID—an integer field consisting of the FCC ID and the country code.

2) colMktID—an integer field corresponding to the station's market.

3) colMimeHash—an integer field corresponding to the data service MIME hash value.

In an exemplary embodiment employing the relational database structure of FIG. 24, the process of storing an index file and the content files could include the following steps. First, the host controller 240, 296 receives the index file and parses it to determine the SB, market, date, version number, and cluster associated with the index file. The host controller 240, 296 then populates the market table and the SB table with this data. The host controller 240, 296 then receives a service or schedule file described by the index file. For service files, the host controller 240, 296 inserts a new entry in the stations table. For schedule files, the host controller 240, 296 inserts a new entry in the schedules table. In some embodiments wherein the index file contains a content file reuse indicator associated with certain schedule files (e.g., an "alternateDate" element), the colStartDate and colStopDate fields may be updated to reflect the number of days for which the associated EPG content will be valid. For example, assume that the current date is Jan. 5, 2009 and that the "alternateDate" element indicated that a schedule file was relevant for the current day and the following two days. In this case, the colStartDate could contain Jan. 7, 2009 and the colStopDate could contain Jan. 3, 2009.

In certain embodiments that include both basic and advanced profile content files, the corresponding profiles can be merged to produce a single content file. For example, continuing the example utilizing the database of FIG. 24, the host controller 240, 296 could retrieve a first service file corresponding to a station on 95.7 FM that contains basic profile information (e.g., FCC ID, frequency, call sign and medium name) and create a corresponding database entry in the stations table. Next, the host controller 240, 296 could retrieve a second service file corresponding to the station on 95.7 FM that contains advanced profile information (e.g., a WBEN graphical logo) and insert this information into the same database entry used for the basic profile information. Thus the database entry for the station on 95.7 FM would have both basic profile information and advanced profile information.

At times, the index file and content files for a particular SB may be associated with an outdated version. This could occur, for example, at the beginning of a new day or when a content file is modified at the SB. In these cases, the SB would update the index file, including adding a new version number, and the schedule the new index file for broadcast as described above. To address this, the host controller may be programmed to check the version number of a newly received index file against the version number of a currently stored index file. If the version number of the current index file is outdated (e.g., not the same as the newly received index file or older than the newly received index file), the host controller will replace the current index file with the new one and begin receiving and updating the content files.

Once the index file and a suitable number of content files have been stored in memory, the EPG is constructed in step 830. In certain embodiments, a suitable number of content files could be one, some, most, or all of the content files listed in the index file. Constructing the EPG consists of retrieving and formatting the data for the programming information that is contained in the content files so that it can be rendered on the display. The EPG application in the receiver will first determine the relevant time by checking the system clock. In some embodiments, it then will query the database to find schedule entries having relevant start and stop times. In certain embodiments, the EPG application may examine the stored index file to determine which schedule files have relevant start and stop times. The relevant programming information is then used to populate the on-screen EPG, for example in a program grid format.

The way the EPG is constructed may depend on the receiver characteristics (e.g., display or memory capabilities) and/or according to user choice. For example, a simple embedded receiver may only receive and display a simple text-based basic profile while a more capable receiver may display a more advanced profile containing, for example, graphics and logo references and long descriptions. Once the programming information has been formatted for the display, it can then be rendered by the DCU 242, 298 in step 832. Additionally, in embodiments including linked content files, the files in the linked content group may be formatted in such a manner that they will be rendered together. For example, when the programming information for the "Morning Show" is displayed, it could include a link or reference (e.g. a hyperlink or a popup) to other talk shows in the schedule files. In some embodiments filtering programming information may be performed according to the end user's choice. Advantageously, the displayed data may be reduced, for example, from a comprehensive level (e.g. full program descriptions) to program type only, upon the end user's selection and irrespective of the display's further capabilities.

In certain embodiments, content may be selected (e.g., user defined) for triggering other processes inside or outside the receiver. For example, this may provide the capability to start recording a certain program at a certain time when it is to be broadcast to trigger a reminder alarm (e.g., audio and/or visual indicator) when a certain program is scheduled to start. A recording capability could comprise an input dialog box that allows a user to select a future program or data service displayed on the EPG. When the content associated with the selected a program or data service is selected, a trigger for a recording function would then store the broadcasted program in memory for future playback. Further examples of providing VCR-like recording functions for radio content are described in U.S. Patent Application Publication No. 2004-0062526A1, which is incorporated in its entirety herein by reference.

Figure 25:
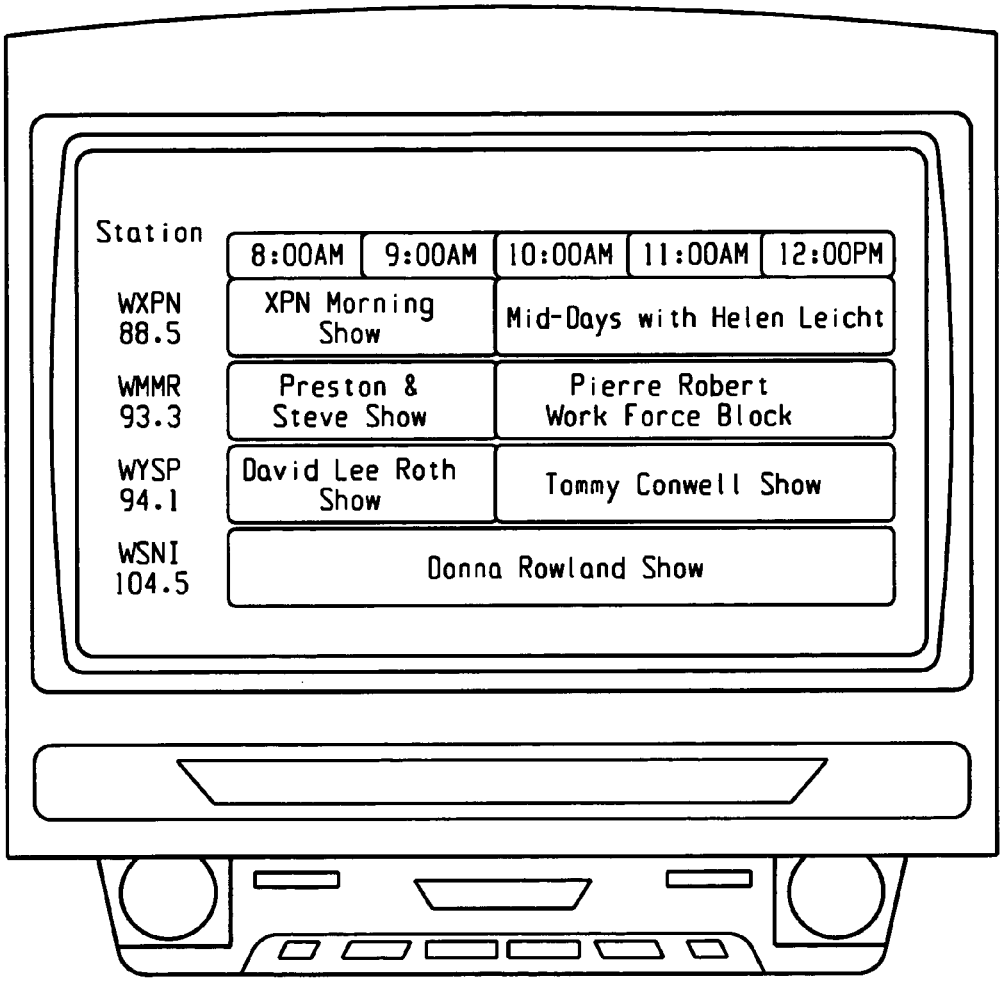
FIG. 25 illustrates an exemplary EPG shown on a display in accordance with certain embodiments.

At this point, the user can view the programming information and perform other related functions. An exemplary EPG display on a GUI is shown in FIG. 25. As illustrated, the EPG display contains a grid having the radio market displayed across the top ("Philadelphia"), below which are various times. On the left side are the various stations that have available EPG schedule and service information (WXPN 88.5, WMMR 93.3F, WYSP 94.1, and WSNI 104.5). In the grid are the various shows that are available at various times.

Figure 26:
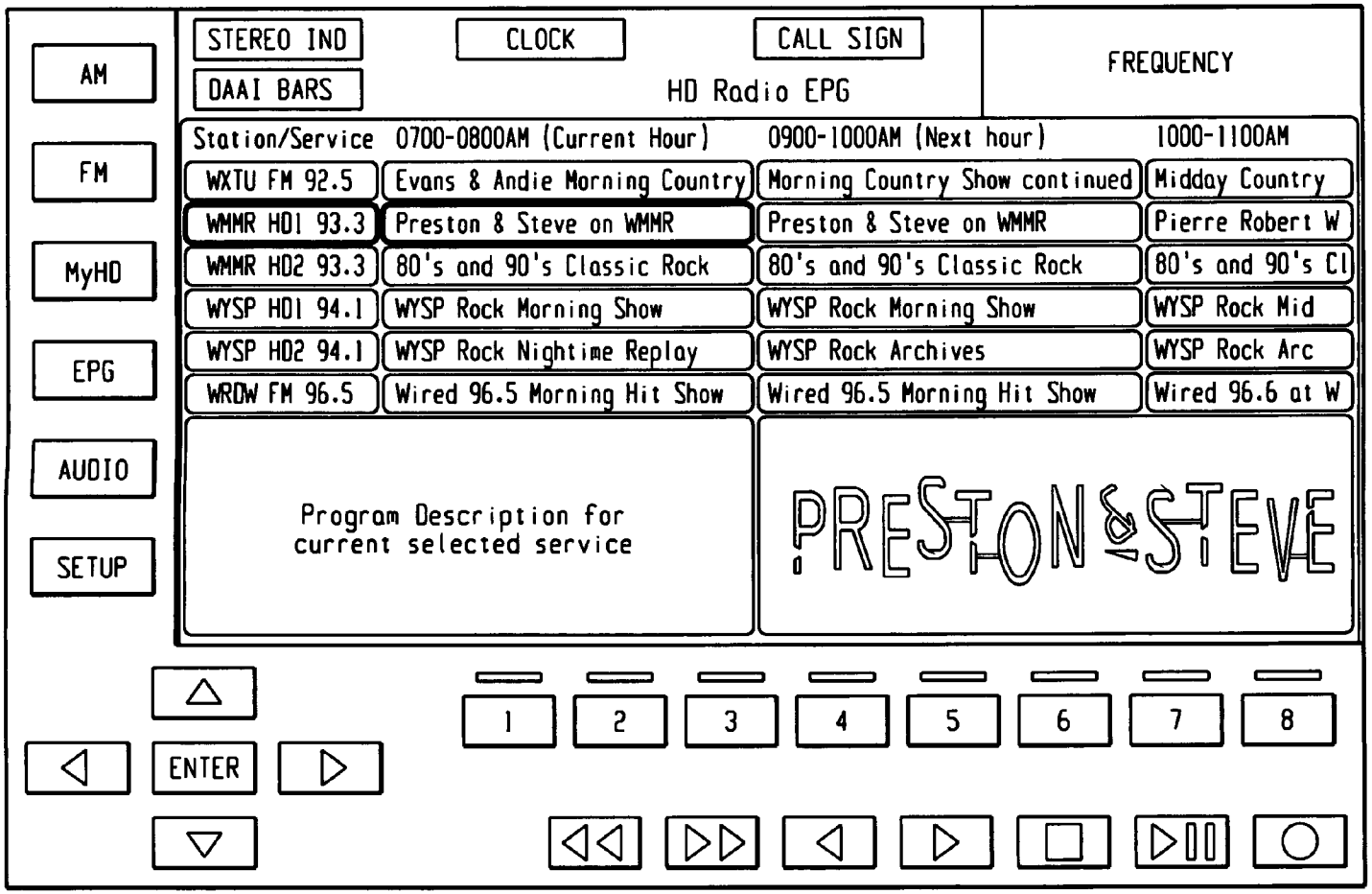
FIG. 26 illustrates an exemplary EPG shown on a display in accordance with certain embodiments.
Figure 27:
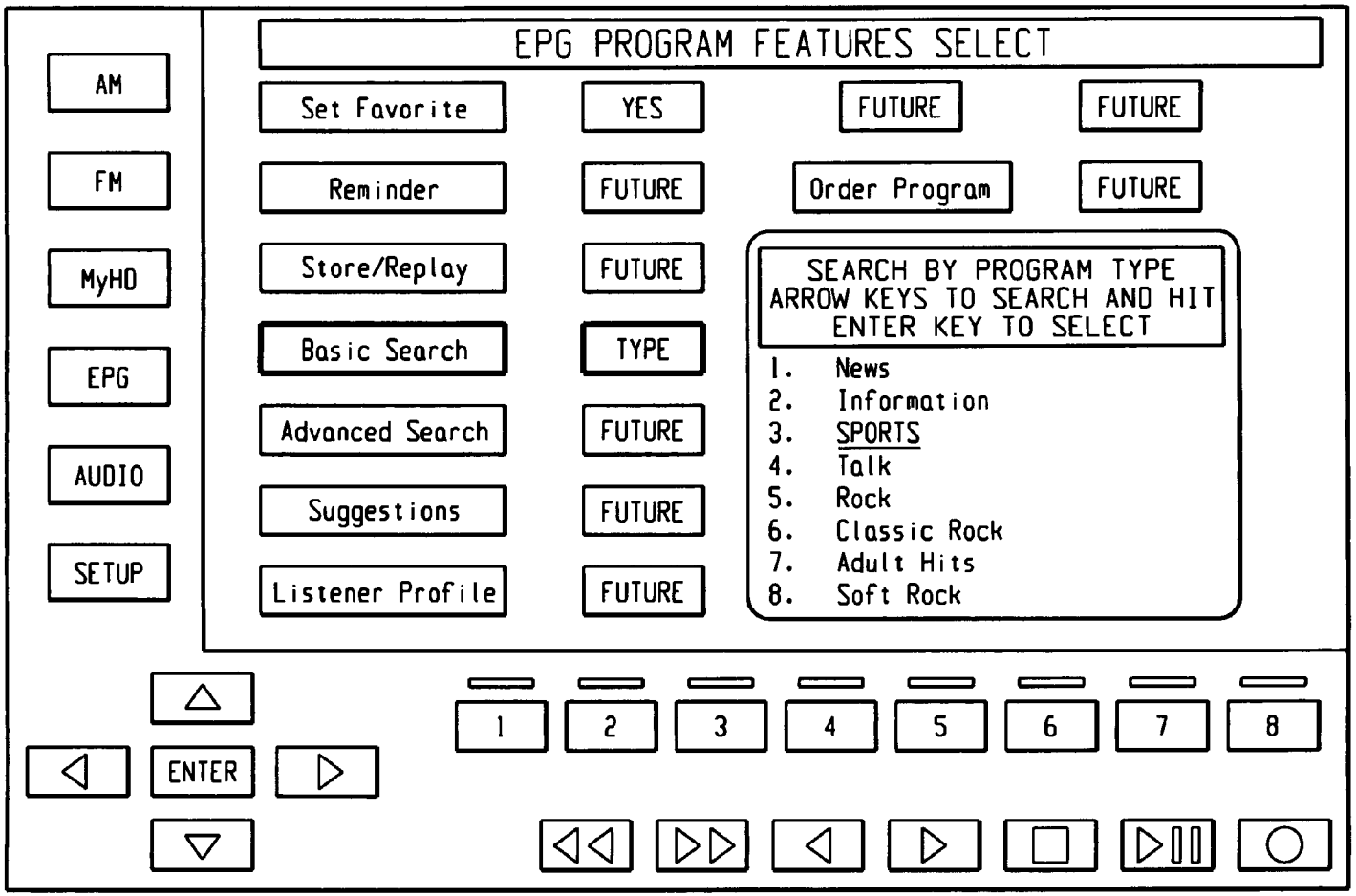
FIG. 27 illustrates an exemplary EPG shown on a display in accordance with certain embodiments.
Figure 28:
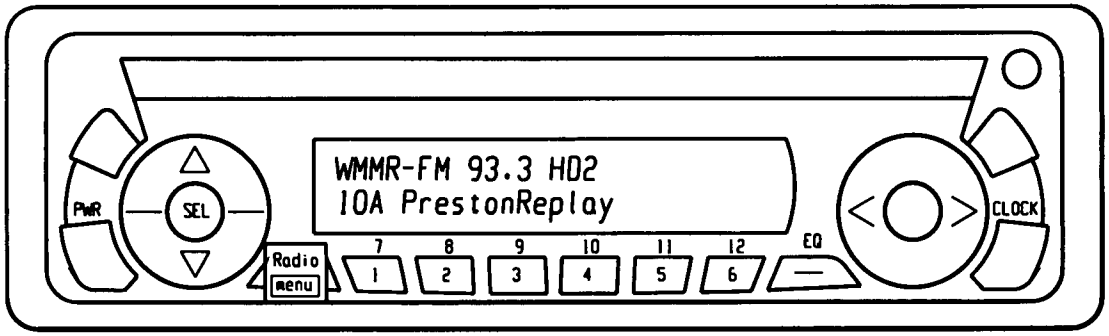
FIG. 28 illustrates an exemplary EPG shown on a display in accordance with certain embodiments.

In other embodiments as illustrated in FIG. 26, the user may be able to browse the programming information using a scrolling display. In this example, the user is provided with navigation arrows for browsing the content. Also shown in the example is multimedia content associated with one of the programs WMMR 93.3 (i.e. the Preston & Steve show). Additionally, the EPG files may be stored in a database such as SQLite that may allow the host controller to perform a database query based on user input. This could enable the user to search for specific program listings by program name, genre, time, or any other suitable criteria. An exemplary search function is illustrated in FIG. 27. In this example, the user is provided with a basic search capability that enables a search by the type of program, e.g., news, information, sports, talk, rock, classic rock, adult hits, and soft rock. FIG. 28 illustrates an exemplary EPG rendered on a receiver having a simple two-line display. In this example, the user can navigate through the current and future programming information using forward and back buttons on the faceplate. The navigation features and menu items can be coded in software using any suitable programming language such as C, C++, or for example and implementing such navigation features and menu items is within the purview of one of ordinary skill in the art.

Figure 29:
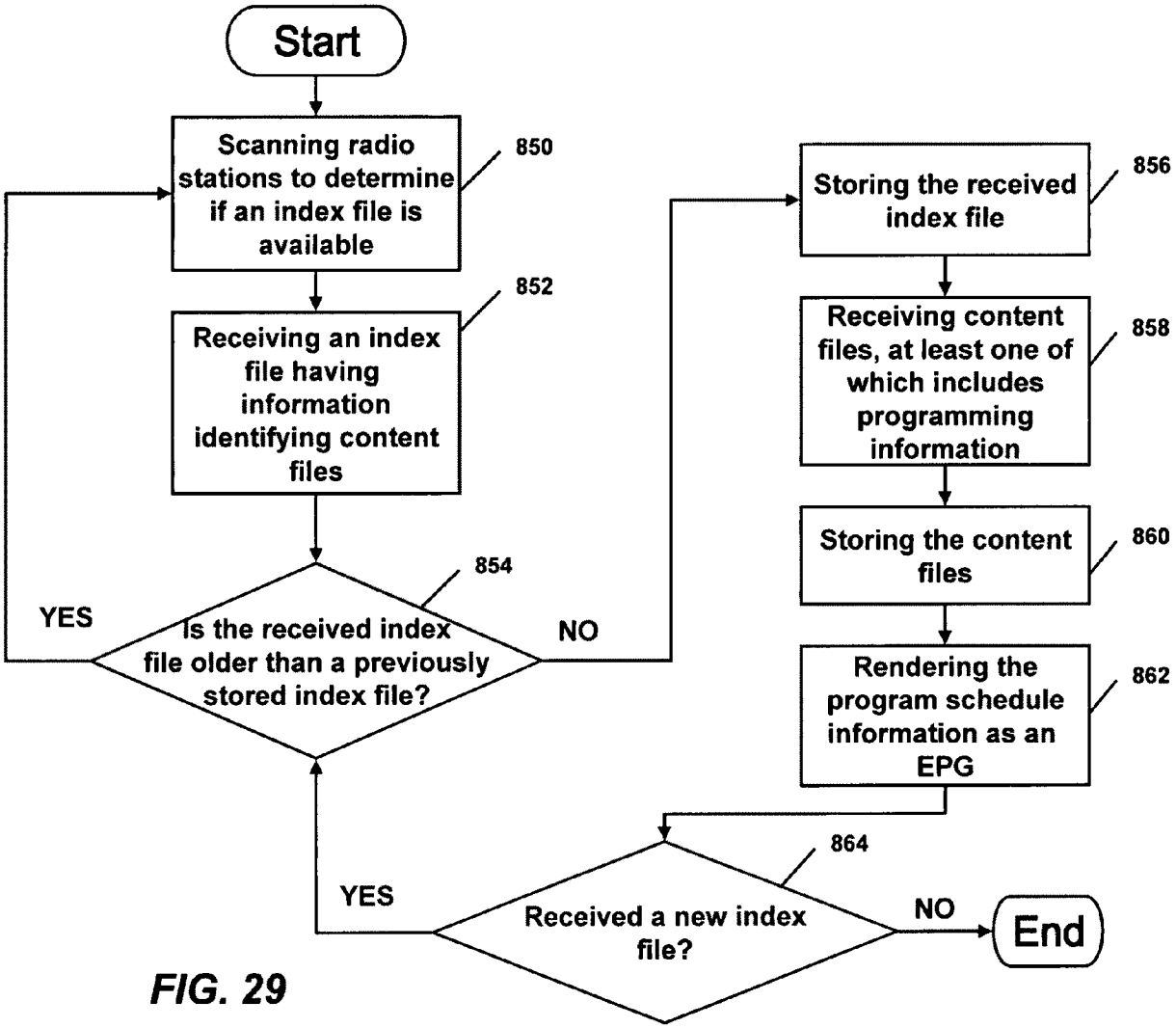
FIG. 29 illustrates an exemplary process for building and rendering an EPG from digital radio broadcast transmissions.

FIG. 29 illustrates an exemplary process for generating an electronic program guide for a digital radio broadcast transmission. The process initiates when the receiver is powered on. In some embodiments, the receiver 200, 251 first scans a plurality of radio stations to determine whether an index file is available on each of the radio stations in step 850. This scan may be automatic or may be user initiated. The scanning comprises tuning to each station, receiving SIS and SIG data, and parsing the data for indicia of EPG service. For example, during scanning the host controller 240, 296 may use SIS data to retrieve the least significant bits of a MIME hash identifying the EPG service (e.g., the 12 least significant bits of a 32-bit MIME hash). If a partial match to an EPG service MIME hash is found, the host controller may retrieve SIG data that contains the full MIME hash value (e.g., the full 32-bit MIME hash). In some embodiments, the host controller may rely upon the SIG data without regard for the SIS data. If a complete match is found, the scan may be stopped and EPG processing may begin.

Next, in step 852 the host controller 240, 296 the signal processing block 201, 251 receives an index file and passes the index file to the host controller 240, 296. The index file may be associated with a specific logical address (e.g., the index file may be assigned to be transmitted over RLS port number 1). The received index file may be received via a byte-stream. As previously described, a byte-stream comprises a plurality of frames of bytes, wherein each frame includes a frame delimiter that indicates the start and the end of the frame, and wherein at least one frame includes a packet delimiter indicating the start of a packet. The received index file contains information identifying the associated content files. As described above, the index file may comprise a SB identifier, a market and/or cluster identifier, a date, a version number, and information identifying content files such as a list of the content file names or binary encoded data that can be used to generate a list of content file names. The list of content file names could comprise the file names and a logical address (e.g., RLS port) associated with each file name. The index file may be in binary format when received and the host controller 240, 296 may decode the index file so that it may be stored in another format (e.g., XML).

In some embodiments, the host controller 240, 296 may have previously stored an index file. In step 854, the host controller compares the version number of the previously stored index file with the version number of the recently received index file. For example, the full index file name may be compared with the full file name of the previously stored index file. If the version number of the recently received index file is the same as the previously stored index file, then the recently received index file may be discarded and the process may start over.

Otherwise, in step 856 the host controller 240, 296 stores the received index file in memory. As described above, the index file could be stored in any suitable storage such as a file system or a database. Next, in step 858 the signal processing block 201, 251 receives and buffers content files, wherein the received content files includes data for displaying programming information. The content files may be formatted as described above. For example, the content files may be received in binary format and may be converted to another format (e.g., XML) by the host controller. The content files may comprise one or a combination of service files, schedule files, and linked content files corresponding to a basic or advanced profile. In some embodiments, each advanced profile content file may be associated with a basic profile content file (e.g., both the basic and advance files relate to the same radio station or program) to facilitate merging the basic and advanced profiles as described above. Some of the content files may be associated with a single radio station, a cluster of radio stations (e.g., a grouping of stations) and/or with a market of radio stations (e.g., a geographic region such as Philadelphia). Advantageously, because the content files may be associated with a cluster or a market, they may be received from a first radio station, but may contain data for displaying programming information of a second radio station. Moreover, a receiver may be able to receive programming information regarding stations that broadcast only in legacy analog waveform and otherwise have no digital or other means of conveying their program schedule.

In some embodiments the content files may be received on specific logical addresses (e.g., a content file may be assigned to be transmitted over a specific RLS port). Also, some logical addresses may be associated with a specific date (e.g., RLS port number 3 may be assigned to day 1). In certain embodiments, multiple logical addresses may be associated with different dates (e.g., RLS port number 3 is associated with day 1 and RLS port number 4 is associated with day 2). The content files also may comprise static service files. The static service files may be associated with a specific logical address (e.g., RLS port number 2 is associated with static service files). In some embodiments the content files are received via a byte stream as previously described.

In some embodiments, the host controller 240, 296 may have previously stored content files. In these cases, the host controller may compare the version number of the previously stored content files with the version numbers of recently received content files that correspond to the previously stored content files (e.g., the content files are for the same radio station and/or radio program) to determine if the previously stored content files are outdated. If the version number of the recently received content file is the same as that of the previously stored content files, then the recently received content file may be discarded and the process may start over.

Otherwise, the host controller 240, 296 stores the at least one received content file in memory. The content files may be stored in any suitable storage such as a file system or a database. The storage process may involve merging advanced profile content files with the associated basic profile content files as described above.

Next, in step 862 the DCU 242, 298 displays the programming information based upon the data from the received content files to a user as an electronic program guide (EPG). The data may be rendered such that the user can view, browse, and/or search the programming information as described above. Advantageously, the data may be customized to the display based on the receiver's display capabilities. For example, for a simple two-line LCD display, the DCU 242, 298 will only render the basic profile data (e.g., station frequency, call sign, and short program name). For an advanced 6" multimedia display, the DCU 242, 298 may render the advanced profile data including long program names and station graphical logos. In some embodiments filtering programming information may be performed according to the end user's choice. For example, the displayed data may be reduced from a comprehensive level to program type only, upon the end user's selection and irrespective of the display's further capabilities. In certain embodiments, the content may include selectable content for triggering other processes inside or outside the receiver. For example, this may provide the capability to start recording a certain program when it starts or to trigger a reminder alarm (e.g., audio and/or audiovisual indicator) when a certain program is scheduled to start.

Finally, in step 864 the host controller determines whether it has received another new index file. If so, the process is restarted; otherwise it is terminated.

The previously described embodiments of the present disclosure have many advantages, including:

One advantage is that in certain embodiments, by including clusters and stations in the EPG, a receiver may be able to receive programming information regarding stations that it can not currently hear. This can be advantageous, for example, in cases where the receiver is mobile and moves within a radio market or cluster. Additionally, a receiver may be able to receive programming information regarding stations that broadcast only in legacy analog waveform and otherwise have no digital or other means of conveying their program schedule.

Another advantage is that in certain embodiments, the EPG data is transmitted in a bandwidth efficient manner by using, for example, broadcast rotation and binary encoding.

Yet another advantage is that in certain embodiments, radio programs may have useful content to trigger other processes inside or outside the receiver. This provides the capability, for example, to start recording a certain program when it starts or to trigger a reminder alarm (e.g., audio and/or audiovisual indicator) when a certain program is scheduled to start.

Another advantage is that in certain embodiments, a SB can aggregate EPG content from multiple content providers, thereby providing commercial opportunities for SB operators.

A further advantage is that in certain embodiments, the end users are provided with a way to intelligently browse through the myriad of available radio programming. This may greatly improve the radio users listening experience.

Still another advantage is that the displayed data may be reduced, for example, from a comprehensive level to program type only, upon end user's selection and irrespective of the display's further capabilities. In some embodiments filtering programming information may be performed according to the end user's choice.

Yet another advantage is that in certain embodiments, the end users are provided an easy way to select and receive the desired content.

Yet another advantage is that in certain embodiments, the end user may be able to search the available radio programming.

Still another advantage is that in certain embodiments, radio stations are partitioned into markets so that a meaningful EPG can be presented even if several AM or FM stations are assigned to the same carrier frequency.

A further advantage is that in certain embodiments the host controller only receives content files associated with relevant dates by receiving data from selected RLS ports. For example, if the host controller is only implementing a 7-day EPG, then it could ignore the RLS ports containing EPG data for days 8-14.

Yet another advantage is that in certain embodiments, radio programs may have useful linked content. This provides the capability, for example, to link a morning show with other talk shows in a market or cluster.

The exemplary approaches described may be carried out using any suitable combinations of software, firmware and hardware and are not limited to any particular combinations of such. Computer program instructions for implementing the exemplary approaches described herein may be embodied on a computer-readable medium, such as a magnetic disk or other magnetic memory, an optical disk (e.g., DVD) or other optical memory, RAM, ROM, or any other suitable memory such as Flash memory, memory cards, etc. Additionally, the disclosure has been described with reference to particular embodiments. However, it will be readily apparent to those skilled in the art that it is possible to embody the disclosure in specific forms other than those of the embodiments described above. The embodiments are merely illustrative and should not be considered restrictive. The scope of the disclosure is given by the appended claims, rather than the preceding description, and all variations and equivalents which fall within the range of the claims are intended to be embraced therein.

What is claimed is:

1. A method of preparing an electronic program guide for broadcast via digital radio broadcast transmission, the electronic program guide including an index file and at least one content file, the method comprising the steps of:

receiving programming information from one or more content providers;

storing the received programming information;

generating at least one content file corresponding to the stored programming information, the at least one content file identifying program names, program times and corresponding radio stations for multiple programs;

generating an index file having information identifying the at least one content file, wherein the index file is associated with a first logical address, and wherein the index file identifies said radio stations;

scheduling the index file and the at least one content file for broadcast to digital radio broadcast receivers via digital radio broadcast transmission, wherein a relative percentage of bandwidth is allocated to the index file and the at least one content file for the electronic program guide, and wherein the index file is scheduled for repeated transmission intermittently relative to the at least one content file; and communicating the index file and the at least one content file for broadcast via digital radio broadcast transmission, the index file and the at least one content file conveying information for displaying the electronic program guide comprising program names, program times and corresponding radio stations for multiple programs at digital radio broadcast receivers, the index file and the at least one content file comprising information for simultaneously displaying the program names, program times and corresponding radio stations for the multiple programs at the digital radio broadcast receivers.

2. The method of claim 1 wherein the at least one content file is associated with a second logical address.

3. The method of claim 2 wherein the second logical address is associated with a first date.

4. The method of claim 3 further comprising the step of generating a second content file corresponding to the programming information, wherein the second content file is associated with a third logical address, and wherein the third logical address is associated with a second date.

5. The method of claim 4 further comprising the step of communicating a transmit pattern file.

6. The method of claim 1 wherein the index file and the at least one content file are XML files.

7. The method of claim 6 comprising the further step of validating the XML files against an XML schema.

8. The method of claim 1 wherein the at least one content file comprises a plurality of content files.

9. The method of claim 8 further comprising prioritizing a broadcast rotation for the plurality of content files.

10. The method of claim 9 comprising the further step of communicating a transmit pattern file.

11. The method of claim 8 wherein the plurality of content files comprises at least one service file and at least one schedule file.

12. The method of claim 11 wherein the at least one service file is scheduled to be broadcast less frequently than the at least one schedule file.

13. The method of claim 11 wherein the at least one service file is static.

14. The method of claim 13 wherein the static service file is associated with a third logical address.

15. The method of claim 8 wherein a first content file of the plurality of content files is associated with a current date, wherein a second content file of the plurality of content files is associated with a future date, and wherein the first content file is scheduled to be broadcast more frequently than the second content file.

16. The method of claim 1 wherein the index file includes a listing of file names.

17. The method of claim 1 wherein the at least one content file comprises a linked content file.

18. The method of claim 1 wherein the at least one content file comprises a basic profile.

19. The method of claim 1 wherein the at least one content file comprises an advanced profile.

20. The method of claim 1 wherein the at least one content file is associated with a cluster of radio stations.

21. The method of claim 1 wherein the at least one content file is associated with a market of radio stations.

22. The method of claim 1 wherein the index file includes a version number.

23. The method of claim 1 wherein the at least one content file includes a version number.

24. The method of claim 1 wherein the index file includes a content file reuse indicator.

25. The method of claim 1, wherein the at least one content file identifies program names, program times and corresponding radio stations for the future programs.

26. A tangible, non-transitory computer readable medium comprising computer program instructions for preparing an electronic program guide for broadcast via digital radio broadcast transmission, the electronic program guide including an index file and at least one content file, said instructions when executed adapted to cause a processing system to execute steps comprising:

receiving programming information from one or more content providers;

storing the received programming information;

generating at least one content file corresponding to the stored programming information, the at least one content file identifying program names, program times and corresponding radio stations for multiple programs;

generating an index file having information identifying the at least one content file, wherein the index file is associated with a first logical address, and wherein the index file identifies said radio stations;

scheduling the index file and the at least one content file for broadcast to digital radio broadcast receivers via digital radio broadcast transmission, wherein a relative percentage of bandwidth is allocated to the index file and the at least one content file for the electronic program guide, and wherein the index file is scheduled for repeated transmission intermittently relative to the at least one content file; and communicating the index file and the at least one content file for broadcast via digital radio broadcast transmission, the index file and the at least one content file conveying information for displaying the electronic program guide comprising program names, program times and corresponding radio stations for multiple programs at digital radio broadcast receivers, the index file and the at least one content file comprising information for simultaneously displaying the program names, program times and corresponding radio stations for the multiple programs at the digital radio broadcast receivers.

27. The non-transitory computer readable medium of claim 26 wherein the at least one content file comprises a plurality of content files.

28. The non-transitory computer readable medium of claim 27 wherein said instructions when executed are adapted to cause the processing system to execute the further step of prioritizing a broadcast rotation for the plurality of content files.

29. The non-transitory computer readable medium of claim 28 wherein said instructions when executed are adapted to cause the processing system to execute the further step of communicating a transmit pattern file.

30. The non-transitory computer readable medium of claim 27 wherein the plurality of content files comprises at least one service file and at least one schedule file.

31. The non-transitory computer readable medium of claim 30 wherein the at least one service file is scheduled to be broadcast less frequently than the at least one schedule file.

32. The non-transitory computer readable medium of claim 26 wherein the at least one content file comprises a linked content file.

33. The non-transitory computer readable medium of claim 26 wherein the at least one content file is associated with a cluster of radio stations.

34. The non-transitory computer readable medium of claim 26 wherein the at least one content file is associated with a market of radio stations.

35. The non-transitory computer readable medium of claim 26 wherein the index file includes a content file reuse indicator.

36. A system for preparing an electronic program guide for broadcast via digital radio broadcast transmission, the electronic program guide including an index file and at least one content file, the system comprising:

a processing system; and a memory coupled to the processing system, wherein the processing system is configured to execute steps comprising:

receiving programming information from one or more content providers storing the received programming information;

generating at least one content file corresponding to the stored programming information, the at least one content file identifying program names, program times and corresponding radio stations for multiple programs;

generating an index file having information identifying the at least one content file, wherein the index file is associated with a first logical address, and wherein the index file identifies said radio stations;

scheduling the index file and the at least one content file for broadcast to digital radio broadcast receivers via digital radio broadcast transmission, wherein a relative percentage of bandwidth is allocated to the index file and the at least one content file for the electronic program guide, and wherein the index file is scheduled for repeated transmission intermittently relative to the at least one content file; and communicating the index file and the at least one content for broadcast via digital radio broadcast transmission, the index file and the at least one content file conveying information for displaying the electronic program guide comprising program names, program times and corresponding radio stations for multiple programs at digital radio broadcast receivers, the index file and the at least one content file comprising information for simultaneously displaying the program names, program times and corresponding radio stations for the multiple programs at the digital radio broadcast receivers.

37. The system of claim 36 wherein the at least one content file comprises a plurality of content files.

38. The system of claim 37 wherein said processing system is configured to execute the further step of prioritizing a broadcast rotation for the plurality of content files.

39. The system of claim 38 wherein said processing system is configured to execute the further step of communicating a transmit pattern file.

40. The system of claim 37 wherein the plurality of content files comprises at least one service file and at least one schedule file.

41. The system of claim 40 wherein the at least one service file is scheduled to be broadcast less frequently than the at least one schedule file.

42. The system of claim 36 wherein the at least one content file comprises a linked content file.

43. The system of claim 36 wherein the at least one content file is associated with a cluster of radio stations.

44. The system of claim 36 wherein the at least one content file is associated with a market of radio stations.

45. The system of claim 36 wherein the index file includes a content file reuse indicator.

46. A method of preparing an electronic program guide for broadcast via digital radio broadcast transmission, the electronic program guide including an index file and at least one content file, the method comprising the steps of:

receiving an index file having information identifying at least one content file, wherein the index file is associated with a first logical address, the index file identifying radio stations associated with programming information identified in the at least one content file;

receiving the at least one content file corresponding to programming information for program content to be broadcast, the at least one content file identifying program names, program times and corresponding radio stations for multiple programs;

storing the index file and the at least one content file; and communicating the index file and the at least one content file to an importer at a transmission side in accordance with a broadcast rotation for subsequent broadcast transmission to digital radio broadcast receivers, wherein a relative percentage of bandwidth is allocated to the index file and the at least one content file for the electronic program guide, and wherein the index file is scheduled for repeated transmission intermittently relative to the at least one content file, the index file and the at least one content file conveying information for displaying the electronic program guide comprising program names, program times and corresponding radio stations for multiple programs at digital radio broadcast receivers, the index file and the at least one content file comprising information for simultaneously displaying the program names, program times and corresponding radio stations for the multiple programs at the digital radio broadcast receivers.

47. The method of claim 46 wherein the at least one content file comprises a plurality of content files, and the index file and the plurality of content files are XML files.

48. The method of claim 46 wherein the at least one content file comprises a plurality of content files, the method comprising binary encoding the index file and the plurality of content files.

49. The method of claim 46 wherein the at least one content file comprises a plurality of content files, and wherein transmitting the index file and the plurality of content files to an importer in accordance with the broadcast rotation is performed asynchronously.

50. The method of claim 46 wherein the at least one content file comprises a plurality of content files, and wherein at least one of the plurality of content files is a static service file and at least one of the plurality of content files is a schedule file.

51. The method of claim 50 further comprising the step of receiving a transmit pattern file having file broadcast frequencies.

52. The method of claim 51 wherein transmitting the index file and the plurality of content files to the importer in accordance with the broadcast rotation is performed in accordance with the file broadcast frequencies of the transmit pattern file.

53. The method of claim 46 wherein the at least one content file comprises a plurality of content files, and wherein each content file is associated with a second logical address.

54. The method of claim 53 wherein the second logical address is associated with a date.

55. The method of claim 54 comprising the further step of receiving a plurality of content files corresponding to programming information for program content to be broadcast, wherein each content file is associated with a third logical address.

56. The method of claim 55 wherein the second logical address is associated with a first date and the third logical address is associated with a second date.

57. The method of claim 56 comprising the further step of receiving a transmit pattern file, wherein transmitting the index file and the plurality of content files to the importer in accordance with the broadcast rotation is performed in accordance with the file broadcast frequencies of the transmit pattern file.

58. The method of claim 46 wherein the at least one content file comprises a plurality of content files, and wherein selected ones of the content files are associated with a cluster of radio stations.

59. The method of claim 46 wherein the at least one content file comprises a plurality of content files, and wherein selected ones of the content files are associated with a radio station market.

60. The method of claim 46 wherein the at least one content file comprises a plurality of content files, the method comprising segmenting the content files in a packet mode.

61. The method of claim 46 wherein the at least one content file comprises a plurality of content files, the method comprising segmenting the content files in a byte-streaming mode.

62. The method of claim 46 wherein the index file includes a content file reuse indicator.

63. A tangible, non-transitory computer readable medium comprising computer program instructions for preparing an electronic program guide for broadcast via digital radio broadcast transmission, the electronic program guide including an index file and at least one content file, said instructions when executed adapted to cause a processing system to execute steps comprising:

receiving an index file having information identifying at least one content file, wherein the index file is associated with a first logical address, the index file identifying radio stations associated with programming information identified in the at least one content file;

receiving the at least one content file corresponding to programming information for program content to be broadcast, the at least one content file identifying program names, program times and corresponding radio stations for multiple programs;

storing the index file and the at least one content file; and communicating the index file and the at least one content file to an importer at a transmission side in accordance with a broadcast rotation for subsequent broadcast transmission to digital radio broadcast receivers, wherein a relative percentage of bandwidth is allocated to the index file and the at least one content file for the electronic program guide, and wherein the index file is scheduled for repeated transmission intermittently relative to the at least one content file, the index file and the at least one content file conveying information for displaying the electronic program guide comprising program names, program times and corresponding radio stations for multiple programs at digital radio broadcast receivers, the index file and the at least one content file comprising information for simultaneously displaying the program names, program times and corresponding radio stations for the multiple programs at the digital radio broadcast receivers.

64. A system for preparing an electronic program guide for broadcast via digital radio broadcast transmission, the electronic program guide including an index file and at least one content file, the system comprising:

a processing system; and a memory coupled to the processing system, wherein the processing system is configured to execute steps comprising:

receiving an index file having information identifying at least one content file, wherein the index file is associated with a first logical address, the index file identifying radio stations associated with programming information identified in the at least one content file;

receiving the at least one content file corresponding to programming information for program content to be broadcast, the at least one content file identifying program names, program times and corresponding radio stations for multiple programs;

storing the index file and the at least one content file; and communicating the index file and the at least one content file to an importer at a transmission side in accordance with a broadcast rotation for subsequent broadcast transmission to digital radio broadcast receivers, wherein a relative percentage of bandwidth is allocated to the index file and the at least one content file for the electronic program guide, and wherein the index file is scheduled for repeated transmission intermittently relative to the at least one content file, the index file and the at least one content file conveying information for displaying the electronic program guide comprising program names, program times and corresponding radio stations for multiple programs at digital radio broadcast receivers, the index file and the at least one content file comprising information for simultaneously displaying the program names, program times and corresponding radio stations for the multiple programs at the digital radio broadcast receivers.

65. The system of claim 64 wherein the processing system is configured to communicate a transmit pattern file.

66. The system of claim 64 wherein the at least one content file comprises a linked content file.

67. The system of claim 64 wherein the at least one content file is associated with a cluster of radio stations.

68. The system of claim 64 wherein the at least one content file is associated with a market of radio stations.

69. The system of claim 64 wherein the index file includes a content file reuse indicator.

70. A method of generating an electronic program guide at a digital radio broadcast receiver for a digital radio broadcast transmission comprising the steps of:

scanning a plurality of radio stations at a digital radio broadcast receiver to generate a list of stations having electronic program guide service available;

selecting a radio station from the list of stations;

receiving a first index file via the selected radio station at the digital radio broadcast receiver, the first index file having a first version number, and storing the first index file;

receiving a second index file via the selected radio station at the digital radio broadcast receiver, the second index file having a second version number, and storing the second index file if the second version number is newer than the first version number, the second index file including information identifying at least one content file and identifying radio stations associated with programming information identified in the at least one content file;

receiving the at least one content file at the digital radio broadcast receiver, wherein the at least one received content file includes data for displaying programming information, and wherein the at least one content file identifies program names, program times and corresponding radio stations for multiple programs;

storing the at least one received content file; and generating at the digital radio broadcast receiver an electronic program guide comprising the programming information based upon the data from the at least one received content file, the programming information including program names, program times and identifications of corresponding radio stations for multiple programs.

71. The method of claim 70 wherein the information identifying the at least one content file comprises a file name.

72. The method of claim 70 wherein the received index file and the at least one received content file are in a binary format.

73. The method of claim 70 wherein the at least one received content file comprises a service file.

74. The method of claim 70 wherein the at least one received content file comprises a schedule file.

75. The method of claim 70 wherein the at least one received content file comprises a plurality of content files.

76. The method of claim 75 wherein selected ones of the plurality of content files are associated with a single radio station.

77. The method of claim 75 wherein selected ones of the plurality of content files are associated with a cluster of radio stations.

78. The method of claim 75 wherein selected ones of the plurality of content files are associated with a radio station market.

79. The method of claim 75 wherein at least one of the plurality of content files comprises a basic profile content file, and at least one of the plurality of content files comprises an advanced profile content file associated with the basic profile content file.

80. The method of claim 79 comprising the further step of merging the advanced profile content file with the associated basic profile content file.

81. The method of claim 75 wherein at least one of the plurality of content files comprises a linked content file.

82. The method of claim 70 wherein the received index file and the at least one received content file are stored in a file system.

83. The method of claim 70 wherein the received index file and the at least one received content file are stored in a database.

84. The method of claim 70 wherein the received index file and the at least one received content file are stored in non-volatile memory.

85. The method of claim 70 wherein the received index file includes a version number.

86. The method of claim 70 wherein the received index file is received via a first logical address.

87. The method of claim 86 wherein the first logical address comprises a first radio link subsystem port.

88. The method of claim 87 wherein the at least one received content file is received via a second logical address.

89. The method of claim 88 wherein the second logical address is a second radio link subsystem port.

90. The digital radio broadcast receiver system of claim 86 wherein the received index file is received via a first logical address and wherein the first logical address comprises a first radio link subsystem port.

91. The method of claim 70 wherein the received index file is received via a byte stream, the byte stream comprising a plurality of frames of bytes, wherein each frame includes a frame delimiter that indicates the start and the end of the frame, and wherein at least one frame includes a packet delimiter indicating the start of a packet.

92. The method of claim 91 wherein the at least one received content file is received via the byte stream.

93. The method of claim 70 comprising the step of providing at least one previously stored content file associated with the previously stored index file.

94. The method of claim 93 comprising the further step of replacing the at least one previously stored content file with the received content file if the first version number is older than the second version number.

95. The method of claim 70 comprising the further step of scanning a plurality of radio stations to determine whether an index file is available on each of the radio stations.

96. The method of claim 70 wherein the received index file is received from a first radio station.

97. The method of claim 96 wherein the at least one content file contains data for displaying programming information of a second radio station.

98. The method of claim 70 comprising the further step of rendering the programming information based upon the data from the at least one received content file to the user such that the user can browse the programming information.

99. The method of claim 70 comprising the further step of rendering the programming information based upon the data from the at least one received content file to the user such that the user can search the programming information.

100. The method of claim 70 wherein the step of displaying the programming information includes the step of customizing the display based on receiver memory capabilities.

101. The method of claim 70 wherein the index file includes a content file reuse indicator.

102. The method of claim 70 wherein the at least one received content file includes a version number.

103. The method of claim 70 wherein the step of displaying the programming information includes the step of filtering the programming information according to a user's choice.

104. The method of claim 70 wherein the programming information includes information relating to stations that broadcast only a legacy analog waveform and otherwise have no digital or other means of conveying their programming information.

105. The method of claim 70 wherein the programming information includes selectable content for triggering another process.

106. A tangible, non-transitory computer readable medium comprising computer program instructions adapted to cause a processing system at a digital radio broadcast receiver to execute steps comprising:

scanning a plurality of radio stations at a digital radio broadcast receiver to generate a list of stations having electronic program guide service available;

selecting a radio station from the list of stations;

receiving a first index file via the selected radio station at the digital radio broadcast receiver, the first index file having a first version number, and storing the first index file;

receiving a second index file via the selected radio station at the digital radio broadcast receiver, the second index file having a second version number, and storing the second index file if the second version number is newer than the first version number, the second index file including information identifying at least one content file and identifying radio stations associated with programming information identified in the at least one content file;

receiving the at least one content file at the digital radio broadcast receiver, wherein the at least one received content file includes data for displaying programming information, and wherein the at least one content file identifies program names, program times and corresponding radio stations for multiple programs;

storing the at least one received content file; and generating at the digital radio broadcast receiver an electronic program guide comprising the programming information based upon the data from the at least one received content file, the programming information including program names, program times and identifications of corresponding radio stations for multiple programs.

107. A digital radio broadcast receiver system for generating an electronic program guide from a digital radio broadcast transmission:

a processing system; and a memory coupled to the processing system, wherein the processing system is configured to execute steps comprising:

scanning a plurality of radio stations at a digital radio broadcast receiver to generate a list of stations having electronic program guide service available;

selecting a radio station from the list of stations;

receiving a first index file via the selected radio station at the digital radio broadcast receiver, the first index file having a first version number, and storing the first index file;

receiving a second index file via the selected radio station at the digital radio broadcast receiver, the second index file having a second version number, and storing the second index file if the second version number is newer than the first version number, the second index file including information identifying at least one content file and identifying radio stations associated with programming information identified in the at least one content file;

receiving the at least one content file at the digital radio broadcast receiver, wherein the at least one received content file includes data for displaying programming information, and wherein the at least one content file identifies program names, program times and corresponding radio stations for multiple programs;

storing the at least one received content file; and generating at the digital radio broadcast receiver an electronic program guide comprising the programming information based upon the data from the at least one received content file, the programming information including program names, program times and identifications of corresponding radio stations for multiple programs.

108. The digital radio broadcast receiver system of claim 107 wherein the at least one received content file comprises a service file.

109. The digital radio broadcast receiver system of claim 107 wherein the at least one received content file comprises a schedule file.

110. The digital radio broadcast receiver system of claim 107 wherein the at least one received content file comprises a plurality of content files.

111. The digital radio broadcast receiver system of claim 110 wherein selected ones of the plurality of content files are associated with a cluster of radio stations.

112. The digital radio broadcast receiver system of claim 110 wherein selected ones of the plurality of content files are associated with a radio station market.

113. The digital radio broadcast receiver system of claim 110 wherein at least one of the plurality of content files comprises a basic profile content file, and at least one of the plurality of content files comprises an advanced profile content file associated with the basic profile content file.

114. The digital radio broadcast receiver system of claim 110 wherein at least one of the plurality of content files comprises a linked content file.

115. The digital radio broadcast receiver system of claim 107 wherein the received index file is received via a byte stream, the byte stream comprising a plurality of frames of bytes, wherein each frame includes a frame delimiter that indicates the start and the end of the frame, and wherein at least one frame includes a packet delimiter indicating the start of a packet.

116. The digital radio broadcast receiver system of claim 107 wherein the index file includes a content file reuse indicator.

117. The digital radio broadcast receiver system of claim 107 wherein the at least one received content file includes a version number.

118. The digital radio broadcast receiver system of claim 107 wherein displaying the programming information includes filtering the programming information according to a user's choice.

* * * * *